US006732950B2

(12) United States Patent
Ingham, Jr. et al.

(10) Patent No.: US 6,732,950 B2
(45) Date of Patent: May 11, 2004

(54) GEAR DRIVE SPRINKLER

(75) Inventors: John W. Ingham, Jr., Tucson, AZ (US); Jerry D. Lawyer, Benson, AZ (US); Charles D. Lemme, Tucson, AZ (US); Michael A. McAfee, Tucson, AZ (US); Derek M. Nations, Tucson, AZ (US); Matthew S. Prucinsky, Irvine, CA (US); David E. Steimle, Tucson, AZ (US)

(73) Assignee: Rain Bird Corporation, Glendora, CA (US)

( * ) Notice: Subject to any disclaimer, the term of this patent is extended or adjusted under 35 U.S.C. 154(b) by 228 days.

(21) Appl. No.: 10/053,532

(22) Filed: Jan. 15, 2002

(65) Prior Publication Data

US 2002/0092924 A1 Jul. 18, 2002

Related U.S. Application Data

(60) Provisional application No. 60/262,026, filed on Jan. 16, 2001.

(51) Int. Cl.[7] ..... B05B 15/10

(52) U.S. Cl. ..... 239/205; 239/206; 239/580

(58) Field of Search ..... 239/200, 203–206, 239/237, 240, 228, 570, 571, 575, 580

(56) References Cited

U.S. PATENT DOCUMENTS 4,353,506 A * 10/1982 Hayes ..... 239/206
5,685,486 A * 11/1997 Spenser ..... 239/242
5,716,004 A * 2/1998 Byles ..... 239/205
6,186,413 B1 * 2/2001 Lawson ..... 239/205
6,491,235 B1 * 12/2002 Scott et al. ..... 239/206
6,502,764 B2 * 1/2003 Walker ..... 239/203

* cited by examiner

*Primary Examiner*—Gene Mancene
*Assistant Examiner*—Thach H. Bui
(74) *Attorney, Agent, or Firm*—John D. Bauersfeld; Kelly Bauersfeld Lowry & Kelley, LLP

(57) ABSTRACT

An improved gear drive sprinkler has a pop-up spray head adapted for adjustable part-circle or full circle operation to deliver irrigation water over a selected terrain area. The sprinkler includes a pop-up riser; a gear drive transmission mounted within the riser includes a water-driven turbine for rotatably driving a speed reduction gear train, which in turn rotatably drives the spray head. A reverse assembly includes an upper trip unit defining an individually adjustable pair of end trip stops, and a lower shift mechanism including a shiftable director plate having first and second sets of angularly oriented jet nozzles for respective alignment with turbine jet ports for respectively driving the water-driven turbine and the gear train in a forward-drive or a reverse-drive direction. The upper trip is coupled to the director plate by an elongated trip rod which shifts the director plate between forward-drive and reverse drive positions. An adjustment cam can be manipulated to disable at least one of the end trip stops to permit spray head rotation through continuous full circle revolutions.

64 Claims, 36 Drawing Sheets

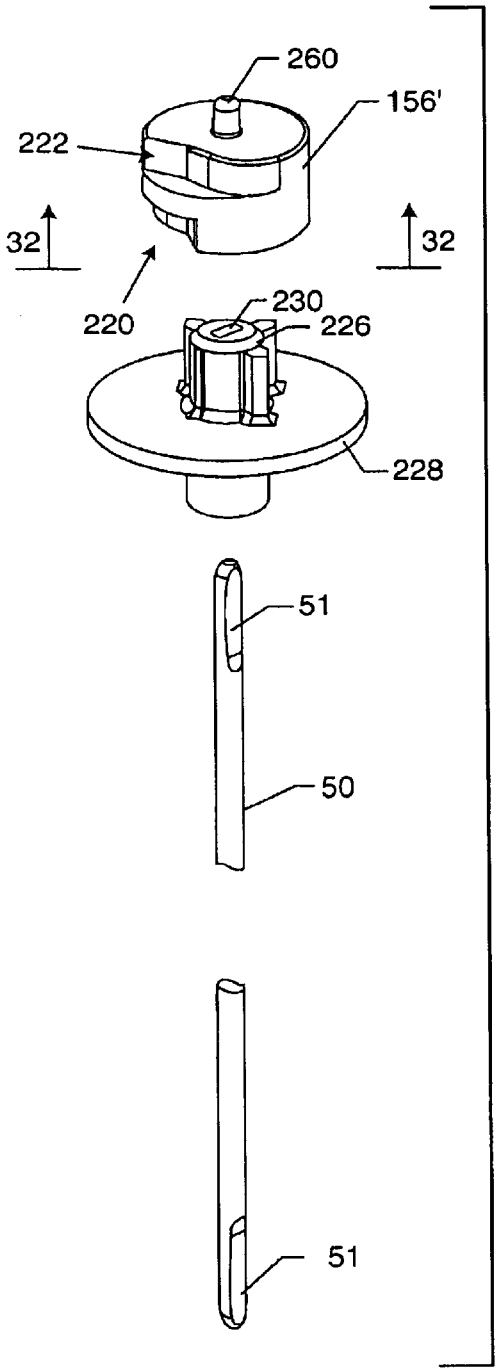
FIG. 31
FIG. 32
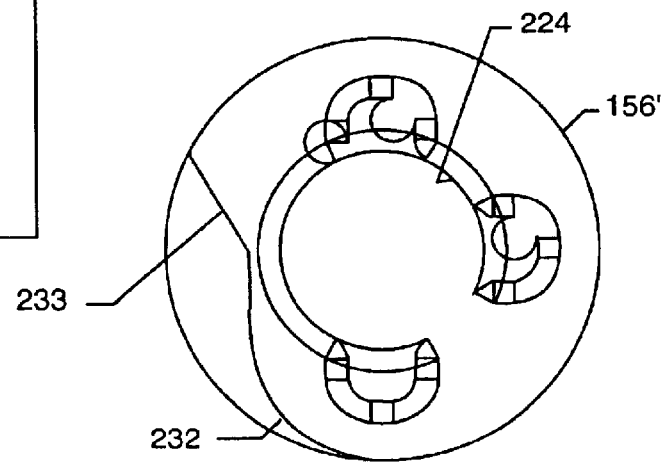

GEAR DRIVE SPRINKLER

RELATED APPLICATION

This application claims priority from Provisional Application Serial No. 60/262,026, filed Jan. 16, 2001.

BACKGROUND OF THE INVENTION

This invention relates generally to irrigation sprinklers of the type having a rotary driven spray head mounted at the upper end of a pop-up riser. More particularly, this invention relates to an improved irrigation sprinkler having a gear drive transmission for rotatably driving the pop-up spray head, and incorporating an improved reverse mechanism for quickly and easily setting the sprinkler for part-circle spray head rotation between a pair of individually adjustable end trip stops, or for continuous full circle rotation. The reverse mechanism further provides improved resistance to vandal-caused damage such as attempted forced rotation of the spray head beyond one of the end trip stops.

Pop-up irrigation sprinklers are well known in the art particularly for use in irrigation systems wherein it is necessary or desirable to embed the sprinkler in the ground so that it does not project appreciably above ground level when not in use. In a typical pop-up sprinkler, a tubular riser is mounted within a generally cylindrical upright sprinkler housing or case having an open upper end, with a spray head carrying one or more spray nozzles mounted at an upper end of the riser. In a normal inoperative position, the spray head and riser are spring-retracted substantially into the sprinkler case so that they do not extend or project a significant distance above the case or the surrounding ground level. However, when water under pressure is supplied to the sprinkler case, the riser is displaced upwardly to shift the spray head to an elevated spraying position spaced above the sprinkler case. The water under pressure flows through a vertically oriented nozzle passage in the riser to the spray head which includes one or more appropriately shaped spray nozzles for projecting a stream or streams of irrigation water generally radially outwardly over a surrounding terrain area and associated vegetation.

In many pop-up sprinklers, a rotary drive mechanism is provided within the sprinkler case for rotatably driving the spray head through continuous full circle revolutions, or alternately back and forth within a predetermined part-circle path, to sweep the projected water stream over a selected target terrain area. In one common form, the rotary drive mechanism comprises a water-driven turbine which is rotatably driven by at least a portion of the water under pressure supplied to the sprinkler case, wherein this turbine rotatably drives a speed reduction gear drive transmission coupled in turn to the rotary mounted spray head. A pair of end trip stops is normally provided to engage and operate a reverse mechanism for reversing the direction of spray head rotation upon movement to the opposite end limits of a predetermined part-circle arcuate path of motion, with at least one of these end trips stops normally being positionally adjustable to variably select the permitted range of spray head motion. In addition, means are normally provided for selectively disabling one of these end trip stops to achieve continuous full circle spray head rotation, if desired. For examples of rotary drive sprinklers of this general type, see U.S. Pat. Nos. 4,787,558; and 5,383,600. Such sprinklers are commercially available from Rain Bird Sprinkler Mfg. Corp. of Glendora, Calif. under the product designations T-Bird Series, 3500 Series, R-50 Series, Falcon, and Talon.

Rotary gear drive sprinklers of this general type beneficially provide relatively accurate and controlled delivery of irrigation water with a substantially uniform water distribution over a target terrain area. However, such sprinklers have not been totally satisfactory.

SUMMARY OF THE INVENTION

In accordance with the invention, an improved gear drive sprinkler is provided with a rotatably driven pop-up spray head for delivering one or more outwardly projected streams of irrigation water to surrounding terrain and vegetation. The sprinkler includes a reverse mechanism for reversing the direction of spray head rotation back-and-forth movement through a part-circle path between a pair of individually adjustable end trip stops. The reverse mechanism is resistant to vandal-caused damage such as an attempt to manually force-rotate of the spray head beyond one of the pre-set end trip stops. In that event, a releasible clutch disengages to permit such over-rotation of the spray head without damage to sprinkler components. Upon release of the spray head, the spray head is rotatably driven back to within the pre-set part-circle path whereupon the releasible clutch re-engages for resumed reversible movement between the pre-set end trip stops.

In a preferred form on the invention, the pop-up spray head is mounted at the upper end of a tubular riser which is in turn mounted within a hollow sprinkler housing or case for pressure responsive pop-up movement from a normal position retracted substantially within the sprinkler housing to an elevated spraying position. A water-driven turbine is rotatably driven by inflow of water under pressure into the sprinkler housing, and this turbine is linked via a speed reduction gear drive transmission to the spray head for rotatably driving the spray head at a selected rotational speed. A flow regulator unit is desirably provided at an upstream side of the turbine for bypassing a portion of the water inflow past the turbine in a manner to maintain a substantially constant rotational turbine speed.

The reverse mechanism comprises a lower shift cartridge including a shiftable deflector plate positioned at the upstream side of the turbine. This deflector plate includes at least one and preferably multiple sets of angularly oppositely oriented jet nozzles for imparting a forward-drive or a reverse-drive circumferential swirl to the water flow directed to the turbine. The deflector plate is movable between a forward-drive position for circumferentially swirling the water flow to drive the turbine in one direction, and a reverse-drive position for circumferentially swirling the water flow to drive the turbine in an opposite direction. At least one and preferably multiple over-center springs are provided to retain the deflector plate in the selected forward-drive or reverse-drive position.

The reverse mechanism further includes an upper trip unit mounted within the spray head. The upper trip unit comprises a trip core linked via an elongated trip rod to the deflector plate for shifting the deflector plate between the forward-drive and reverse-drive positions. The trip core is engaged by a pair of end trip stops which rotate with the spray head. The positions of the two end trips stops are individually adjustable to permit spray head rotation back-and-forth within a part-circle arcuate path in any selected azimuthal direction and pattern width. Upon engagement of an end stop with the trip core, the trip core is rotatably driven through a short stroke sufficient to shift the deflector plate in a manner reversing the direction of spray head movement.

In accordance with a primary aspect of the invention, the upper trip unit of the reverse mechanism includes the reversible clutch adapted to disengage upon attempted forced over-rotation of the spray head. In one preferred form, the reversible clutch comprises a clutch plate mounted at an upper end of the trip rod, in combination with a clutch spring for normally urging the trip core and clutch plate into rotatably engaged relation. In the event that the spray head is manually force-rotated beyond either one of the two end trip stops with a force exceeding the engagement force applied by the clutch spring, the trip core and clutch plate disengage to permit such over-rotation without damage to components such as the end trip stops. Upon resumed operation, the sprinkler spray head will be rotatably driven back to a position within the pre-set arcuate path, whereupon the trip core and clutch plate will re-align and re-engage for resumed spray head movement within the pre-set arcuate pattern.

The improved sprinkler further includes an adjustment cam mounted within the spray head and accessible from the exterior thereof for selectively disabling one or both of the end trip stops, for setting the spray head for continuous full circle revolutions. The adjustment cam includes at least one cam pin engageable with the reverse mechanism. In one preferred form, the adjustment cam is engageable with the trip core for disengaging the trip core from the associated clutch plate to effectively disable both end trip stops. In an alternative preferred form, the adjustment cam is adapted to disengage a trip spring associated with one of the end trip stops. In either case, disablement of one or both of the end trip stops disconnects the upper trip unit from the lower shift cartridge for at least one direction of spray head movement, resulting in spray head rotation through repeated full circle revolutions.

The improved gear drive sprinkler of the present invention may further include an improved plug seal member for closing and sealing an auxiliary inlet to the sprinkler housing. The plug seal member comprises a plug core threadably fitted into an adapter sleeve fixed into the auxiliary inlet to the housing. The adapter sleeve includes a pliant seal lip disposed generally at an inboard end of the plug core, wherein this pliant seal lip is designed for pressure-caused deformation upon supply of water under pressure to the housing interior. The pressure-deformed seal lip is forced against the inboard end of the plug core, into sealing relation therewith, to prevent undesired water leakage from the sprinkler housing through the auxiliary inlet.

In accordance with a further feature of the invention, the improved sprinkler may include means for temporarily supporting the pop-up riser in a partially elevated position to facilitate service and maintenance, such as replacement of one or more spray nozzles mounted on the spray head. In this regard, the pop-up riser includes a lower peripheral flange having at least one gap formed therein for registry with a vertically elongated internal guide rib formed within the sprinkler housing to prevent riser rotation relative to the sprinkler housing. However, the guide rib additionally includes a gap formed therein at a generally mid-height location. The riser can thus be manually elevated to align the flange thereon with the rib gap, whereupon the riser can be rotated through a short part-circle stroke to position a portion of the flange within the rib gap. In this position, the rib will support the riser in a mid-height position for facilitated access to and service of sprinkler components.

The water-driven turbine may also include a brake means for limiting turbine rotational speed, particularly wherein compressed air is used to flush components of the sprinkler system. The brake means comprises at least one and preferably a pair of balanced centrifugal brake arms adapted to displace radially outwardly against a turbine housing or shroud in response to turbine rotation above a predetermined threshold level. The frictional engagement of the brake arms with the turbine housing or shroud effectively restricts turbine rotational speed to prevent excess wear or component damage attributable to compressed air flush-out or the like.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 31 is an exploded perspective view illustrating a trip core forming a portion of the modified upper trip unit of FIG. 29;

FIG. 32 is a horizontal sectional view taken generally on the line 32—32 of FIG. 31, illustrating the underside of the trip core;

DETAILED DESCRIPTION OF THE PREFERRED EMBODIMENTS

Figure 1:
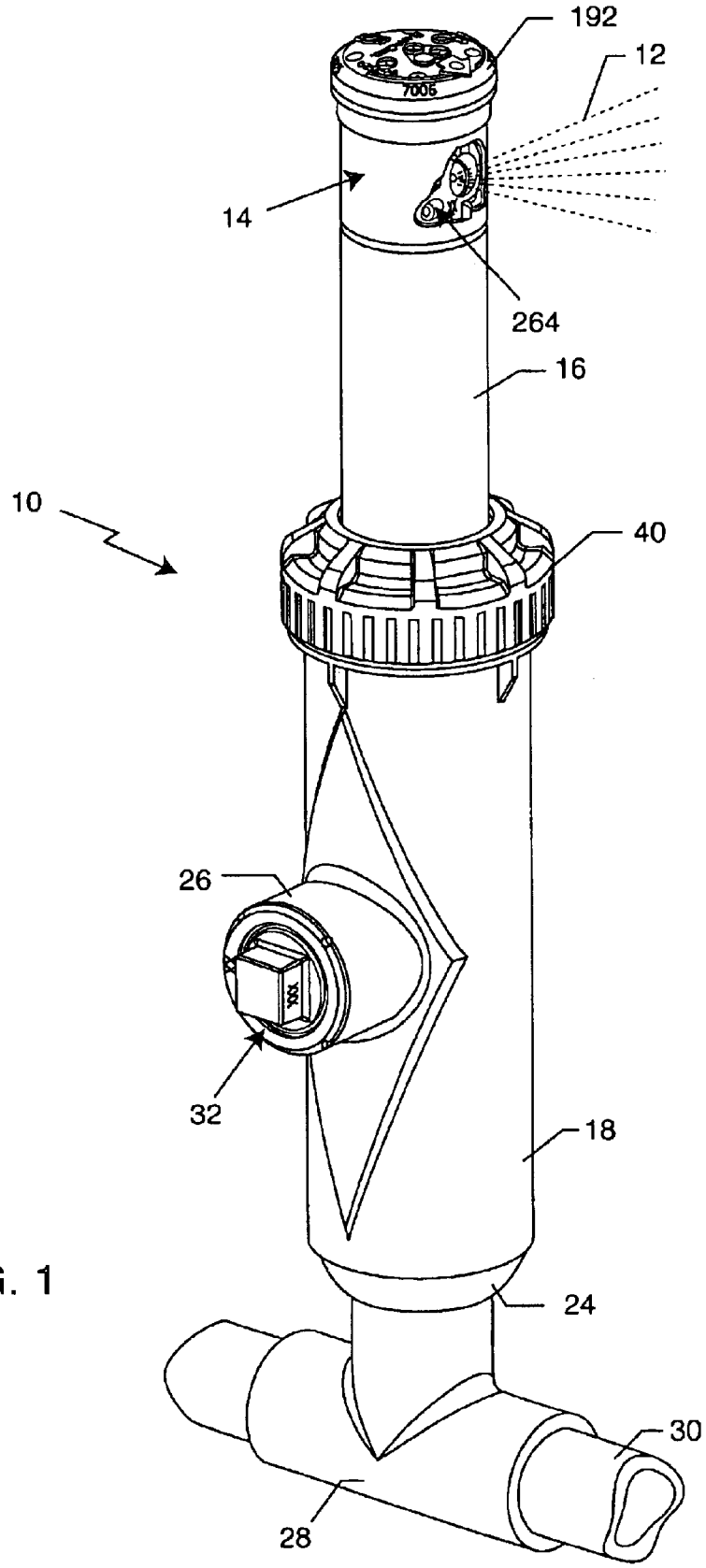
FIG. 1 is a perspective view illustrating a gear driven pop-up sprinkler for part-circle or full circle operation, constructed in accordance with the novel features of the invention.

As shown in the exemplary drawings, an improved gear drive sprinkler referred to generally in FIG. 1 by the reference numeral 10 is provided for delivering irrigation water 12 from a rotatably driven spray head 14 to a surrounding terrain area to irrigate vegetation such as turf grass, shrubs and the like. The spray head 14 is carried at an upper end of a pop-up riser 16 which is mounted within a sprinkler case or housing 18 and adapted for pop-up movement to an elevated spraying position (as viewed in FIG. 1) in response to supply of water under pressure to the sprinkler housing 18. The improved sprinkler 10 includes a speed reduction gear drive transmission 20 (FIGS. 3–6 and 12–14) for rotatably driving the spray head 14 in a manner distributing the irrigation water over the surrounding terrain. A reverse assembly 22 (FIGS. 3–11, 15, and 17–28) provides a pair of end trip stops which can be individually adjusted to shift the drive output of the gear drive transmission 20 for repeated back-and-forth rotary driving of the spray head 14 within an adjustably selected part-circle arcuate path, or to permit continuous full circle rotary driving of the spray head.

The improved gear drive sprinkler 10 of the present invention beneficially permits selective individual adjustment of both end trip stops of the reverse assembly or mechanism 22, so that the spray head 14 can be operated within a pre-set arcuate range to distribute irrigation water over a custom-selected terrain area of narrow to broad arcuate pattern width and aimed in any azimuthal direction relative to the sprinkler housing 18. The reverse assembly incorporates a releasible clutch which enables these adjustably set end trip stops to withstand forced over-rotation without breakage and without altering the set positions thereof. Accordingly, following an unauthorized manual forced rotation of the spray head 14 by vandals or the like to alter the water spray pattern or to damage the rotary drive mechanism, the sprinkler 10 of the present invention rotates the spray head back to a position within the prior-set arcuate range and then resumes normal back-and-forth part-circle operation. In a full circle mode, one or both of the end trip stops can be disabled, such as by disengagement of the releasible clutch, to permit spray head rotation through continuous full circle revolutions. Individual adjustment of the two end trip stops to select the specific arcuate spray pattern, or to set the spray head for full circle rotation, may be accomplished quickly and easily from the exterior of the sprinkler without requiring disassembly of any portion of the sprinkler 10.

As shown generally in FIGS. 1–4, the improved sprinkler 10 generally comprises the outer case or housing 18 having a generally upright cylindrical configuration formed typically from a lightweight yet rugged injection molded plastic or the like. The illustrative sprinkler housing 18 defines a lower water inlet 24 formed at a bottom end thereof, and may also include a side inlet 26 defined by a cylindrical boss protruding laterally outwardly from one side thereof. FIG. 1 shows the lower inlet 24 coupled by a tee fitting 28 or the like to a water supply line 30 through which a supply of irrigation water under pressure is supplied to the interior of the sprinkler housing 18, whereas the side inlet 26 is shown closed by a plug seal member 32 to be described herein in more detail. It will be appreciated, however, that the water supply line 30 may be suitably coupled to the sprinkler housing 18 via the side inlet 26, in which event the lower inlet 24 would be closed by the plug seal member 32.

Figure 2:
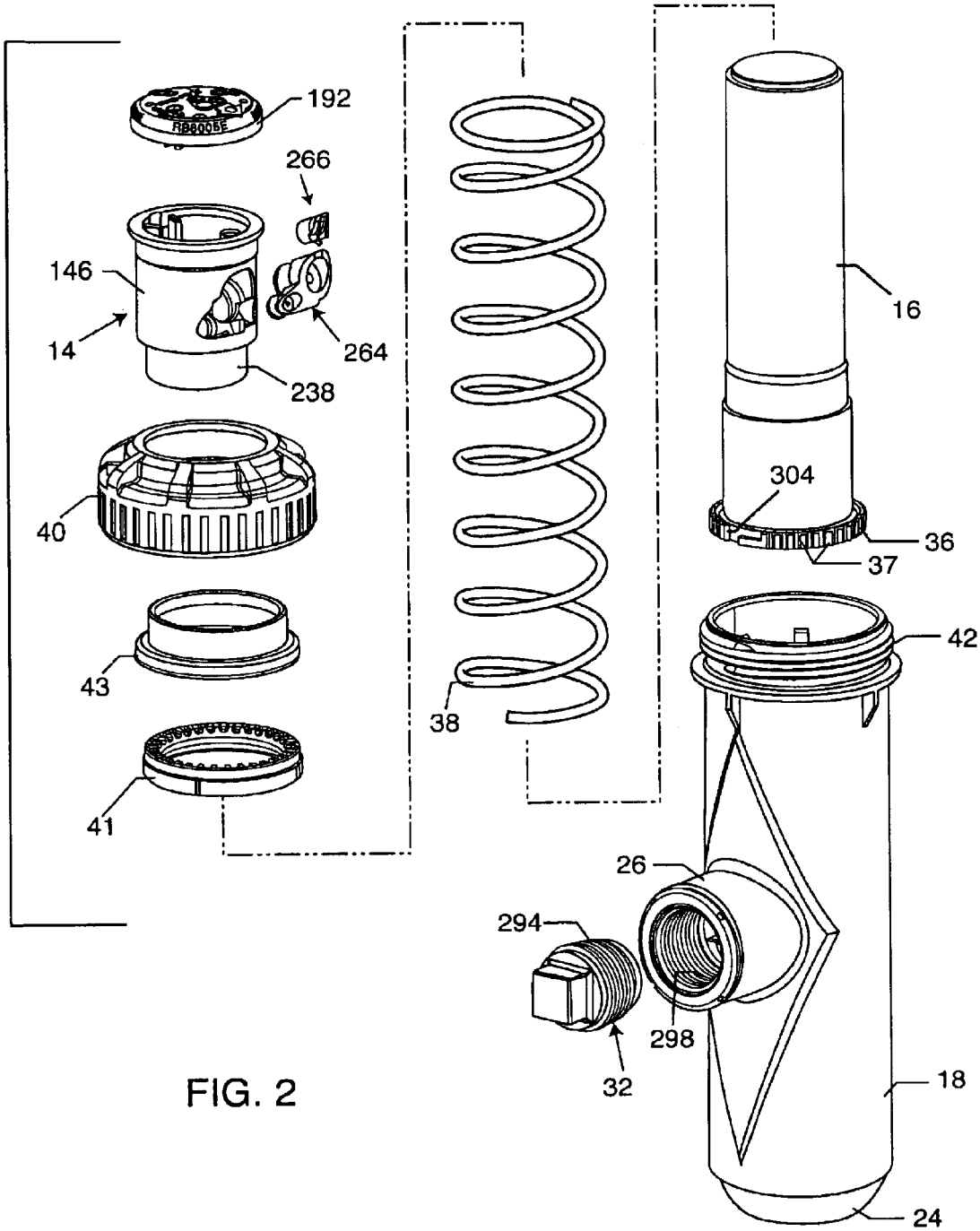
FIG. 2 is an exploded perspective view of the sprinkler of FIG. 1.
Figure 3:
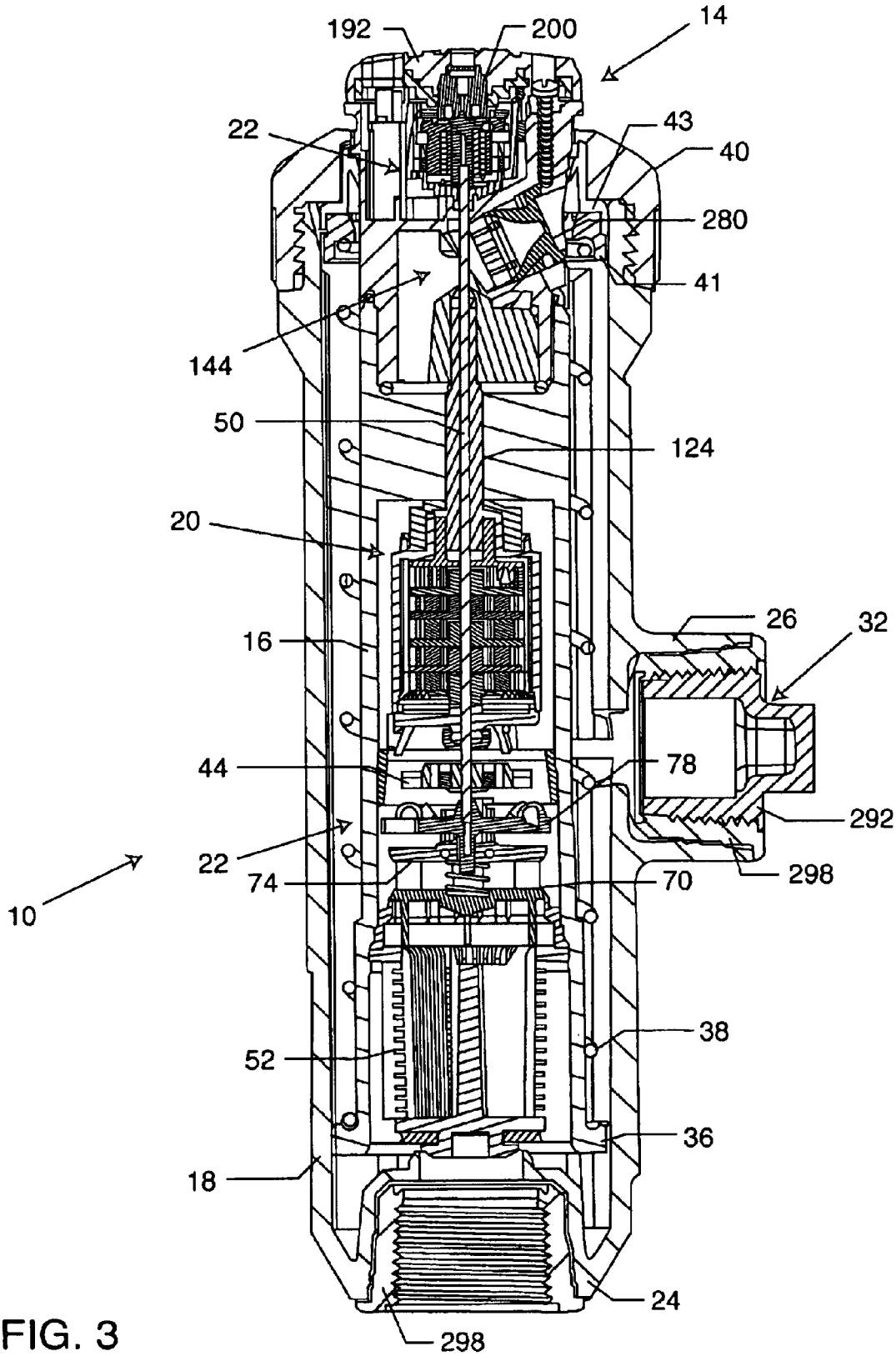
FIG. 3 is an enlarged vertical sectional view of the sprinkler shown in FIG. 1, depicted with a pop-up riser in a lowered position retracted substantially within a sprinkler housing.
Figure 4:
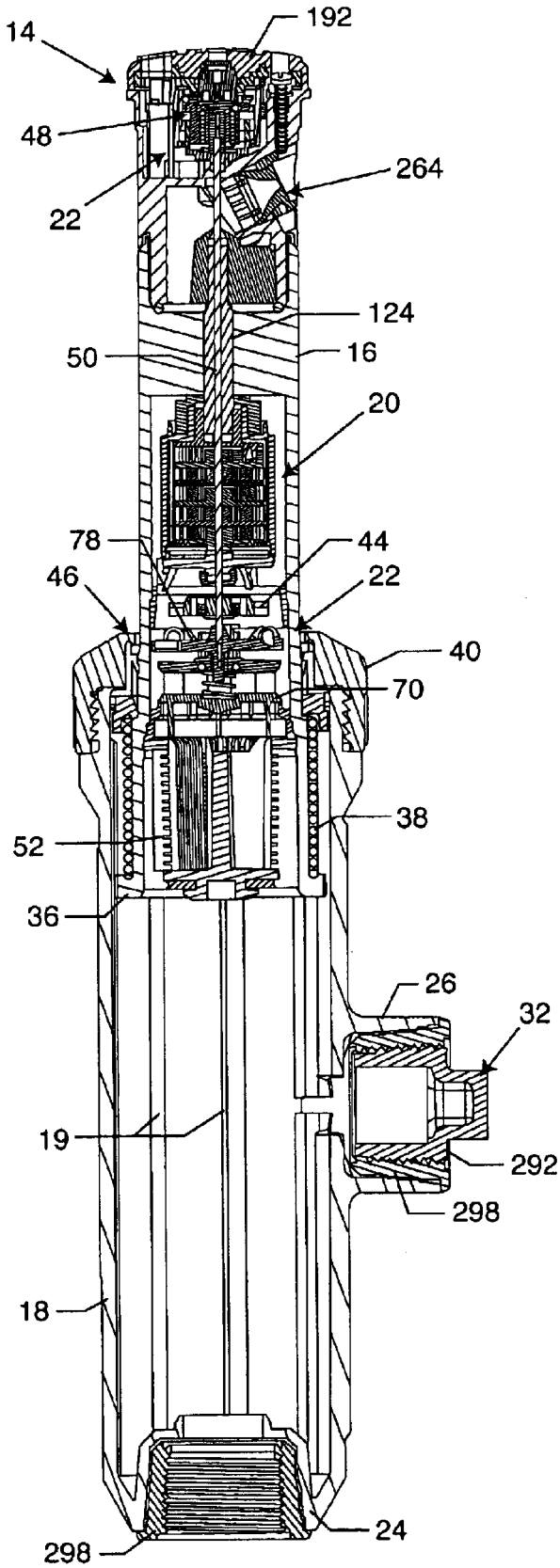
FIG. 4 is a vertical sectional view similar to FIG. 3, but showing the pop-up riser in an elevated operating or spraying position with a riser-mounted spray head elevated above the sprinkler housing.

The pop-up riser 16 generally comprises an elongated hollow riser tube having a size and shape for slide-fit reception into the interior of the sprinkler housing 18. This riser tube 16, which may also be constructed conveniently and economically from a lightweight molded plastic, has a radially outwardly protruding flange 36 (FIGS. 2–5) at a lower end thereof defining a seat for receiving and supporting a lower end of a riser spring 38. This riser spring 38 is coiled about the exterior of the riser tube 16 and has an upper end seated against an inboard or lower side of an annular housing cover or cap 40. As shown best in FIG. 2, an upper end of the housing 18 includes an externally threaded segment 42 to accommodate thread-on mounting of the cap 40. The spring 38 reacts between the cap 40 and the riser flange 36 to spring-bias and normally retain the pop-up riser 16 in a retracted position withdrawn substantially into the interior of the sprinkler housing 18, with an upper end of the spray head 14 substantially seated upon the annular cap 40 (FIG. 3). When water under pressure is supplied to the interior of the housing 18, the water acts against the bottom of the pop-up riser 16 to force the riser to translate upwardly against the force applied by the spring 38, to raise the spray head 14 to an elevated spraying position (FIGS. 1 and 4) disposed above the annular cap 40. The water under pressure supplied to the sprinkler housing 18 also provides the motive power for rotatably driving the spray head 14, as will be described in more detail. A ring-shaped wiper seal 43 (FIGS. 2 and 3) may be carried by the annular cap 40 for slidably engaging the riser 16 during pop-up and pop-down movement thereof, to reduce or eliminate intrusion of grit and the like into the sprinkler housing 18. In this regard, FIGS. 2 and 3 show the wiper seal 43 seated against the underside of the cap 40 by a bearing ring 41 carried at the upper end of the riser spring 38. In addition, the riser flange 36 normally includes external teeth 37 (FIG. 2) for engaging internal vertically elongated ribs 19 (FIG. 4) formed within the sprinkler housing 18 to prevent relative rotation between the riser 16 and housing 18 during pop-up and pop-down riser movement.

Figure 5:
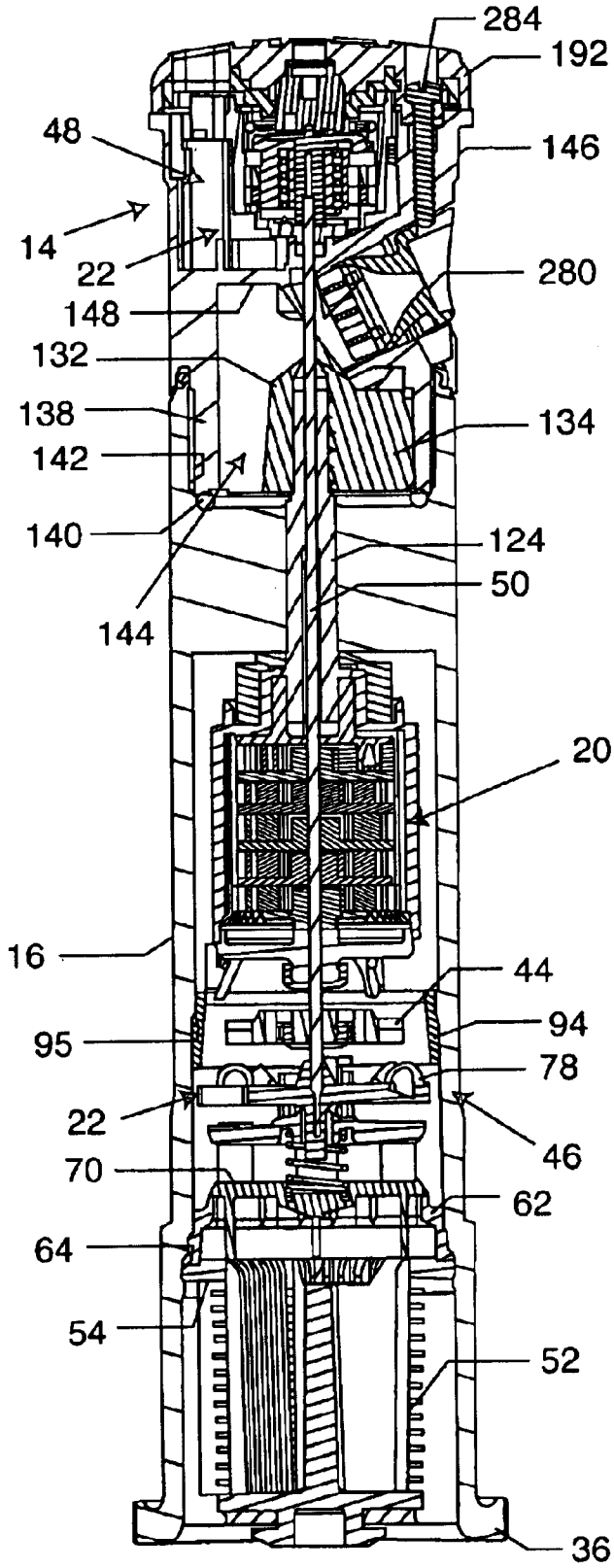
FIG. 5 is an enlarged vertical sectional view of the pop-up riser shown in FIGS. 3 and 4.

FIG. 5 shows the pop-up riser 16 in enlarged vertical section, to illustrate the gear drive transmission 20 and the associated reverse assembly 22 mounted therein. More particularly, the gear drive transmission 20 generally comprises a water-driven turbine 44 which is rotatably driven by water under pressure flowing into the interior of the sprinkler housing 18 (e.g., via the lower water inlet 24) and passing upwardly through the riser tube 16 to the spray head 14. The turbine 44 thus provides a rotary drive source which is linked through the gear drive transmission 20 for rotatably driving the spray head 14 in a manner distributing the irrigation water 12 over the prescribed terrain area. Importantly, the direction of this rotary drive output from the turbine 44 and the associated gear drive transmission 20 is controlled by a lower shift mechanism or cartridge 46 forming a portion of the reverse assembly 22. The lower shift cartridge 46 responds to rotation of the spray head 14 back-and-forth between a pair of end trip stops defined by an upper trip unit 48 mounted within the spray head, and also forming a portion of the reverse assembly 22, to shift or switch the direction of rotary driving of the turbine 44. In this manner, the direction of spray head rotation is repeatedly reversed for back-and-forth movement between the end trip stops. As shown, the upper trip unit 48 is coupled to the lower shift cartridge 46 by an elongated trip rod 50 extending downwardly from the spray head 14 through the elements of the gear drive transmission 20.

Figure 6:
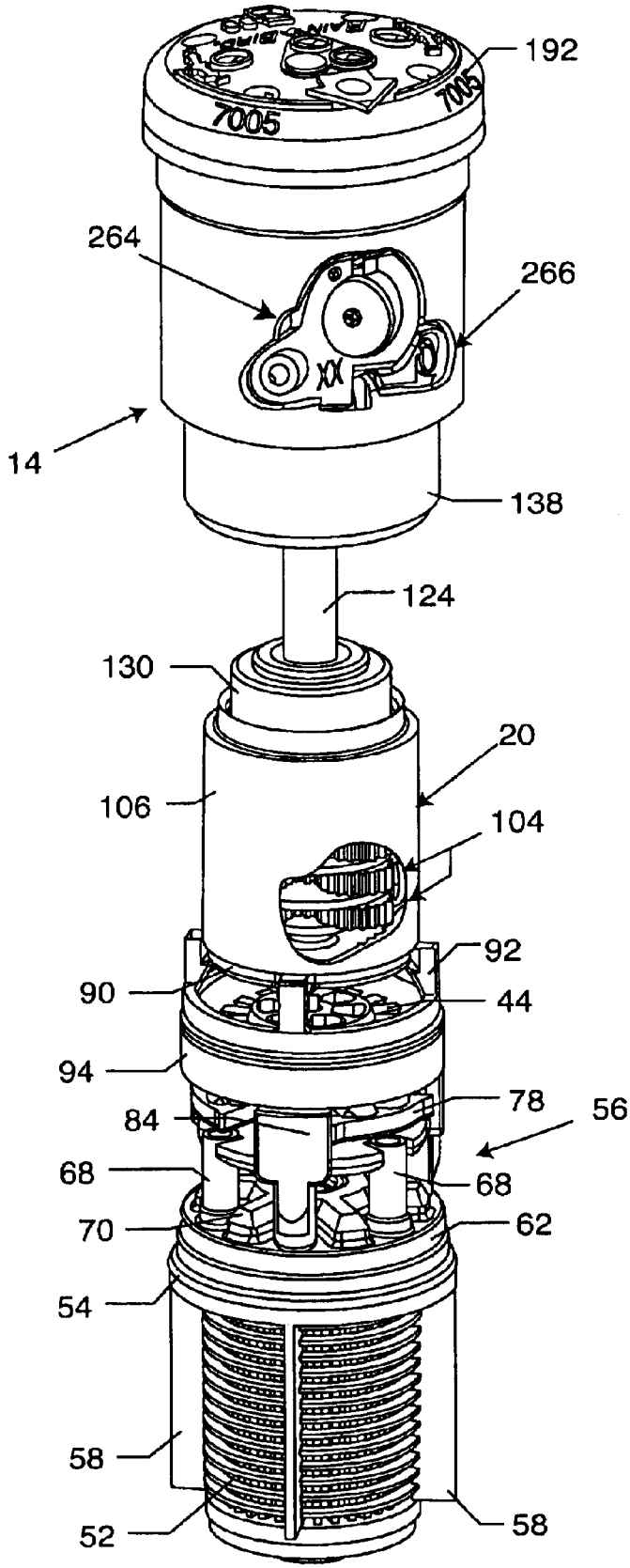
FIG. 6 is an exploded perspective view illustrating portions of the sprinkler for mounting in and on the pop-up riser, including an inlet filter, a flow regulator unit, a water-driven turbine, a speed reduction gear drive transmission, a rotatable spray head, and an adjustable part-circle reverse assembly.
Figure 7:
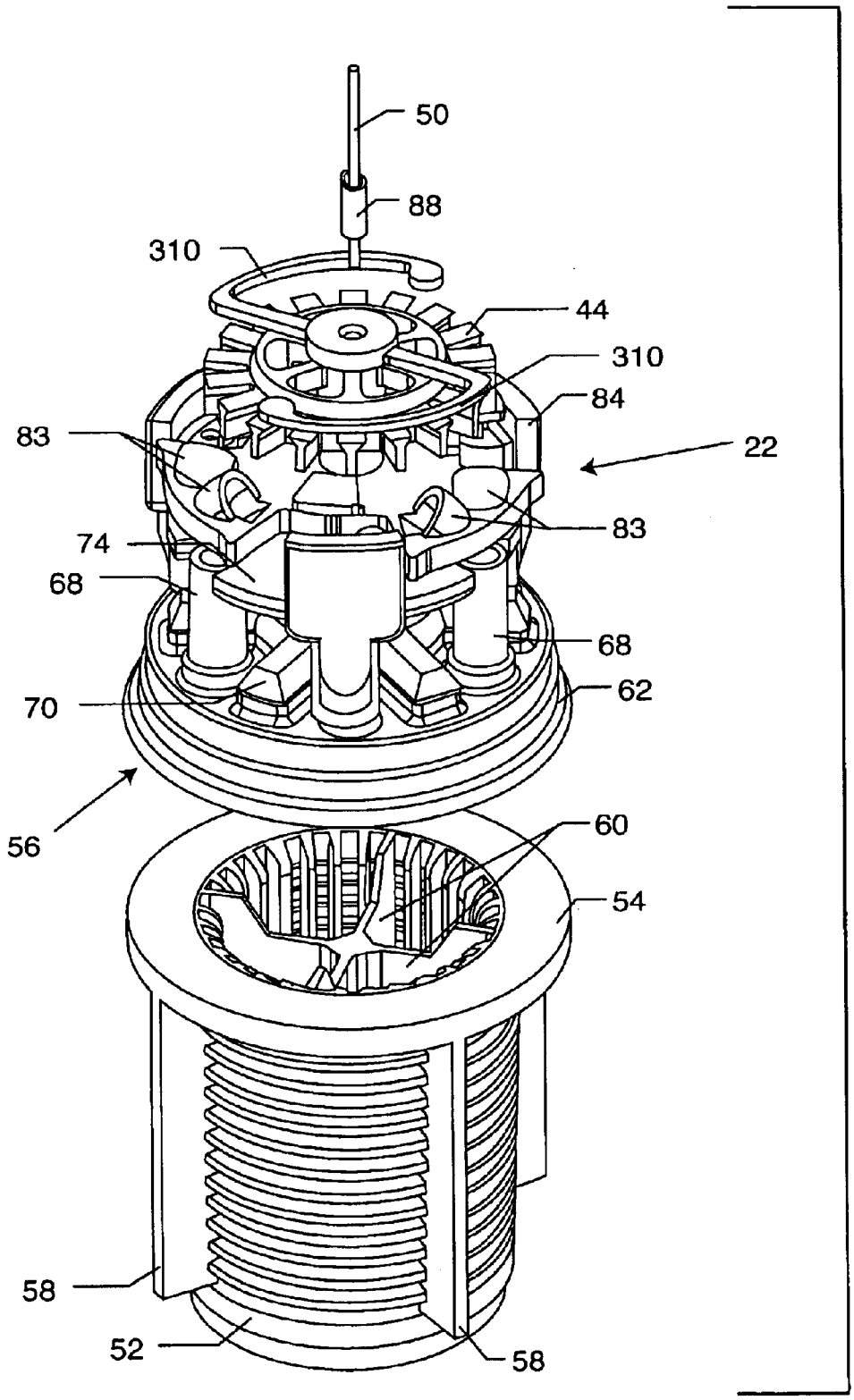
FIG. 7 is an enlarged perspective view of the inlet filter shown in assembled exploded relation with the flow regulator unit, a lower shift mechanism forming a portion of the reverse assembly, and the water-driven turbine and brake.

As shown in FIGS. 5–7, an inlet filter 52 is mounted within a lower end of the riser tube 16 to collect small water-borne debris such as small pebbles and the like to prevent flow passage of such debris into potentially damaging contact with moving sprinkler parts, such as the turbine 44, the gear drive transmission 20, and the related reverse assembly 22. The preferred geometry for the inlet filter 52 comprises a generally annular perforated basket defining a perforated bottom wall joined to an upstanding perforated side wall, the upper end of which carries an upper annular rim 54 (FIG. 7) to seat against an overlying flow regulator unit 56. The inlet filter 52 further includes a plurality of radially outwardly extending external guide rails 58 for retaining the basket-shaped filter in a generally centered position within the riser tube 16, with the perforated side wall of the basket spaced radially inwardly from the wall of the riser tube 16. In addition, the filter basket 52 also includes internal diametrically extending support ribs 60, preferably arranged in an X-shaped configuration as viewed best in FIG. 7, to prevent undesired collapse of the cylindrical wall of the perforated filter basket in response to a pressure differential attributable to accumulated debris on the perforated walls of the basket.

The upper end of the inlet filter 52 is designed for quick and easy assembly in abutting relation with the underside of the flow regulator unit 56, as by snap-fit reception of the basket upper rim 54 to engage a stepped shoulder 64 (FIG. 5) formed in the riser tube 16 near the lower end thereof. In this regard, as viewed in FIG. 5, the flow regulator unit 56 includes a frame 62 having an externally stepped geometry for similar snap-fit or seated engagement with the stepped shoulder 64 formed in the riser tuber 16. The frame 62 of the flow regulator unit 56 defines a central bypass flow port 66

Figure 8:
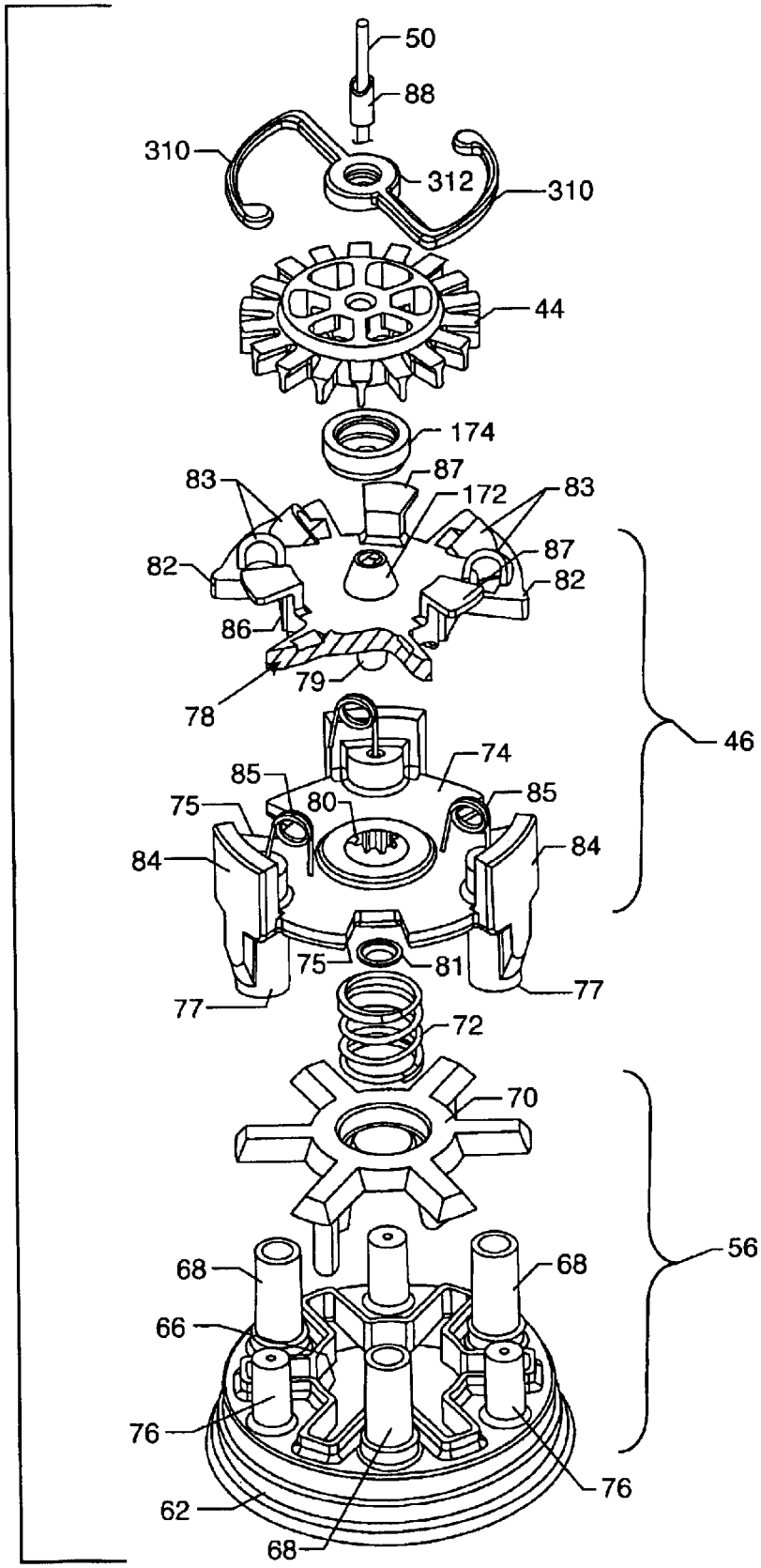
FIG. 8 is an enlarged exploded perspective view depicting further construction details of the flow regulator unit, lower shift mechanism, and water-driven turbine.
Figure 9:
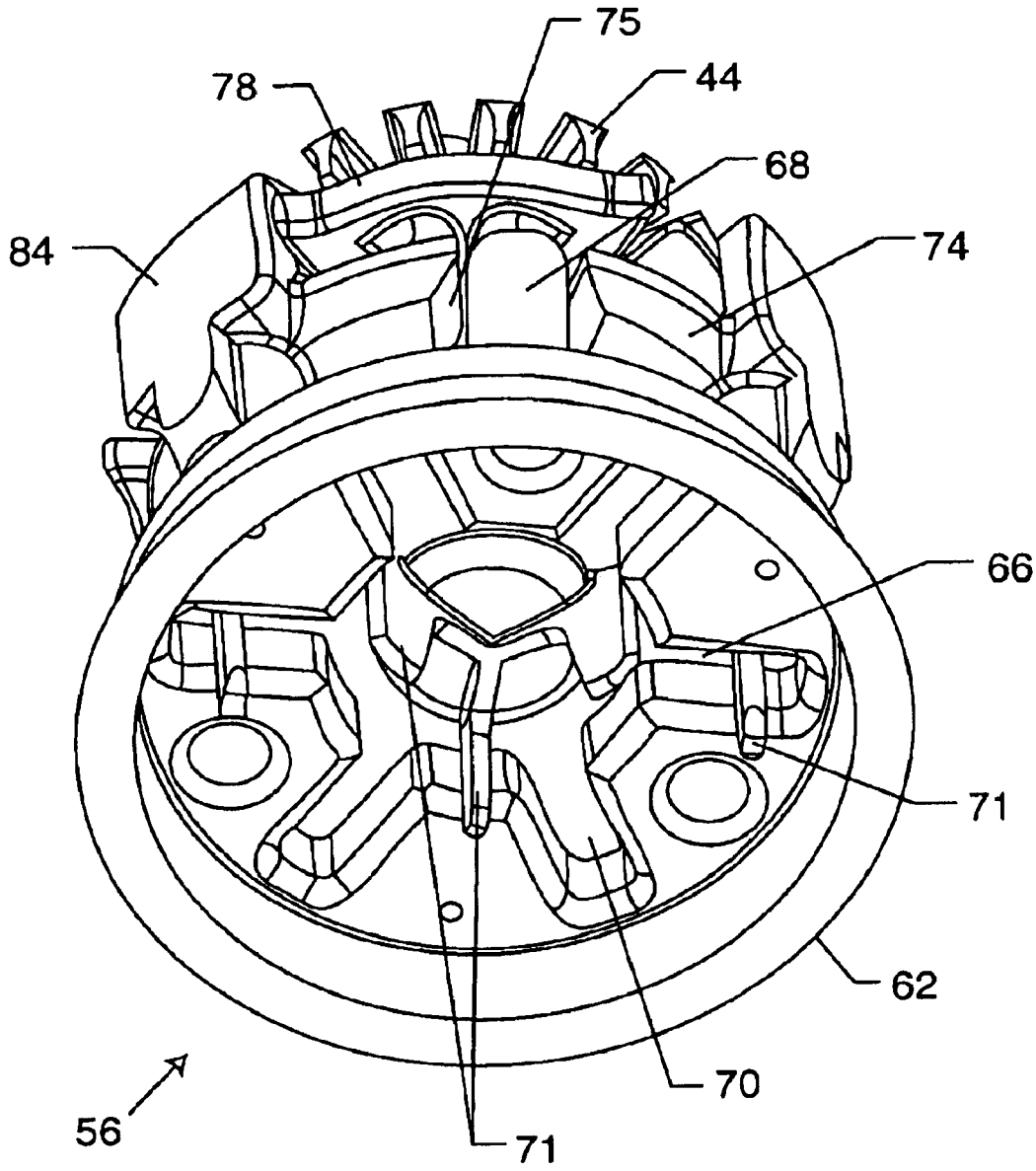
FIG. 9 is a bottom perspective view of the flow regulator unit.
Figure 10:
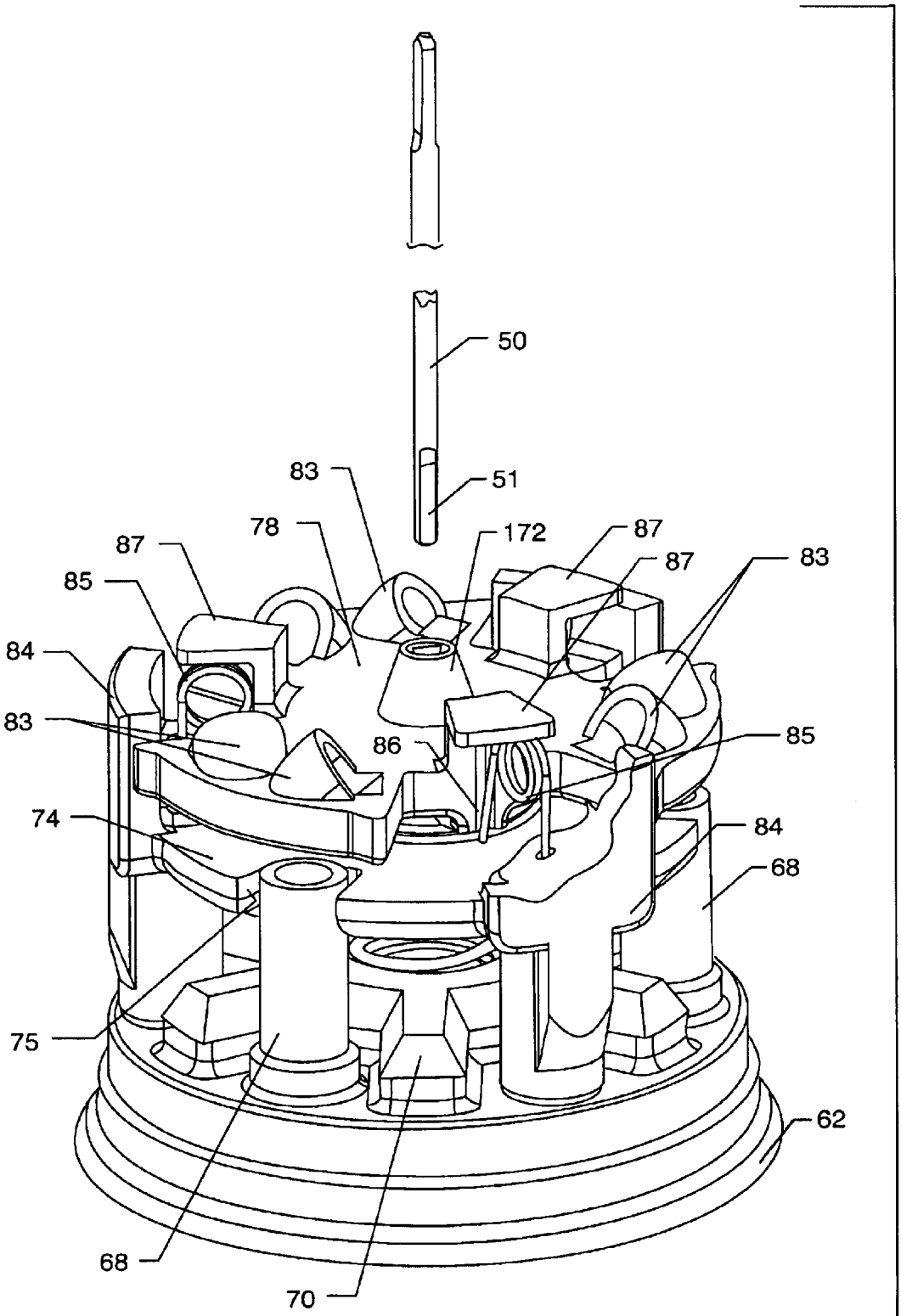
FIG. 10 is an enlarged perspective view showing an upper side of the flow regulator unit assembled with the lower shift mechanism, and illustrating the lower shift mechanism in a forward-drive position.
Figure 11:
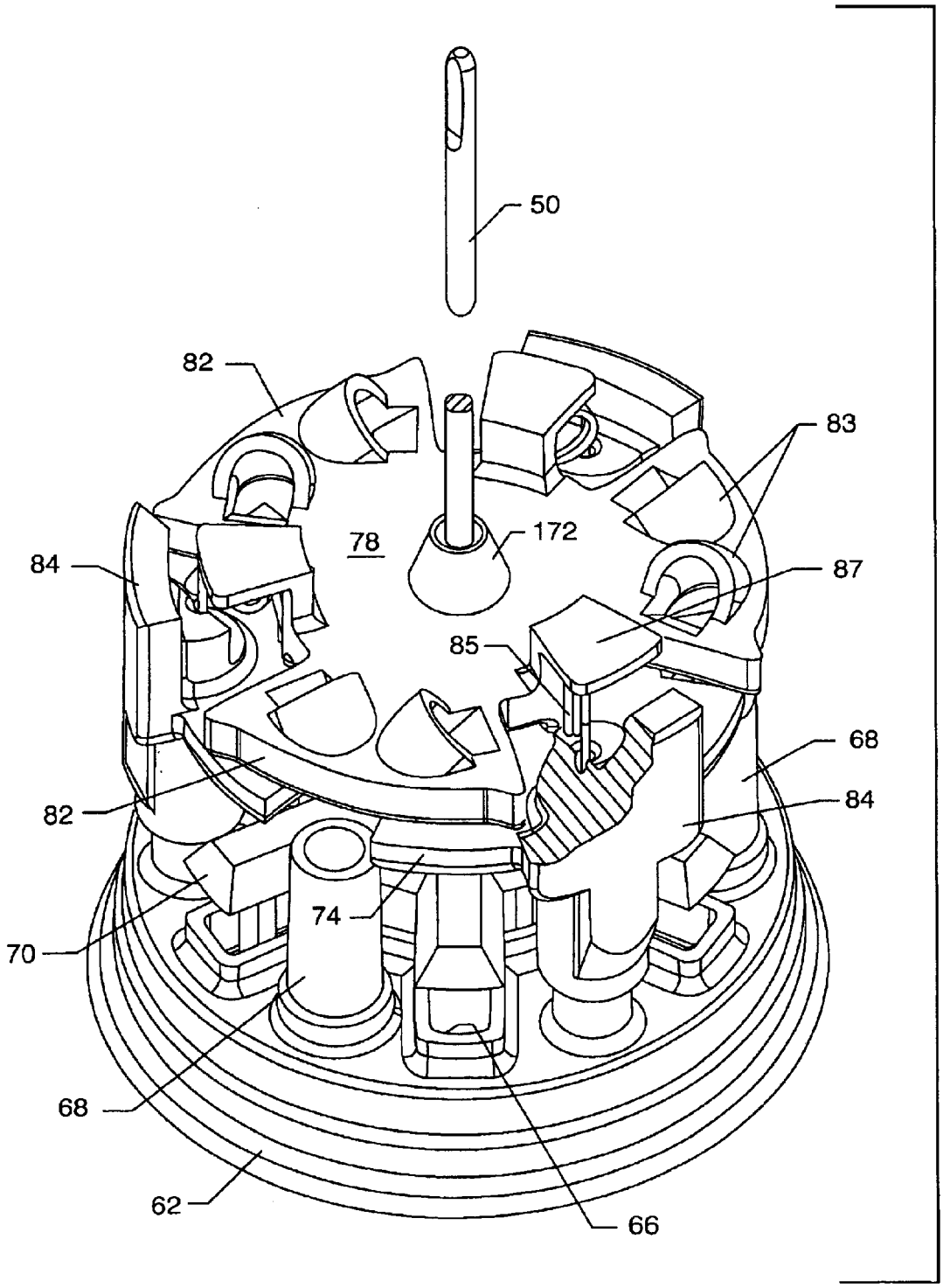
FIG. 11 is an enlarged perspective view similar to FIG. 10, but illustrating the lower shift mechanism in a reverse-drive position.

(shown best in FIG. 8) in combination with a plurality of axially elongated turbine drive jet ports 68 formed in a circumferentially spaced array about the central flow port 66. A bypass valve 70 (FIGS. 8–11) is biased by a spring 72 for normally closing the central bypass flow port 66. This biasing spring 72 is mounted above the bypass flow port 66 with an upper end of the spring reacting against a stop plate 74 mounted above the bypass flow port 66 by a plurality of interfitting mounting posts 76 and 77 formed respectively on the frame 62 and the stop plate 74 (FIG. 8). Importantly, this stop plate 74 includes a plurality of peripheral notches 75 (FIG. 8) aligned respectively with the underlying turbine drive jet ports 68 to accommodate upward water flow through the jet ports 68.

A shiftable deflector plate 78 is mounted on an upper side of the stop plate 74, and comprises an integral portion of the lower shift cartridge 46 of the reverse assembly 22. In general terms, this deflector plate 78 is movable back-and-forth with a part-circle rotational displacement between forward-drive and reverse-drive positions (FIGS. 10 and 11) to result in rotational driving of the turbine 44 respectively in opposite rotational directions. More particularly, as shown best in FIG. 8, the deflector plate 78 has a generally disk-shaped configuration with a depending central pivot post 79 received downwardly through a central bushing 80 formed in the stop plate 74. A push nut 81 is captured by press-fitting onto a lower end of this depending central post 79 for mounting said deflector plate 78 onto the underlying stop plate 74 in a manner permitting rotational movement there between.

The deflector plate 78 further includes a plurality of radially outwardly extending lobes 82, three of which are shown in the illustrative drawings, with each lobe 82 including a pair or set of oppositely angled jet nozzles 83. These sets of jet nozzles 83 are positioned generally over the turbine drive jet ports 68, and function to redirect water flow jetted upwardly through said jet ports 68 in a circumferential forward-drive or reverse-drive direction for rotatably driving the water turbine 44, as will be described. In this regard, a plurality of stop posts 84 project upwardly from the stop plate 74 into the arcuate spaces between the deflector plate lobes 82, and function to engage side edges of the lobes 82 in a manner limiting deflector plate rotation relative to the underlying stop plate 74. Overcenter springs 85 are mounted at the inboard side of each stop post 84 and include a leg engaging a notched seat 86 (FIG. 8) on the deflector plate 78 between an adjacent pair of the lobes 82 thereon. These overcenter springs 85 retain the deflector plate 78 is a forward-drive position (FIG. 10) with the jet nozzles 83 oriented to redirect the water flow from the jet ports 68 with a counter-clockwise swirl motion, or in a reverse-drive position (FIG. 11) with the jet nozzles oriented to redirect the water flow with a clockwise swirl motion. Raised cap segments 87 may be formed on the deflector plate 78 to project radially outwardly above the overcenter springs 85 to assist in retaining those springs in place.

The water-driven turbine 44 is rotatably mounted within the riser tube 16 in a position directly above the jet nozzles 83 on the deflector plate 78, whereby the resultant circumferential swirl flow provided by the jet nozzles 83 rotatably drives the turbine 44 in a selected forward-drive or reverse-drive direction in accordance with the shifted position of the deflector plate 78. More specifically, as shown in FIGS. 6–8 and 12, the turbine 44 is mounted on the lower end of a hollow or tubular turbine shaft 88 which is rotatably supported within a central bearing hub 89 (FIG. 12) formed on a base plate 90 of a turbine housing. This base plate 90 is coupled by a circumferentially spaced plurality of support legs 92 to the upper end of a generally cylindrical turbine shroud 94 sized to seat within the riser tube 16 against a second stepped shoulder 95 (FIG. 5) formed therein.

The swirl flow of water from the flow regulator unit 56 rotatably drives the turbine 44 to provide motive power for the sprinkler 10. In this regard, the turbine 44 preferably comprises an axial flow turbine having a plurality of radially outwardly projecting turbine vanes oriented in cooperation with the jet nozzles 83 for forward-drive rotation (FIG. 10) or for reverse-drive rotation (FIG. 11) as previously described. In either case, the swirl flow passes beyond the turbine 44 through open vents defined by the support legs 92 and between the base plate 90 and turbine shroud 94 (shown best in FIGS. 6 and 12), for upward flow within the riser tube 16 to the spray head 14.

Upon initial supply of water under pressure to the interior of the sprinkler case 18, the water flows upwardly through the filter basket 52 to the underside of the flow regulator unit 56. Initially, the bypass valve 70 (FIGS. 8–10) is normally retained by the valve spring 72 in a closed position, whereby the entire water flow passes upwardly through the jet ports 68 for rotatably driving the turbine 44 in accordance with the forward-drive or reverse-drive setting of the deflector plate 78. However, as the water pressure drop across the jet ports 68 rises, the bypass valve 70 is displaced against the valve spring 72 toward an open position to permit some of the water inflow to pass upwardly in bypass relation to the jet ports 68. In this regard, the illustrative drawings show the bypass valve 70 and the associated bypass flow port 66 to have an enlarged, generally multi-legged or star-shaped configuration to provide a relatively large open bypass flow area. The bypass valve 70 may also include downwardly projecting guide ribs 71 (FIG. 9) which protrude into and through the flow port 66 to maintain the multi-legged valve 70 in proper rotational alignment with the multi-legged port 66. Importantly, this pressure responsive opening of the bypass valve 70 effectively regulates the driving force applied to the turbine 44 by the water jetted upwardly through the jet ports 68 in a manner maintaining turbine rotational speed at a substantially constant and predetermined level. Such maintenance of turbine drive speed at a known level beneficially regulates the output rotary drive speed of the spray head 14 to a substantially constant and predetermined level, e.g., on the order of about 3 minutes per full circle revolution. An altered spray head rotational speed can be provided by decreasing the size of the bypass port 66 to increase rotational speed, and vice versa.

The rotatably driven turbine 44 provides a rotary drive input for the gear drive transmission 20, wherein the gear drive transmission comprises a substantially closed gear box positioned at the upper side of the turbine housing base plate 90 (FIG. 6). In general terms, this gear box functions to convert the relatively high speed rotation of the water-driven turbine 44 to a significantly slower rotational speed suitable for rotational driving of the sprinkler spray head 14. In this regard, in response to the supply of water under pressure to the sprinkler 10, the turbine 44 is typically driven at a rotational speed on the order of 1,000–2,000 rpm. The speed reduction gear box responds to this drive input to drive the spray head 14 at a rotational speed which can be on the order of about 3 minutes per revolution as noted above.

Figure 12:
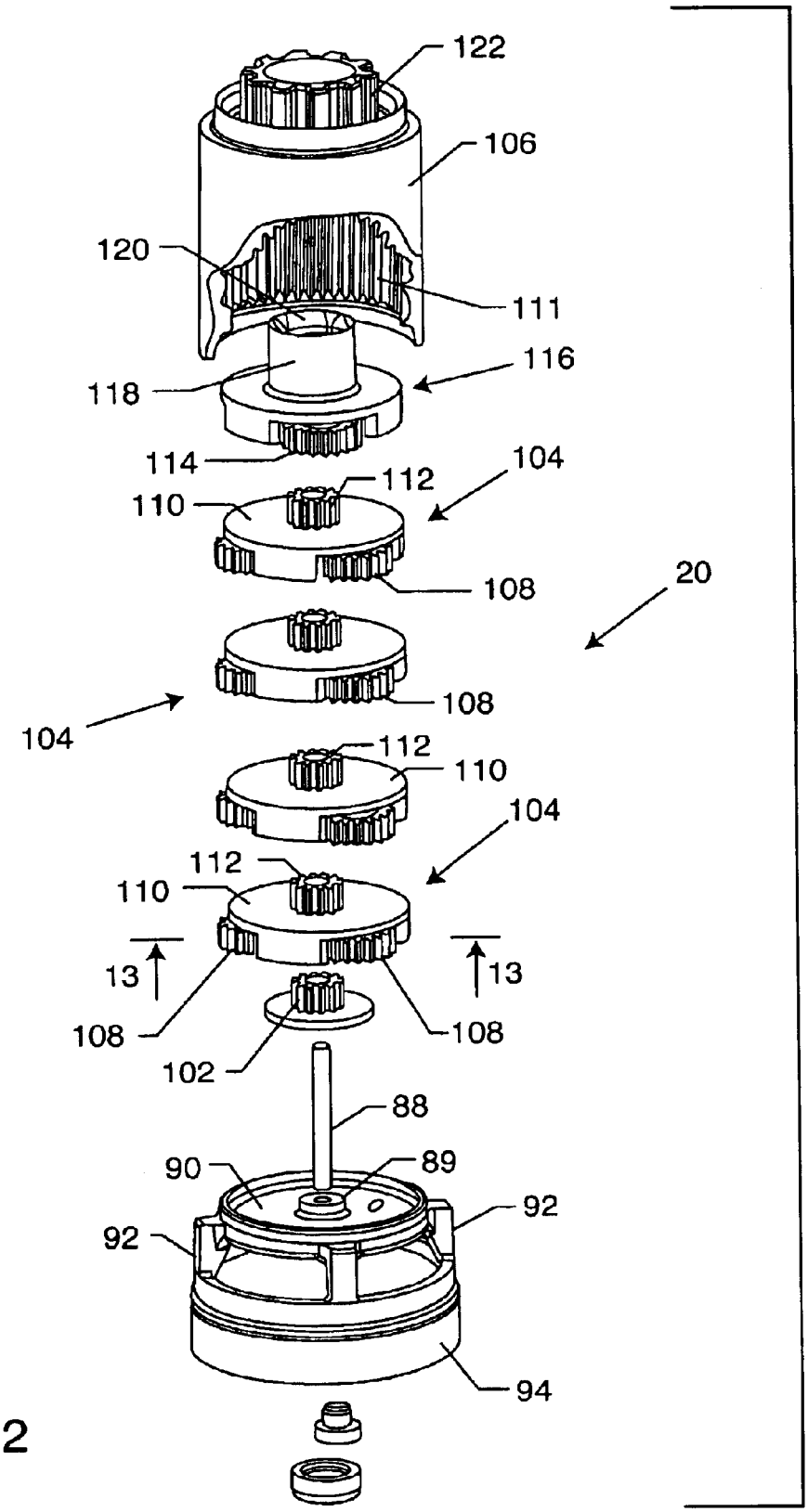
FIG. 12 is an exploded perspective view showing assembly of components forming the speed reduction gear drive transmission.
Figure 13:
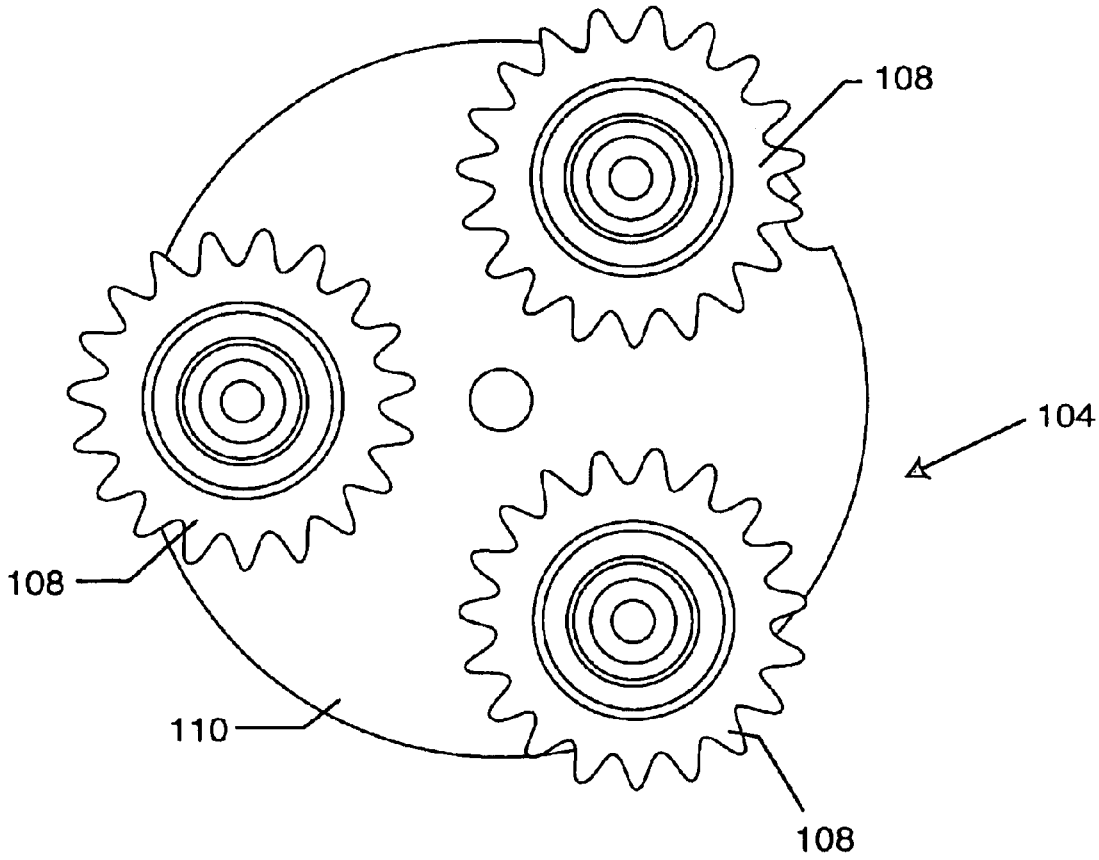
FIG. 13 is an enlarged bottom plan view of one of a plurality of planet gear units forming a portion of the gear drive transmission, taken generally on the line 13—13 of FIG. 12.
Figure 14:
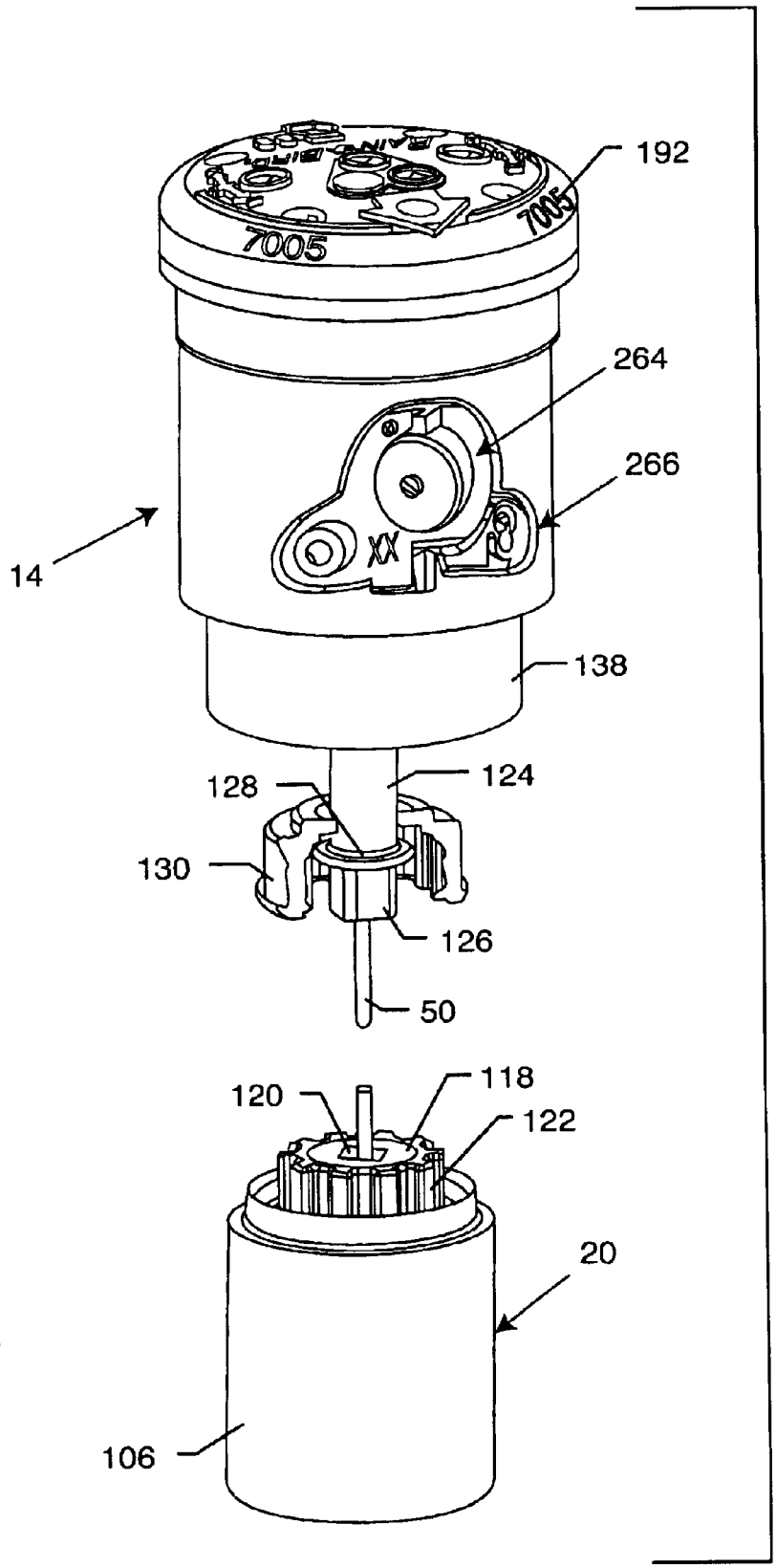
FIG. 14 is an exploded perspective view showing assembly of the gear drive transmission with the spray head.

The speed reduction gear drive transmission 20 is shown best in FIGS. 6 and 12–13 to include a main drive gear 102 mounted onto an upper end of the turbine drive shaft 88 for direct rotatable drive by the turbine 44. This main drive gear 102 is meshed with a first one of a plurality of planet gear modules 104 mounted in a stacked array within a generally cylindrical and internally splined gear box housing 106. In the preferred form as shown, four substantially identical planet gear modules 104 are shown, each comprising a trio of planet gears 108 rotatably mounted at the underside of a carrier disk 110 at circumferentially and uniformly spaced positions, and in meshed relation with internal splines 111 formed within the gear box housing 106. Each carrier disk 110 additionally includes a centrally positioned output gear 112 at the upper side thereof. The lowermost one of the planet gear modules 104 is mounted with its underlying planet gears 108 in driven meshed relation with the main drive gear 102, and with its upper output gear 112 in meshed relation with the planet gears 108 of the next module 104 in succession. This next planet gear module 104 in succession in turn has its output gear 112 meshed with the trio of planet gears 108 of the next successive module 104, with the uppermost module 104 having its output gear 112 meshed with a similar trio of planet gears 114 on the underside of an output planet module 116. This output planet module 116 defines an output drive hub 118 which includes a noncircular drive socket 120, such as the square-drive socket shown in FIG. 12, for rotatably driving the spray head 14. In this regard, this drive hub 118 protrudes upwardly within an externally splined bearing collar 122 formed on the upper end of the gear box housing 106 for upwardly exposing the drive socket 120. With this construction, the sequence of planet gear modules 104 produce a substantial speed reduction between the turbine-driven main drive gear 102 and the output drive hub 118.

The gear box housing 106 is mounted within the riser tube 16 in a manner to permit rotation of the gear box housing 106 when excessive external torque is applied to the spray head 14, such as by a vandal attempting to turn the spray head by hand.

In this instance, the base plate 90 is nonrotatably secured to the support legs 92 of the turbine shroud 94, such as by sonic welding, and the gear box housing 106 is press-fit around an upper, reduced diameter portion 91 of the base plate (see FIG. 12) such that the gear box housing is frictionally coupled to the base plate 90, but can be rotated relative to the base plate in the event a relatively high torque is applied to the gear box housing, such as might occur if a vandal were to grab the spray head and rotate it. Allowing the gear box housing 106 to resistively rotate relative to the base plate 90 insures that an externally applied torque will not cause the gear train within the gear box housing to break.

Figure 15:
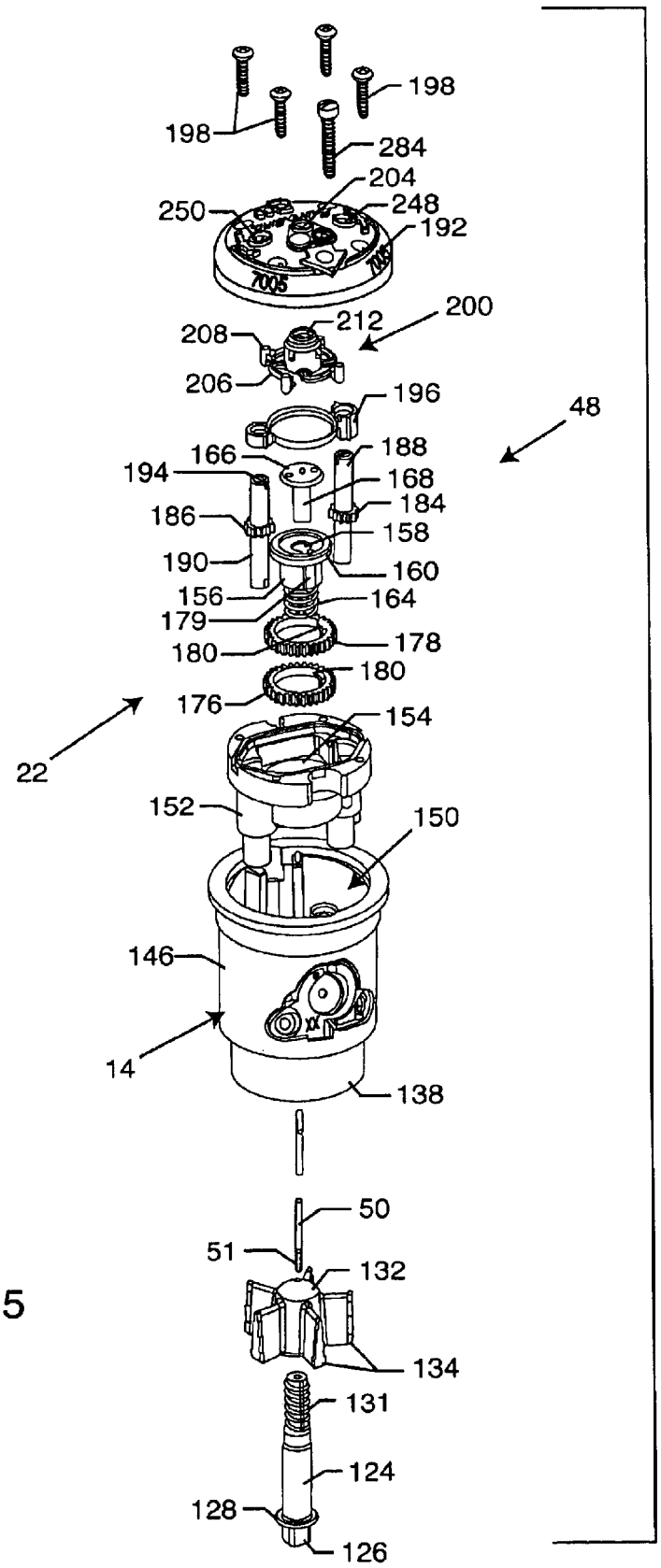
FIG. 15 is an exploded perspective view depicting components mounted within the spray head to include a nozzle housing with an upper trip unit mounted therein, wherein said upper trip unit forms a portion of the part-circle reverse assembly.
Figure 16:
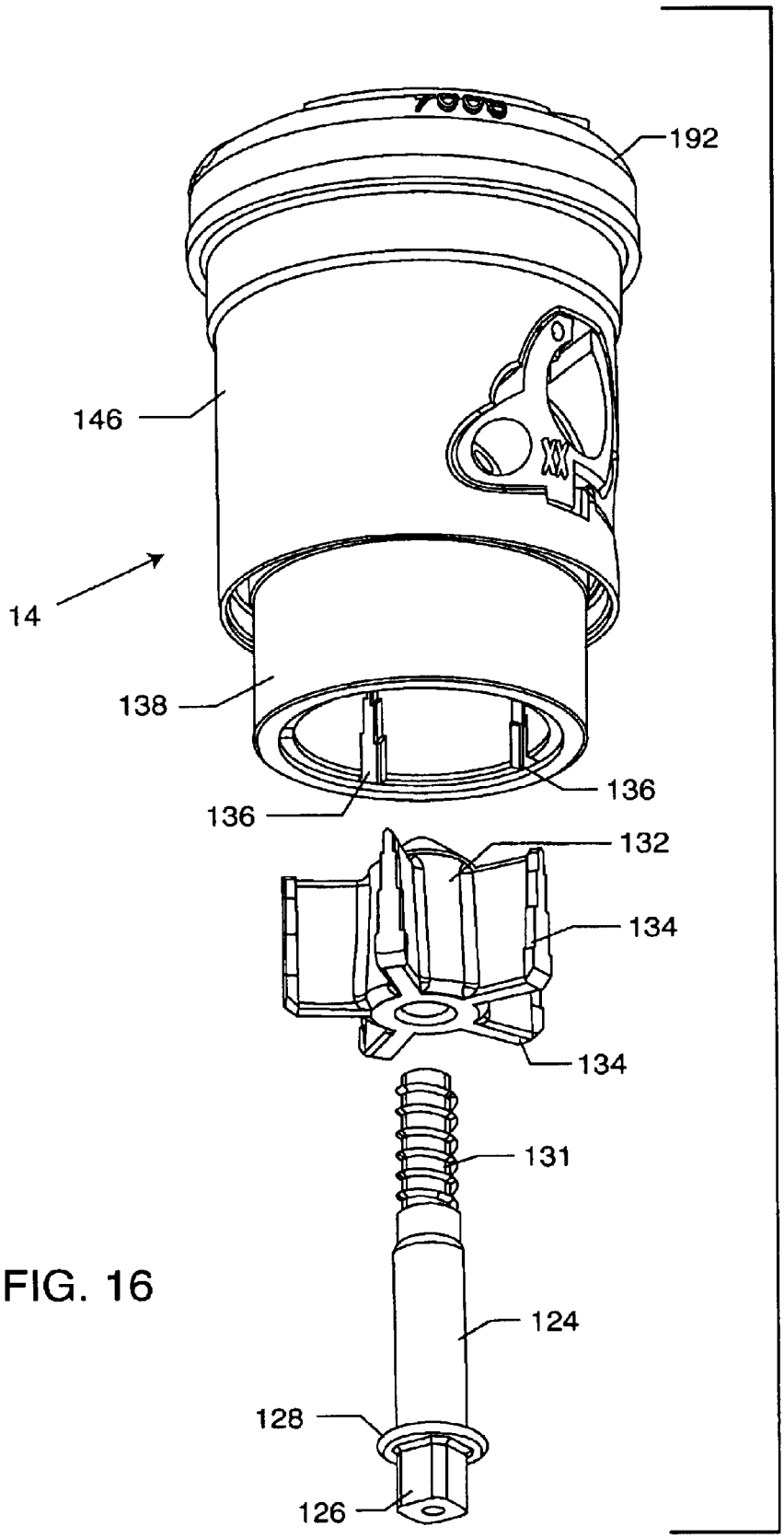
FIG. 16 is an exploded perspective view showing the underside of the spray head nozzle housing.

The drive hub 118 engages and drives a drive shaft 124 having an upper end secured to the spray head 14. As shown in FIGS. 5 and 14–16, the spray head drive shaft 124 includes driven lower foot 126 of noncircular geometry, such as a square-drive shape as shown (FIG. 14), for mating reception into the drive socket 120 of the underlying drive hub 118. A ring-shaped flange 128 is formed on the drive shaft 124 at a location above the driven foot 126, and functions to support a downwardly open and internally splined cap 130 fitted over the externally splined bearing collar 122 on the upper end of the gear box housing 106. The spray head drive shaft 124 extends upwardly from the gear box housing 106 and terminates in an upper end which is suitably threaded or serrated as indicated by reference number 131 in FIG. 15 for secure attachment into a2 sleeve 132 (FIGS. 15–16). A plurality of radially outwardly extending spokes 134 are carried by this sleeve 132, with their outermost ends seated within matingly shaped slots 136 (FIG. 16) formed within a cylindrical depending skirt 138 of the upper spray head 14. If desired, these spokes 134 may be securely fastened to the spray head skirt 138 by use of a suitable adhesive or by sonic welding or the like. Importantly, the sleeve 132 and the associated spokes 134 thereon couple the rotary drive output from the gear drive transmission 20 to the spray head 14. FIG. 5 shows the spray head skirt 138 rotatably positioned within an upper end of the riser tube 16, with a seal ring 140 positioned between a lower end of the skirt 138 and an internal shoulder 142 within the riser tube 16. This seal ring 140 accommodates rotational movement of the spray head 14 relative to the riser tube 16, while preventing outward water leakage between these components. Instead, upward water flow passing through the riser tube 16 about the exterior of the gear box housing 106 flows further past the spokes 134 into a hollow pressure chamber 144 within the spray head 14 in flow communication with one or more spray nozzles, as will be described in more detail.

The spray head 14 comprises a generally cylindrical nozzle housing or turret 146, as shown in FIGS. 14–18, which may also be formed from lightweight molded plastic and from which the lower cylindrical skirt 138 depends for slide-fit reception into the upper end of the riser tube 16. An internal divider 148 (FIG. 5) subdivides the nozzle housing 146 into the hollow lower pressure chamber 144 at the underside thereof, and an upper control chamber 150 within which the upper trip unit 48 is mounted. As noted previously herein, the upper trip unit 48 includes a pair of individually adjustable end trip stops for actuating the lower shift cartridge 46 (FIGS. 7–8 and 10–11) to reverse the direction of spray head rotation within a pre-set arcuate pattern.

More specifically, as shown best in FIG. 15, the upper control chamber 150 of the nozzle housing 146 receives and supports a retainer cup 152 mounted therein as by sonic welding or the like. The retainer cup 152 defines an upwardly open central cavity 154 for nested reception of the upper trip unit 48. FIGS. 15 and 17–25 illustrate the upper trip unit 48 to include the releasible clutch in the form of a trip core 156 having a generally cylindrical configuration with a central bore 158 and a radially outwardly extending upper clutch flange 160. An upper face of this clutch flange 160 includes an upwardly presented recessed seat 162, preferably defined by radially extending side margins having a ramped or tapered profile as shown best in FIG. 23. A biasing spring 164 engages the underside of the clutch flange 160 and reacts against the bottom of the retainer cup 152 for urging the trip core 156 upwardly within the retainer cup 152.

A clutch insert is provided for normal engagement with the trip core 156, and comprises a circular clutch plate 166 carried at an upper end of an elongated clutch pin 168 which is received slidably and rotatably within the central bore 158 of the trip core 156. This clutch plate 166 is sized and shaped to overlie the clutch flange 160, and includes a downwardly presented lug 170 (FIG. 20) for mating reception into the recessed flange seat 162. The biasing spring 164 normally urges the trip core 156 upwardly within the retainer cup 152 for displacing the clutch flange 160 into abutting engagement with the clutch plate 166, whereby the lug 170 is seated within and engaged with the flange seat 162 when these components are rotationally aligned with each other. Such engagement of the lug 170 into the flange seat 162 prevents relative rotation between the trip core 156 and the clutch plate 166.

The trip rod 50, which may have a flat-bladed upper end as shown (FIGS. 10–11), has an upper end anchored into the underside of the clutch pin 168 and extends downwardly therefrom through the spray head drive shaft 124, and further through the gear drive transmission 20 to the lower shift cartridge 46. More particularly, as viewed in FIGS. 12 and 14, the components of the gear drive transmission 20 include aligned central ports for slide-fit reception of the trip rod 50. The trip rod 50 extends further downwardly through the hollow turbine drive shaft 88 (FIGS. 3–5 and 7–8), and terminates in a lower end defined by a flat-surfaced blade segment 51 (FIG. 15) seated within a matingly shaped blade socket 172 (FIGS. 8 and 10–11) at the top of the deflector plate 78. Thus, the trip rod 50 links the deflector plate 78 of the lower shift cartridge 46 to the upper trip unit 48 mounted within the spray head housing 146. Part-circle rotational displacement of the releasible clutch, including the trip core 156 and the clutch plate 166, is effective to shift the deflector plate 78 back-and-forth between the forward-drive and reverse-drive positions. A resilient seal member 174 at the turbine 44 (FIG. 8) conveniently seals against the trip rod 50 to prevent migration of grit and like upwardly into the interior of the gear box housing 106.

The upper trip unit 48 additionally includes a pair of adjustment rings 176 and 178 mounted in stacked relation within the cylindrical central cavity 154 of the retainer cup 152 (FIGS. 15 and 17–22), wherein these adjustment rings 176 and 178 each include an internal radially inwardly projecting stop key 180 comprising the respective pair of end trips stops for the sprinkler. These internal stop keys 180 on these adjustment rings 176, 178 are engageable with a radially outwardly extending drive tab 179 on the exterior of the trip core 156. In addition, each adjustment ring 176 and 178 includes an externally formed set of gear teeth 182 engaged respectively with a pair of adjustment cog wheels 184 and 186 mounted on the sprinkler head 14. FIGS. 15 and 17–22 show the pair of adjustment cog wheels 184 and 186 mounted on a respective pair of rotatable posts 188 and 190 mounted within the retainer cup 152 on opposite sides of the stacked adjustments rings 176, 178, with the cog wheels 184, 186 positioned vertically for respectively engaging the toothed adjustment rings 176, 178. An upper end of each adjustment post 188, 190 extends upwardly to and partially through a cap 192 mounted on the spray head housing 146 to expose slotted upper ends 194 (FIG. 15) for convenient access by means of a screwdriver or the like. A retainer cage 196 (FIGS. 15 and 18–21) may also be provided at a location above the cog wheels 184, 186 for maintaining the adjustment shafts 188, 190 in substantially parallel spaced-apart relation and to hold down the adjustment rings 176, 178.

Figure 17:
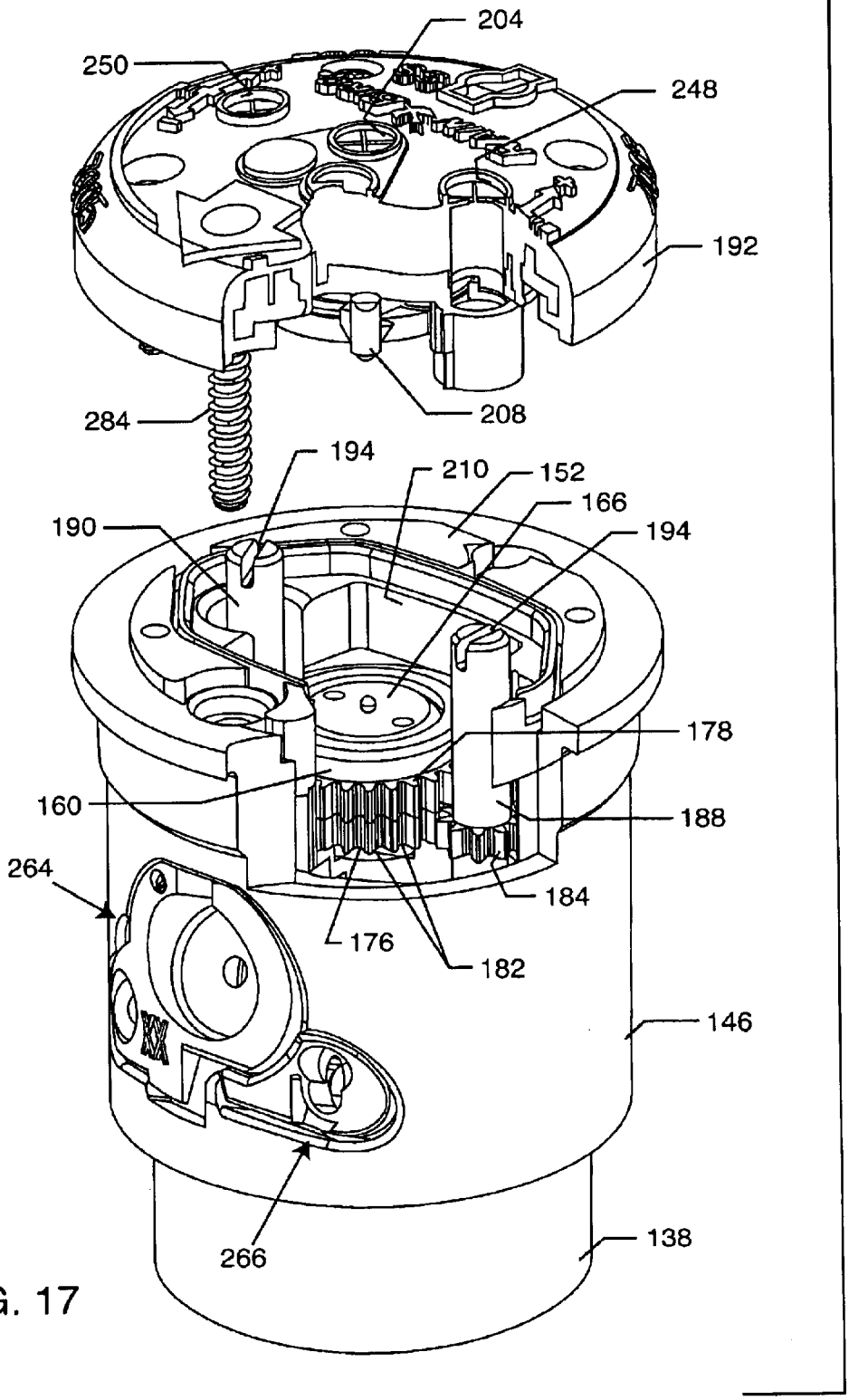
FIG. 17 is an enlarged perspective view showing the upper trip unit mounted within the nozzle housing, and illustrated in exploded relation with a spray head cap module.
Figure 18:
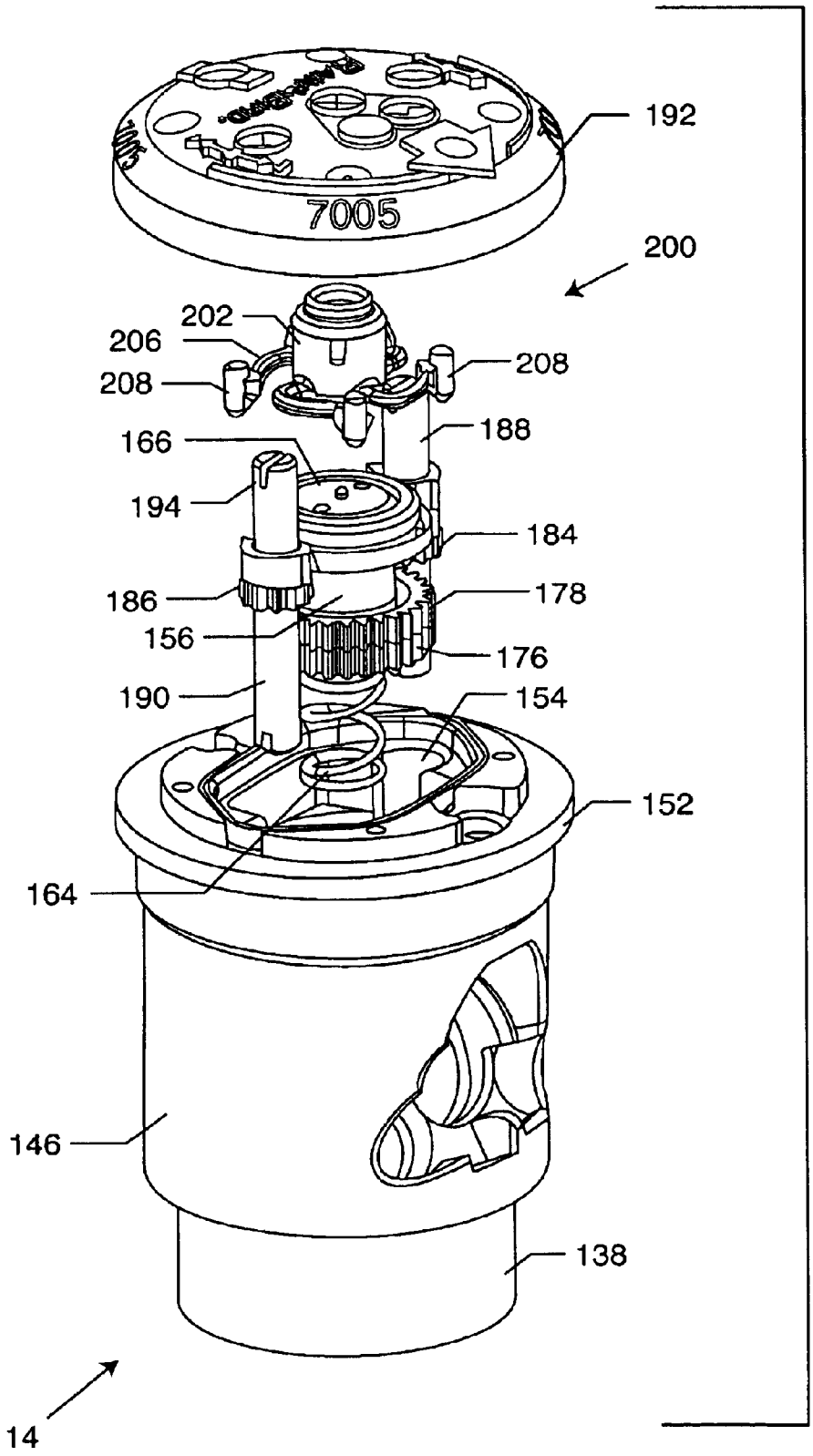
FIG. 18 is an enlarged perspective view showing the upper trip unit in assembled form, in exploded relation with the nozzle housing and spray head cap module.
Figure 19:
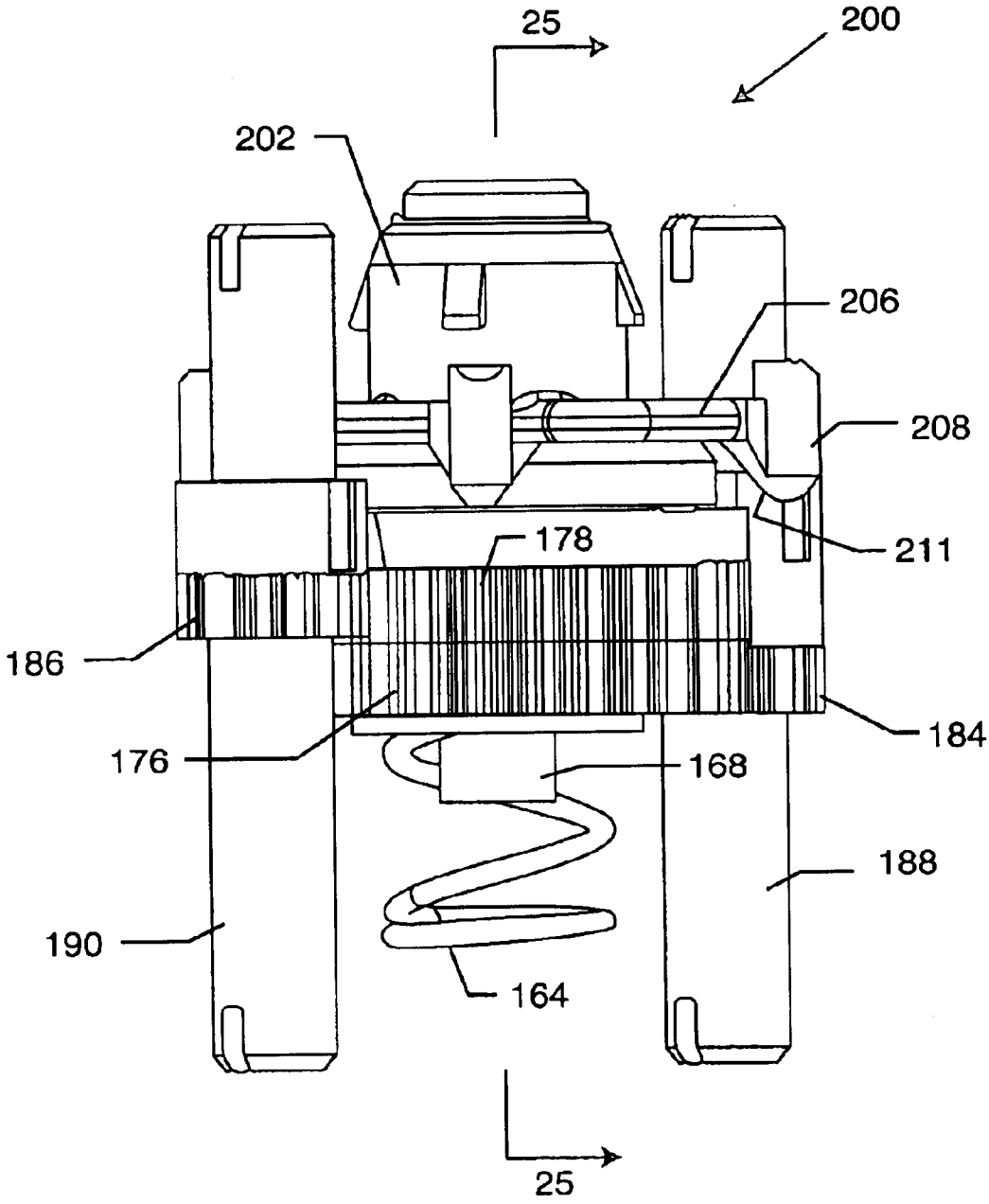
FIG. 19 is a further enlarged perspective view showing the upper trip unit in assembled form.
Figure 20:
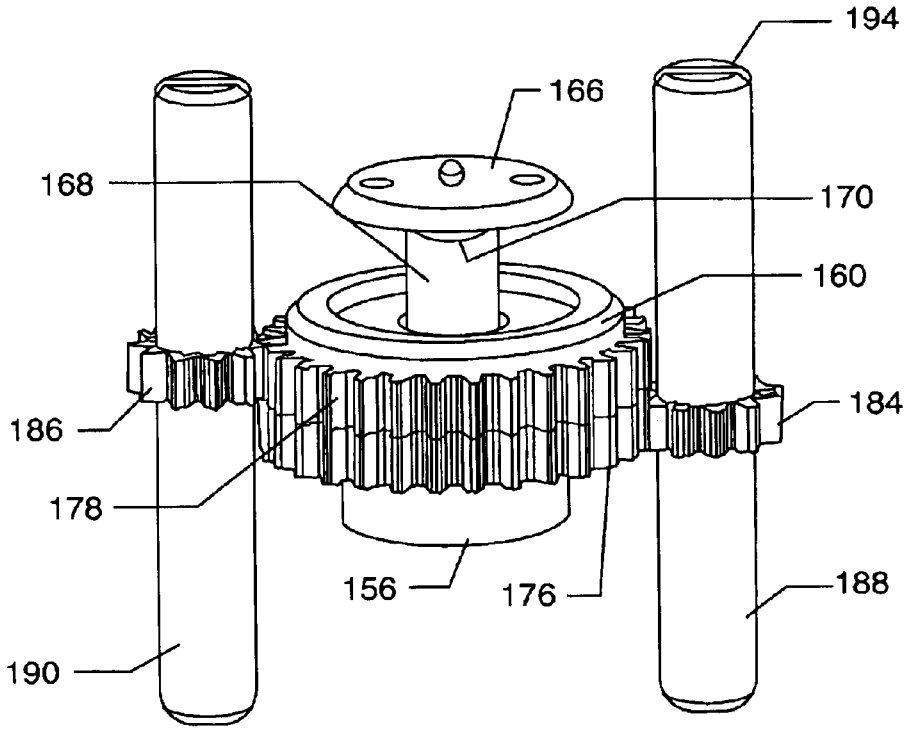
FIG. 20 is an enlarged perspective view of the upper trip unit, similar to FIG. 19, but depicting a releasible clutch thereof in a disengaged position.
Figure 21:
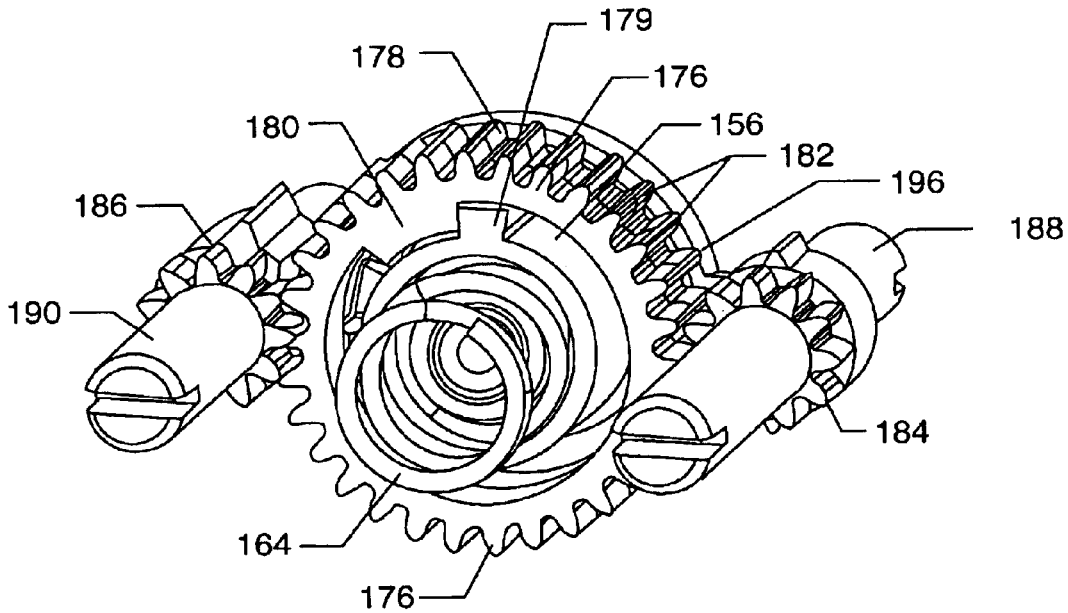
FIG. 21 is an enlarged perspective view showing the underside of the assembled upper trip unit.
Figure 22:
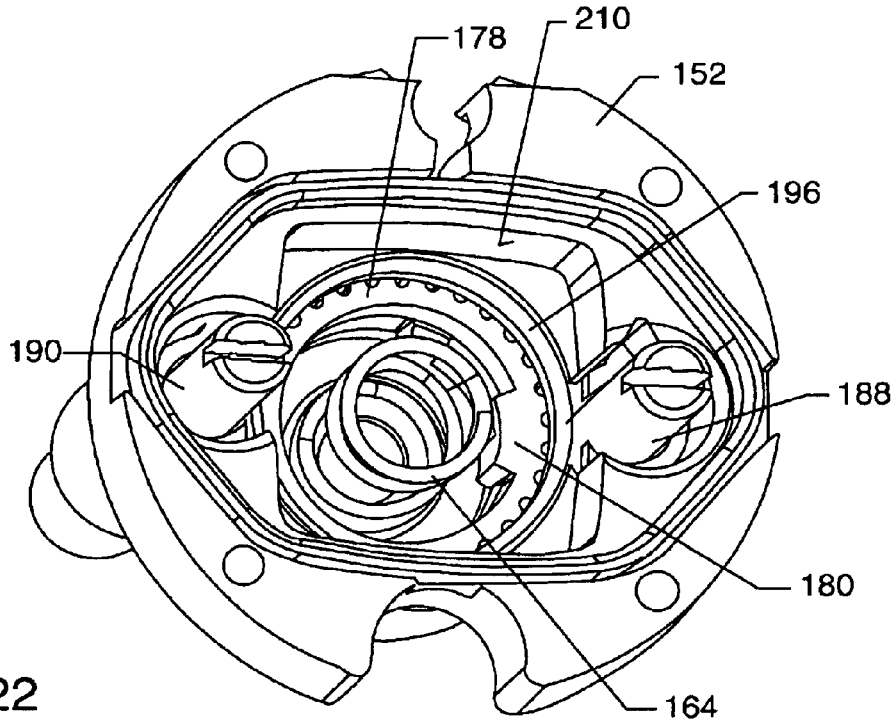
FIG. 22 is an enlarged perspective view illustrating installation of a pair of individually adjustable end trip stops into the spray head nozzle housing.
Figure 23:
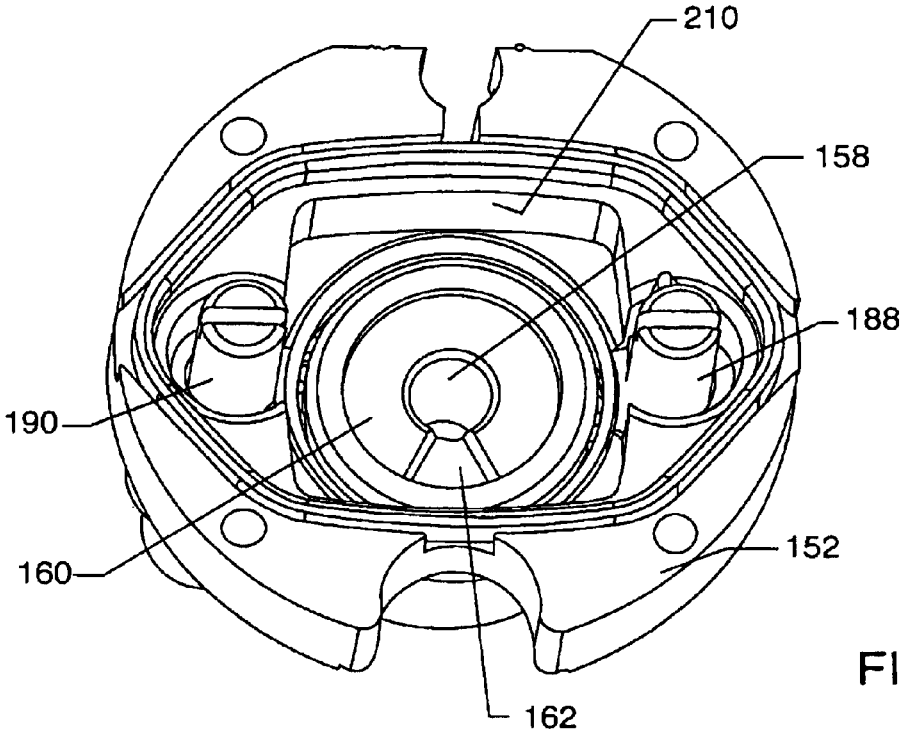
FIG. 23 is an enlarged perspective view similar to FIG. 22, but showing further installation of a clutch body forming a portion of the releasible clutch.
Figure 24:
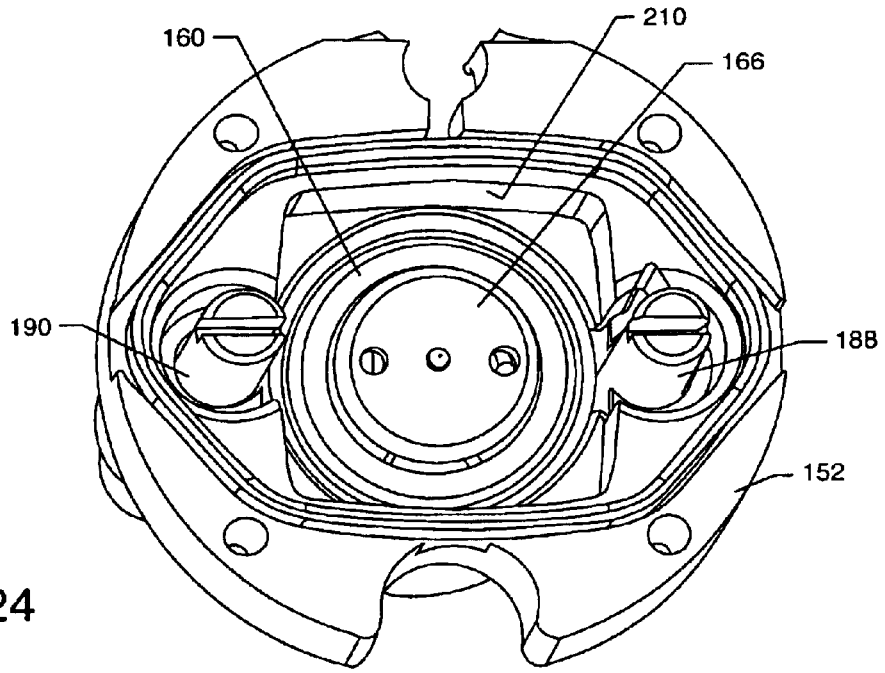
FIG. 24 is an enlarged perspective view similar to FIG. 23, depicting further installation of a clutch plate forming a portion of the releasible clutch.
Figure 25:
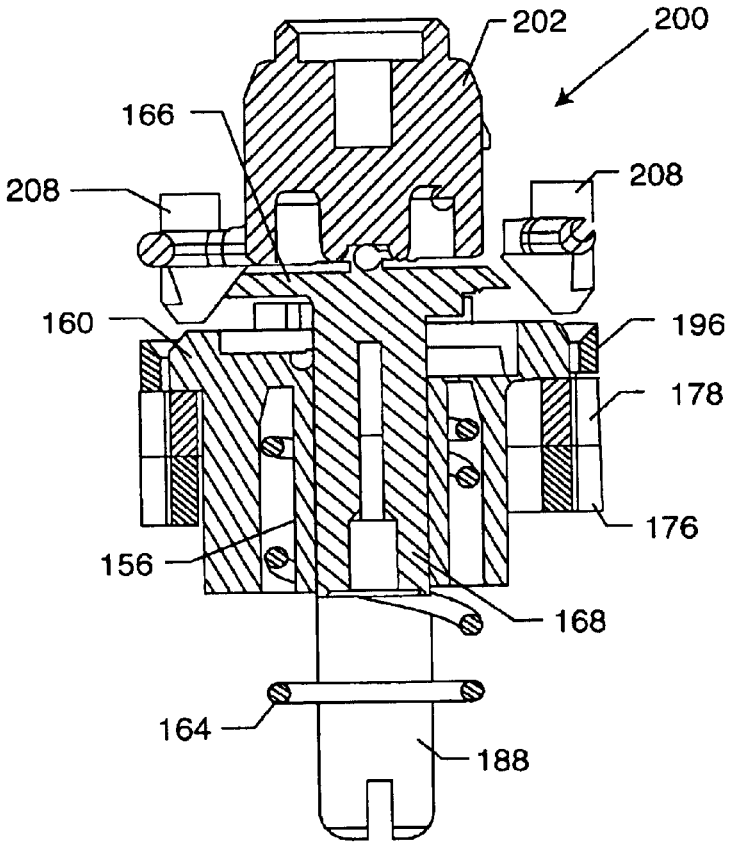
FIG. 25 is a vertical sectional view of the upper trip unit, taken generally on the line 25—25 of FIG. 19.

More specifically, each of the trip rings 176, 178 is adjustable quickly and easily from the exterior of the sprinkler 10 for separate and individual selected setting of the positions for the two end trip stops. As shown herein, the two adjustment cog wheels 184, 186 are carried on the respective pair of adjustment shafts 188, 190 at diametrically opposed sides of the stacked lower and upper trip rings 176, 178. FIG. 17 shows the adjustment cog wheel 184 on the adjustment shaft 188, to position the cog wheel 184 in meshed engagement with the toothed perimeter of the lower trip ring 176. In a similar fashion, FIG. 18 also shows the other adjustment cog wheel 186 on the adjustment shaft 190, to position the cog wheel 186 thereon in meshed engagement with the toothed perimeter of the upper trip ring 178. The upper ends of the two adjustment posts 188, 190 are rotatably seated respectively within upwardly open access ports 248 and 250 formed in the nozzle cap 192, and project downwardly through corresponding openings formed in the retainer cage 196. Herein, for rotary adjustment, the exposed upper ends of the adjustment posts 188, 190 are slotted as indicated at 194 for screwdriver access via the ports 248, 250. Through rotation of the posts 188,190 the rotational positions of the two trip rings 176, 178 can be independently adjusted to correspondingly set the desired opposite end limits of back-and-forth spray head rotation. Notably, the two adjustment shafts 188, 190 are supported by the underlying retainer cup 152 and the overlying nozzle cap 192 with sufficient friction resistance to effectively lock the two trip rings 176, 178 against undesired self-rotation or rotational creep relative to the spray head 14 during normal sprinkler operation.

The adjustment rings 176 and 178 rotate with the sprinkler spray head 14 during normal rotary drive operation of the sprinkler spray head 14, in response to the rotary drive connection thereof via the gear drive transmission 20 to the water-driven turbine 44. Such rotational displacement of these adjustment rings 176, 178 causes the trip stop keys 180 thereon to be rotated into engagement with the external drive tab 179 on the trip core 156 for purposes of reversing the direction of spray head rotation back-and-forth within a selected and adjustable arcuate path of motion. More specifically, the adjustment shafts 188 and 190 are respectively and individually rotatably set to positionally adjust the two adjustment rings 176 and 178, by means of their respective engagement with the adjustment cog wheels 184 and 186, to custom-tailor or custom-select the positions and arcuate spacings between the two trip stop keys 180. As the spray head 14 rotates in one direction, the trip stop key 180 on the adjustment ring 176 moves into engagement with the trip core drive tab 179 to initiate displacement of the trip core 156 in the same rotational direction. Rotation of the trip core 156 is coupled via the releasible clutch structure to the clutch plate 166 and further via the trip rod 50 downwardly to the deflector plate 78, producing shift rotation of the deflector plate 78 to align the opposite set of jet nozzles 83 with the underlying jet ports 68. As a result, the direction of turbine driving is reversed, to correspondingly reverse the direction of spray head rotation.

Following this reversal of motion, the spray head 14 is rotatably driven in an opposite direction to move the trip stop key 180 on the other adjustment ring 178 eventually into engagement with the trip core drive tab 179 on the trip core 156. Such key-engagement with the trip core drive tab 179 functions to initiate displacement of the trip core 156 for again rotating the clutch plate 166 and trip rod 50 in a manner shifting the deflector plate 78 to reverse the direction of turbine-driven spray head rotation. In this manner, the spray head 14 is rotatably driven with a back-and-forth motion between the end limits of a prescribed path of rotation defined by the individually set positions of the two trip stop keys 180 on the two adjustment rings 176 and 178. In accordance with one aspect of the invention, the trip rod 50 comprises a metal shaft with a minor degree of resiliency requiring wind-up rotation through a small angle of displacement, such about 7°, before applying sufficient torque to shift the deflector plate 78 against the biasing force applied thereto by the overcenter springs 85. With this construction, positive shift action occurs substantially without risk of the deflector plate 78 stalling or hanging up mid-way or dead-center between the forward-drive and reverse-drive positions.

The individually adjustable end trip stops beneficially permits the spray head 14 to be custom-set for back-and-forth rotational driving to project irrigation water within an arcuate spray pattern of virtually any arcuate width, and aimed in any azimuthal direction from the sprinkler. Accordingly, the sprinkler 10 can be installed quickly and easily by appropriate connection to a water supply line 30 (as viewed in FIG. 1), without regard for any reference point associated with one or more end trip stops. After the sprinkler is suitably installed, the rotational positions of the two end trip stops can be selectively set as described above, to provide reversible sprinkler operation within the selected arcuate pattern. This arcuate pattern may be narrow, e.g., a pattern width of 30° or less, or the pattern may be broad, e.g., a pattern width approaching approximately 360°.

In accordance with a further important aspect of the invention, the spray head 14 is substantially resistant to damage attributable typically to attempted vandalism in the form of manually forced rotation of the spray head 14, for example, to direct the water spray emanating therefrom in a direction outside the range of the predetermined part-circle pattern. In this regard, upon manually forced rotation of the spray head 14 beyond either end limit of the prescribed path of motion as defined by the positions of the trip stop keys 180, the releasible clutch will disengage to correspondingly disconnect the upper trip unit 48 of the reverse assembly 22 from the lower shift cartridge 46 and thereby prevent damage to components of the reverse assembly. That is, application of sufficient torque to the spray head 14 in an effort to over-rotate the spray head beyond one end limit will cause the spring-loaded trip core flange 160 to retract axially from the clutch plate 166 to disengage the releasible clutch. Upon release of the spray head 14, the turbine-driven transmission 20 will continue rotatable driving of the spray head in the direction opposite to that of the forced over-rotation until the trip core seat 162 is rotated back into alignment with the clutch plate lug 170, whereupon the biasing spring 164 will re-engage these components. Importantly, such re-engagement will occur when the spray head 14 has rotated back to within the desired range of reversible back-and-forth motion, without altering the set positions of either trip stop key 180. Thus, upon re-engagement of the releasible clutch, the sprinkler will automatically resume normal back-and-forth spray head movement between the originally set end limits.

In accordance with a further aspect of the invention, one or both of the end trip stops may be disabled quickly and easily from the exterior of the sprinkler, to set the spray head 14 for full circle rotation through continuous full circle revolutions. More particularly, FIG. 15 shows the nozzle cap 192 for secure mounting onto an upper end of the spray nozzle housing 146 by means of mounting screws 198 or the like to enclose the upper trip unit 48 therein. An upper spider cam 200 (FIGS. 15, 18, and 26–28) is mounted on the underside of the nozzle cap 192 for selectively engaging the releasible clutch to effectively disable the normal reversing action of the end trip stops by disengaging the trip core 156 from the clutch plate 166.

Figure 26:
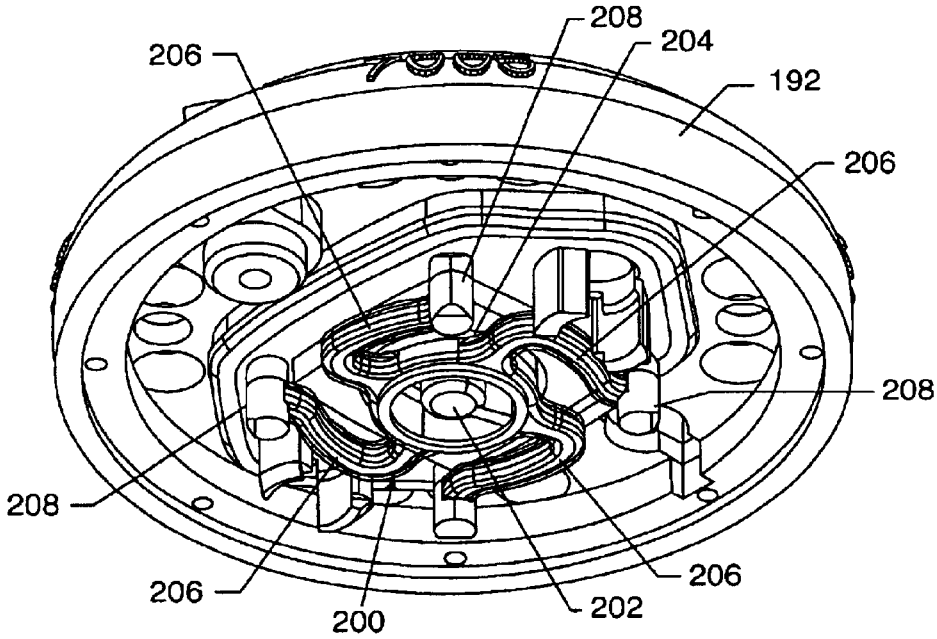
FIG. 26 is a bottom perspective view of the spray head cap module forming a portion of the spray head, and depicting a multi-legged adjustment cam mounted thereon.
Figure 27:
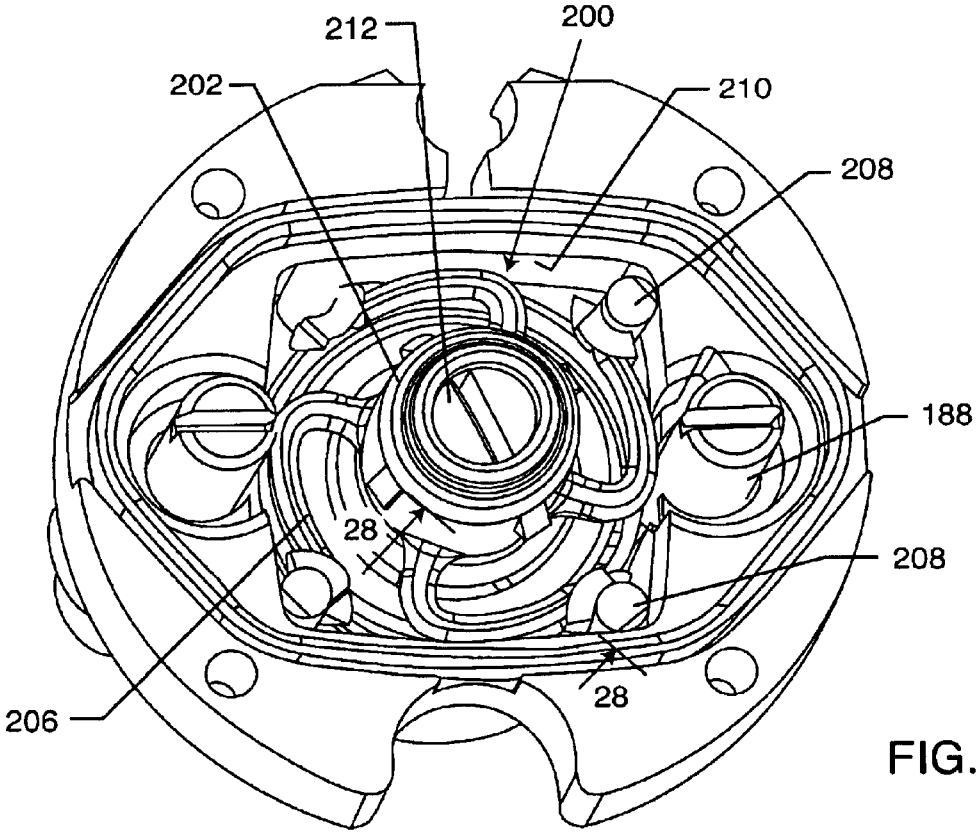
FIG. 27 is an enlarged perspective view similar to FIG. 24, but showing the multi-legged adjustment cam not in engagement with the releasible clutch of the upper trip unit.
Figure 28:
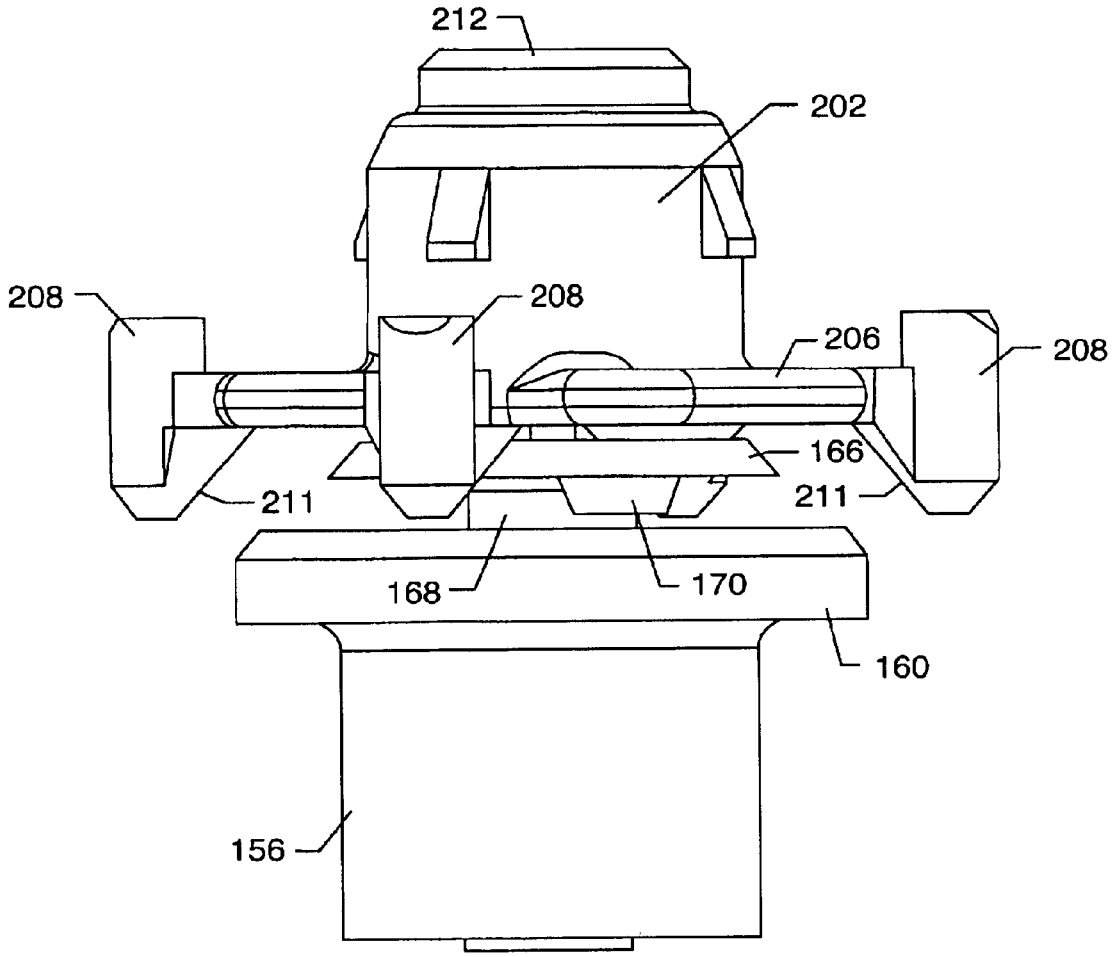
FIG. 28 is an enlarged side elevation view illustrating the adjustment cam and releasible clutch for disengaging said clutch to achieve full circle rotation of the sprinkler spray head.

The spider cam 200 is shown best in FIGS. 26–28, and comprises a central cylindrical boss 202 rotatably supported within a mating recessed seat 204 formed in the nozzle cap 192, in combination with a plurality of spider legs 206 projecting radially outwardly from the central boss 202 and then curve or turn generally tangentially before terminating at distal ends thereof in short cam pins 208. These cam pins 208, four of which are depicted in the illustrative drawings at the distal ends of a corresponding number of four spider legs 206, project vertically downwardly from the spider legs 206 to ride against the perimeter of a generally square-shaped cam track 210 (FIG. 27) formed within the retainer cup 152 at a location generally surrounding the uppermost margin of the trip core 156. The radially inboard edges of the cam pins 208 are tapered to extend angularly in a radially outward and downward direction, as viewed in FIG. 28 and indicated by arrow 211. An upper end of the central boss 202 includes a screwdriver slot 212 or the like (FIG. 27), and is accessible from the exterior of the sprinkler via the recessed seat 204 which is upwardly open at the center of the nozzle cap 192 (FIGS. 15 and 17).

In a normal adjustment position, the spider cam 200 is rotatably set relative to the nozzle cap 192 to position the cam pins 208 thereon generally at the corners of the cam track 210 (FIG. 27) where they are out of engagement with the trip core 156. In this position of adjustment, the releasible clutch defined by the trip core 156 and the clutch plate 166 are retained by the underlying clutch spring 164 in engagement so that the trip stop keys 180 actuate the lower shift cartridge 46 via the releasible clutch and trip rod 50 for reversible drive sprinkler operation. However, in the event that continuous full circle sprinkler operation is desired, the spider cam 200 can be rotatably adjusted through a part-circle increment of about 45°. This translates the cam pins 208 along the cam track 210 to shift the cam pins 208 radially inwardly toward the trip core clutch flange 160. The tapered inboard surfaces 211 of the cam pins 208 are thus moved into engagement with the clutch flange 160, resulting in a short downward displacement of the trip core 156 sufficient to disengage the trip core from the clutch plate 166. With the trip core 156 retained by the spider cam 200 in this disengaged position, the sprinkler head 14 will be rotatably driven in one direction through repeated full circle revolutions, without reversible driving.

FIGS. 29–38 illustrate an alternative preferred form of the upper trip unit mounted within the spray head 14, wherein components identical to those shown and described with respect to the previous embodiment are identified by common reference numerals, and further wherein modified but otherwise functionally corresponding components are identified by common primed reference numerals. In general terms, a modified upper trip unit 48' is mounted within a spray head housing 146 within an upwardly open retainer cup 152', and includes an individually adjustable pair of end trip stops coupled to a lower shift cartridge 46 (not shown in FIGS. 29–38) via an elongated trip rod 50. A nozzle cap 192' is mounted onto and closes the top of the spray head housing 146, wherein the nozzle cap 192' again carries an adjustable spider cam 200' for disabling at least one of the end trip stops in the event that full circle sprinkler rotation is desired.

Figure 29:
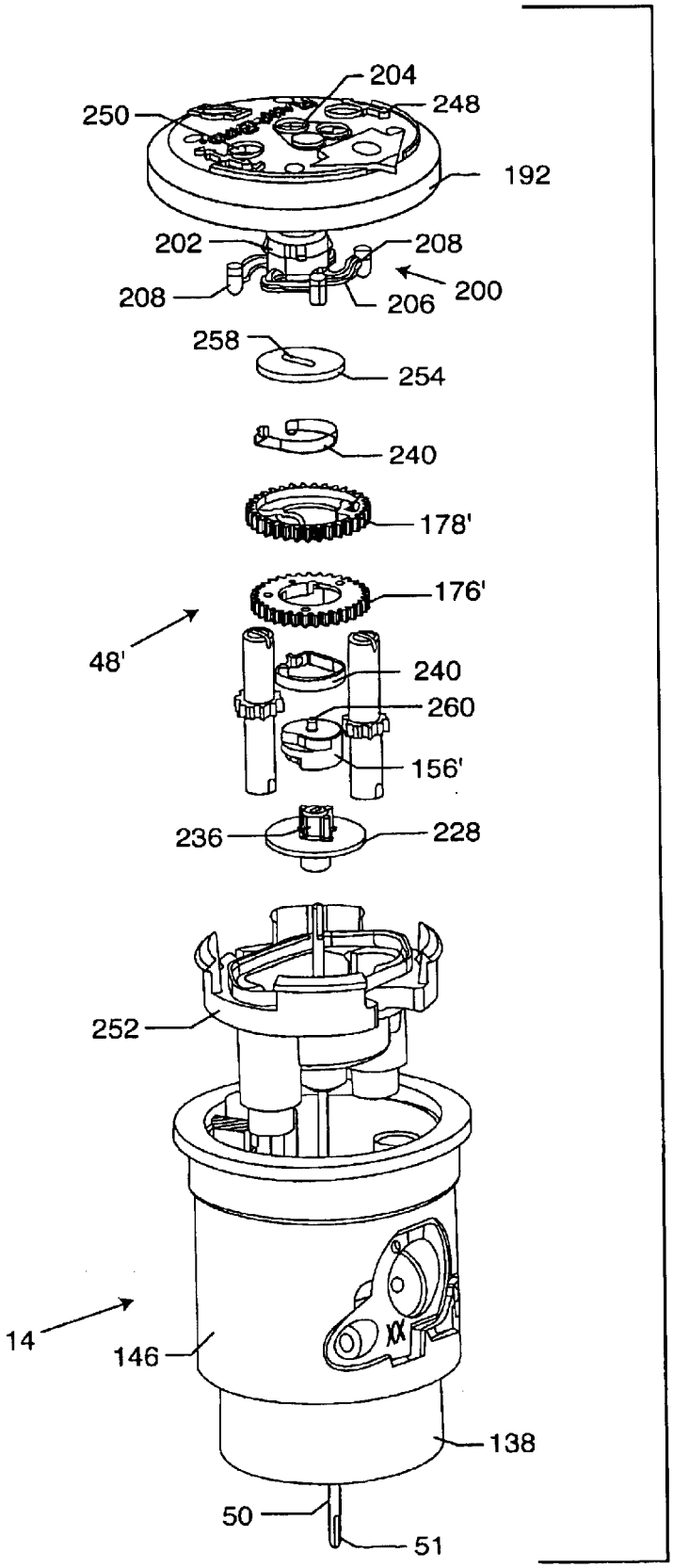
FIG. 29 is an exploded perspective view similar to FIG. 15, but depicting an alternative preferred form of the invention to include a modified upper trip unit mounted within a spray head nozzle housing.
Figure 30:
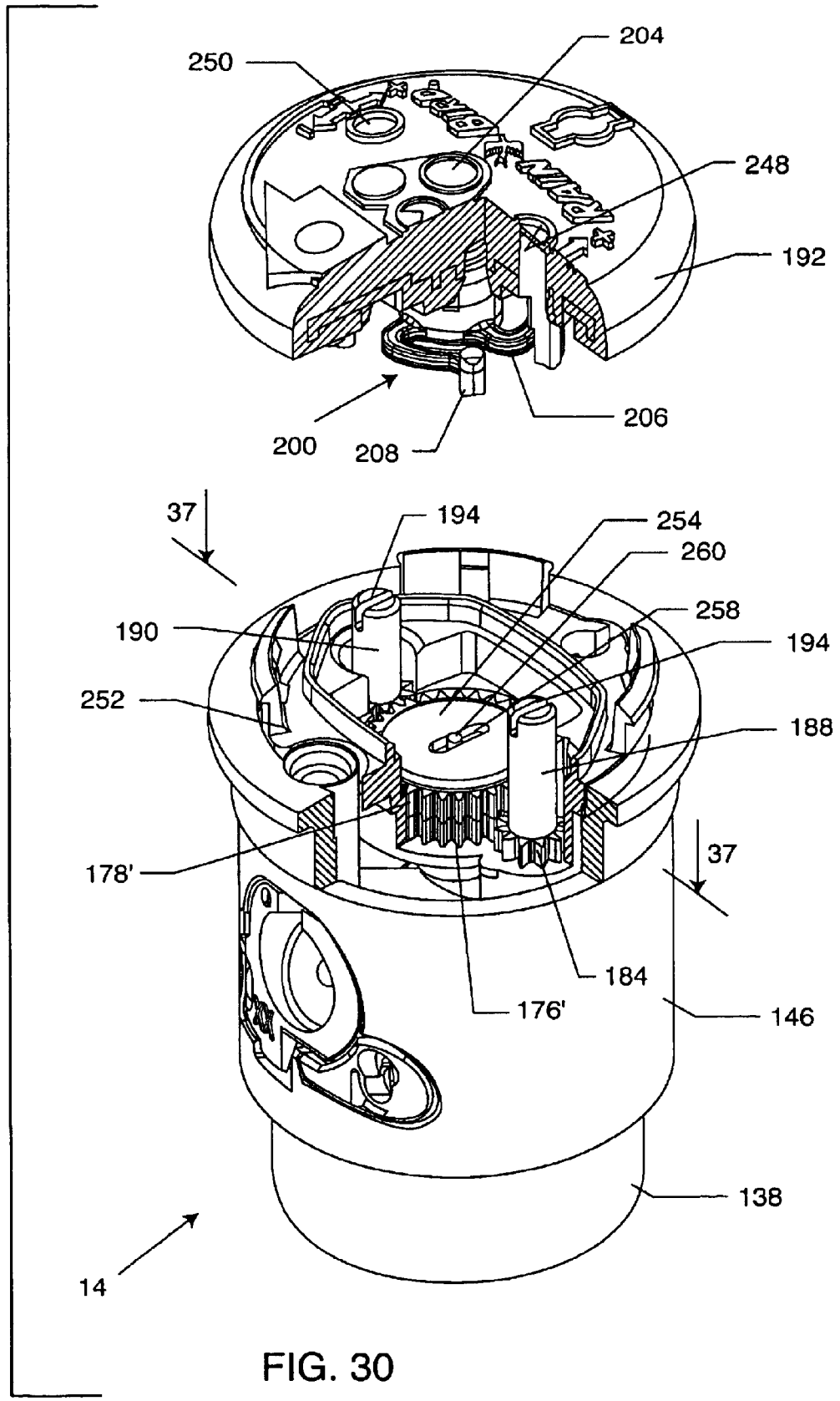
FIG. 30 is an enlarged perspective view similar to FIG. 17, but showing the modified upper trip unit of FIG. 29 mounted within the nozzle housing, and in exploded relation with a spray head cap module.
Figure 33:
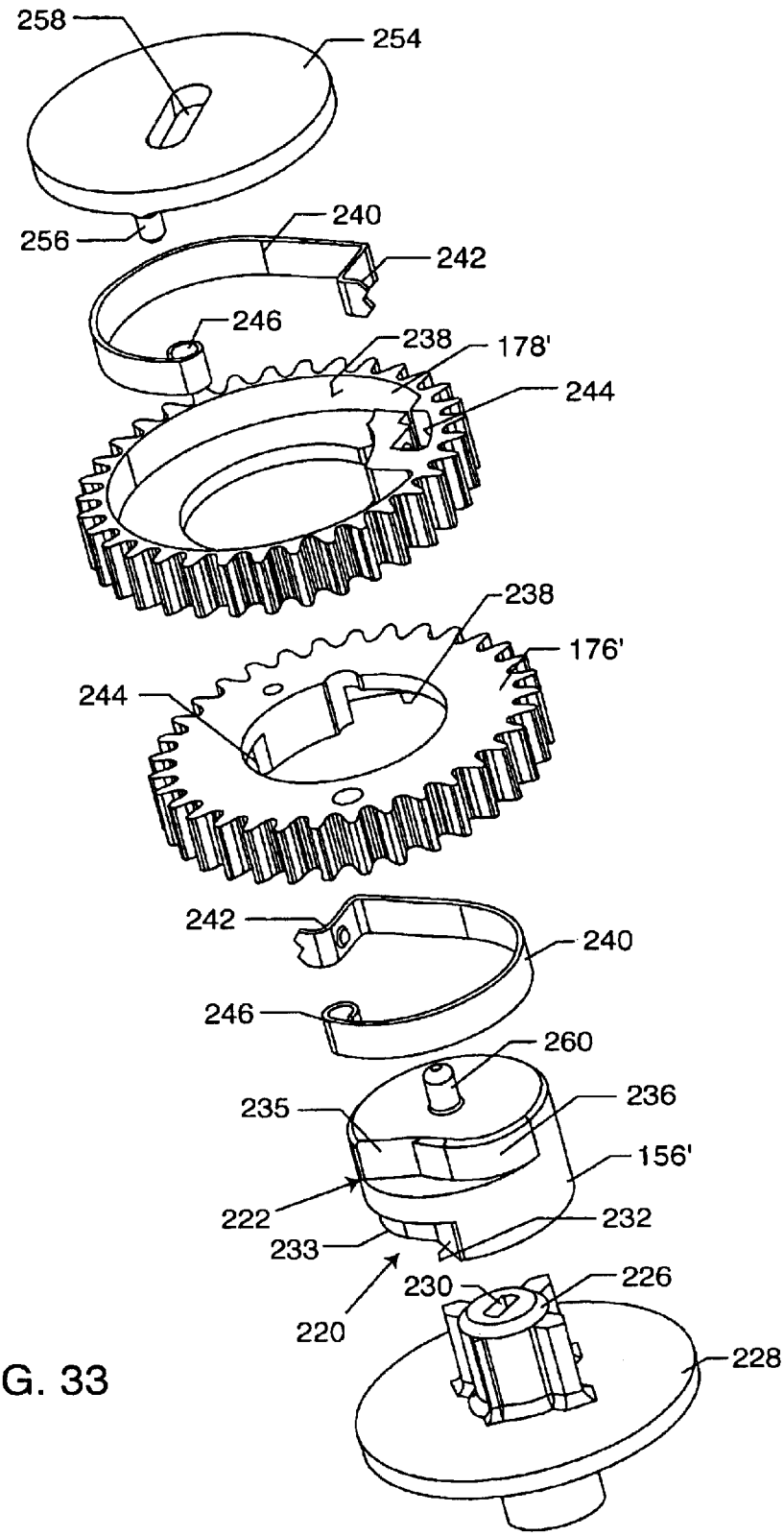
FIG. 33 is an exploded perspective view showing assembly of the modified upper trip unit including a pair of adjustably set trip rings and an upper control disk for converting the sprinkler for full circle spray head rotation.
Figure 34:
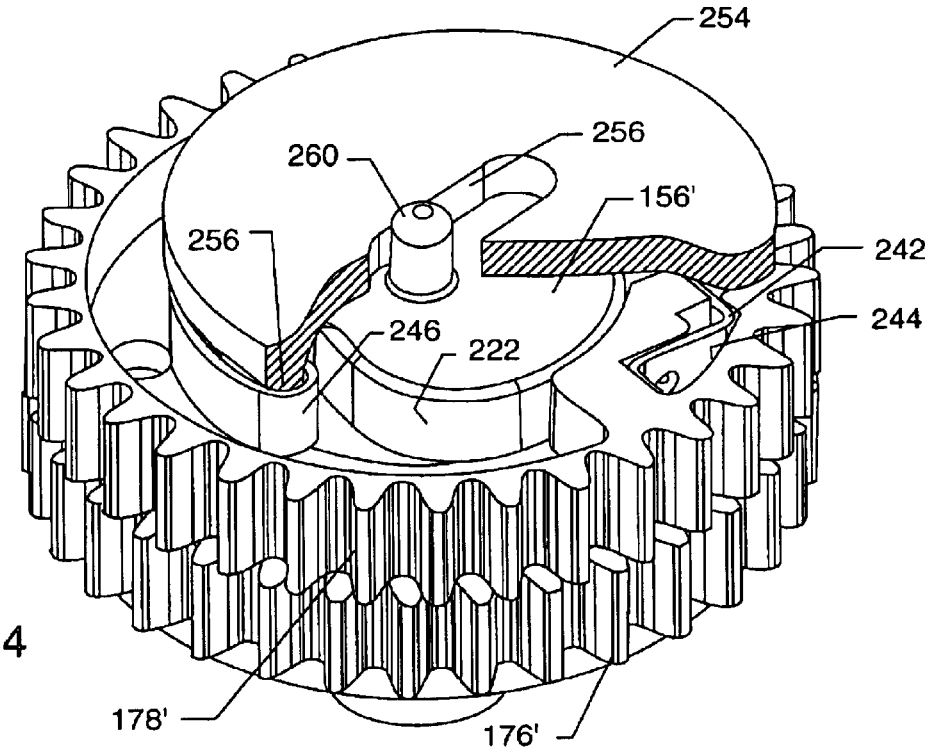
FIG. 34 is an enlarged fragmented perspective view depicting the components of FIG. 33 in assembled relation.
Figure 35:
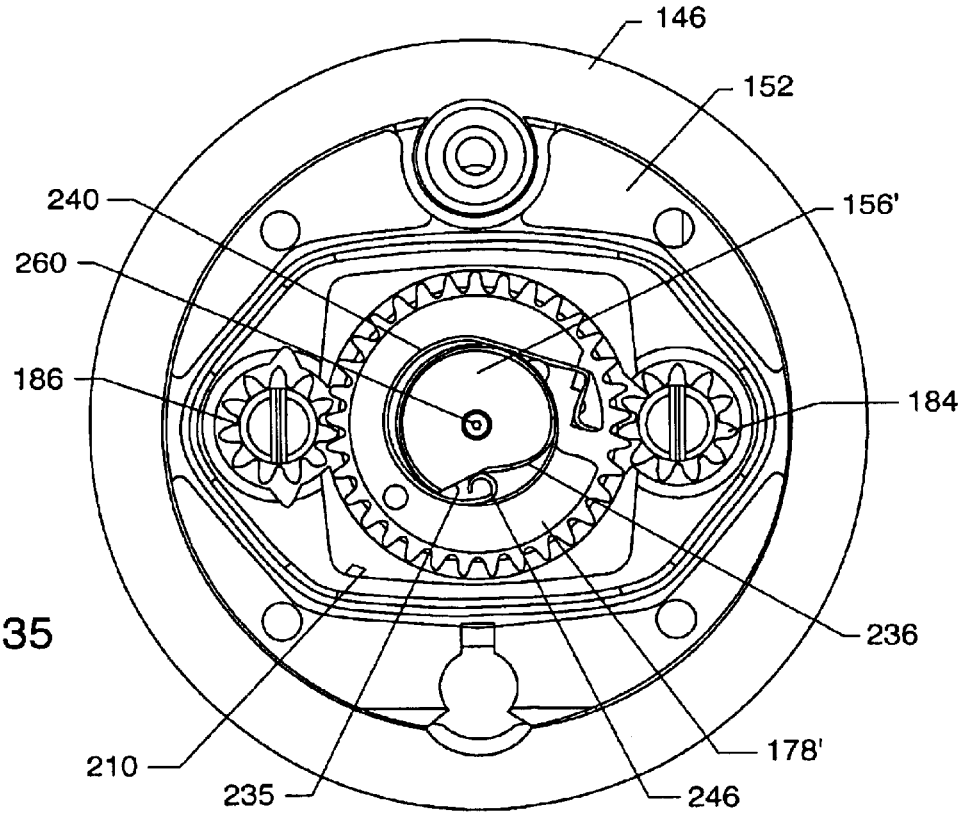
FIG. 35 is a horizontal sectional view of the spray head taken generally on the line 37—37 of FIG. 30, and depicting a lower trip ring of the modified upper trip unit positioned substantially at one end limit of part-circle rotation.

More specifically, the retainer cup 152' again defines an upwardly open and generally cylindrical central cavity for nested mounting of the modified upper trip unit 48'. FIGS. 29, 31 and 33 illustrate the upper trip unit 48' to include a modified trip core 156' having an exterior surface configuration to define a lower cam track 220 and an upper cam track 222. The trip core 156' has a central drive port 224 formed in the underside thereof (FIG. 32) of asymmetric shape for reception of a short drive pin 226 (FIG. 31) of mating asymmetric shape and upstanding from a support disk 228 mounted at the bottom of the retainer cup cavity. This drive pin 226 in turn defines a slotted aperture 230 for receiving a flat-bladed upper end 51 of the trip rod 50 (FIG. 31), which extends downwardly from the upper trip unit 48' coaxially through the components of the gear drive transmission 20 (FIG. 5) for connection of the lower end thereof to the lower shift cartridge 46 as previously described. Accordingly, the trip rod 50 links the trip core 156' of the modified upper trip unit 48' with the lower shift cartridge 46.

The two cam tracks 220 and 222 formed on the trip core 156' are similar in configuration, except that the two cam tracks are formed in reverse as mirror images of each other. That is, as shown best in FIGS. 31–33, the lower cam track 220 comprises a generally cylindrical perimeter surface of the trip core 156' interrupted by a radially inset notch defined on one side by a substantially planar cam flat 232 and on an opposite side by an outwardly convexly shaped cam curve 233. The cam flat 232 and the cam curve 233 do not extend along a radius of the trip core 156', but instead extend inwardly from the cylindrical perimeter generally along a chord relative to an axial centerline of the trip core 156'. The upper cam track 222 has a similar geometry to include a generally cylindrical perimeter surface interrupted by a radially inset notch defined in combination by a substantially planar cam flat 235 and a convexly shaped cam curve 236, except that the cam flat and curve 235, 236 are reversed left-for-right relative to the cam flat and curve 232, 233 of the lower cam track 220.

A pair of annular adjustment trip rings 176' and 178' are mounted on the trip core 156' in respective association with the lower and upper cam tracks 220, 222 and cooperate therewith to define the end trip stops of the reverse assembly. In the preferred form as shown in FIGS. 29, 33, 34, 36 and 38, these trip rings 176', 178' are substantially identical in construction and are adapted for mounting on the trip core 156' in an arrangement inverted relative to each other.

The lower trip ring 176' comprises an externally toothed annular ring defining a central opening for slide-fit mounting over the trip core 156' into axial alignment with the lower cam track 220. The underside of the lower trip ring 176' is hollowed to define a shallow cavity 238 into which a trip spring 240 is mounted. As shown best in FIG. 33, this trip spring 240 includes an anchor foot 242 locked as by snap-fit reception into a detent seat 244 formed in the underside cavity 238 generally at the perimeter thereof. From the anchor foot 242, the trip spring 240 wraps circumferentially about the lower cam track 220 to encircle at least one-half and preferably about 300° of the cam track 220, terminating in a rolled and rounded spring tip or bead 246 for slidably engaging the cam track 220. Importantly, the geometry of the lower trip spring 240 provides a spring bias urging the spring at least slightly off-axis relative to the trip core 156', so that the tip 246 comprises a cam follower retained in engagement with the lower cam track 220.

In a similar manner, the upper trip ring 178' comprises an externally toothed annular ring defining a central opening (FIG. 33) for slide-fit mounting over the trip core 156' in stacked relation with the lower trip ring 176' and in axial alignment with the upper cam track 222. The upper side of the upper trip ring 178' is hollowed to define a shallow cavity 238 into which a second trip spring 240 is mounted. This upper trip spring 240 also includes an anchor foot 242 locked as by snap-fit reception into a similar detent seat 244 formed in the upper cavity 238 generally at the perimeter thereof, and wraps circumferentially about the upper cam track 222 in a manner and magnitude similar to the lower trip spring 240 relative to the lower cam track 220, but in an opposite direction. A distal end of the upper trip spring 240 terminates in a rolled and rounded tip 246 comprising a cam follower for slidably engaging the upper cam track 222. Once again, the trip spring 240 provides a spring bias for normally urging the spring at least slightly off-axis relative to the trip core 156', so that the tip 246 is retained in engagement with the associated cam track 222.

The lower and upper trip springs 240 on the two trip rings 176', 178' respectively permit relative rotation between the trip rings and the trip core 156' in one direction, but respectively prevent such relative rotation in an opposite direction when the cam follower tips 246 are drawn into engagement with the associated cam flats 232 or 235. In particular, during normal rotational driving of the spray head 14 relative to the riser tube 16, the control rod 50 normally retains the trip core 156' against rotation with other components of the spray head. The two trip rings 176', 178' are respectively constrained for rotation with the spray head 14 by means of the pair of adjustment cog wheels 184 and 186 (FIGS. 29–30 and 35–38) engaged respectively therewith. Accordingly, as shown best in FIG. 35, the upper trip ring 178' is free to rotate continuously about the trip core 156' in a forward-drive or counter-clockwise direction (as viewed from above), with the cam follower tip 246 of the associated trip spring 240 riding along the cam track 222 including dropping into the radial notch along the cam flat 235 and riding back out of the notch along the cam curve 236. Conversely, reverse-drive or clockwise rotation of the upper trip ring 178' about the trip core 156' causes the cam follower tip 246 to ride along the upper cam track 222 until the tip 246 drops into the radial notch along the cam curve 236 and then engages the cam flat 235 as viewed in FIG. 35. At this point, the spring tip 246 will lock against the cam flat 235 and thereby cause the upper trip spring 240 to wind up about the trip core 156' and define a first end trip stop preventing further clockwise rotation of the upper trip ring 178'. When this occurs, the upper trip ring 178' drives the trip core 156' and the trip rod 50 connected thereto through a short incremental rotational stroke in the clockwise direction sufficient to displace the lower shift cartridge 46 from a reverse-drive to a forward-drive position as previously shown and described.

In the same manner, by virtue of its mirror image geometry, the lower trip ring 176' is free to rotate continuously about the trip core 156' in an opposite, namely, reverse-drive or clockwise direction with the associated cam follower tip 246 of the trip spring 240 riding smoothly along the lower cam track 220 including dropping into the radial notch along the cam flat 232 and riding back out of the notch along the cam curve 233. However, when the lower trip ring 176' is rotated counter-clockwise relative to the trip core 156', the cam follower tip 246 of the lower trip spring 240 eventually drops into the radial notch of the lower cam track 220 and then locks against the associated cam flat 232. This causes the trip spring 240 to wind up about and lock with the trip core 156' to define a second end trip stop and driving the trip core 156' and the trip rod 50 through a short rotational stroke in a counter-clockwise direction for switching the lower shift cartridge 46 back to the reverse-drive position.

Figure 36:
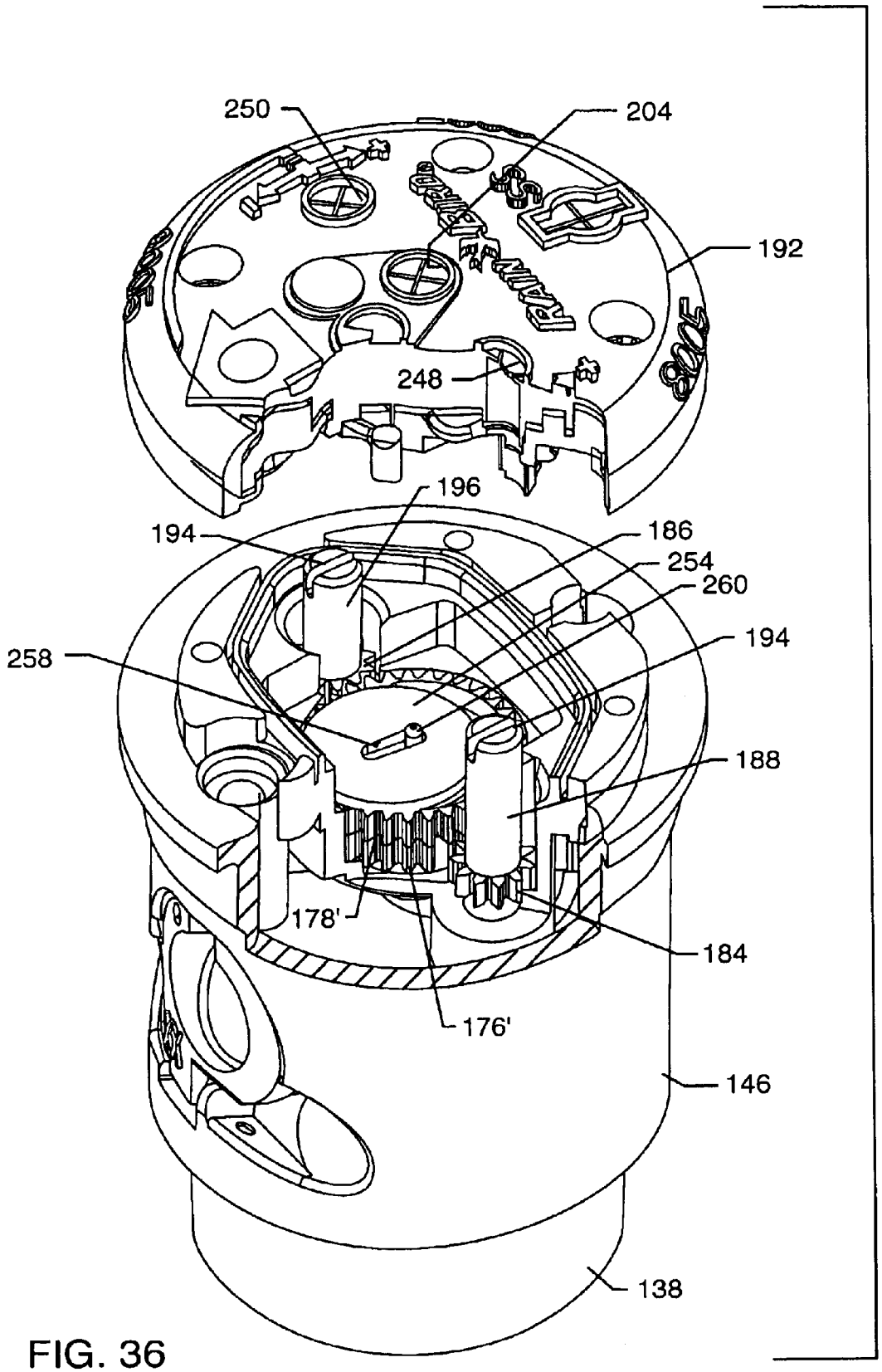
FIG. 36 is a top perspective view showing the spray head, with the cap module removed to reveal components of the modified upper trip unit of FIG. 29 mounted within the nozzle housing.
Figure 37:
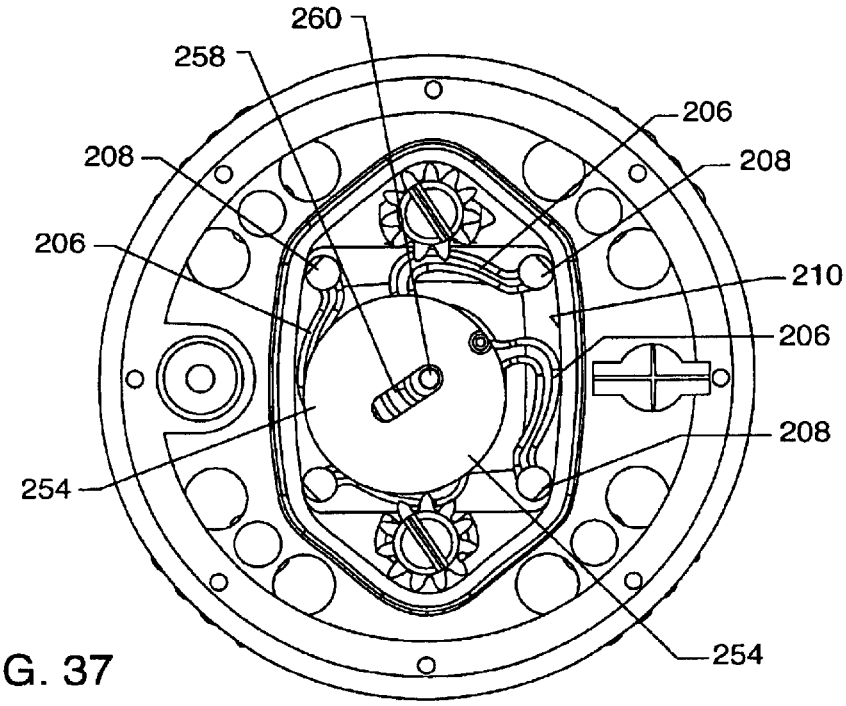
FIG. 37 is a plan view similar to FIG. 35 but additionally showing the adjustment cam in engagement with the upper control disk for adjustable setting the spray head for part-circle or full circle operation.
Figure 38:
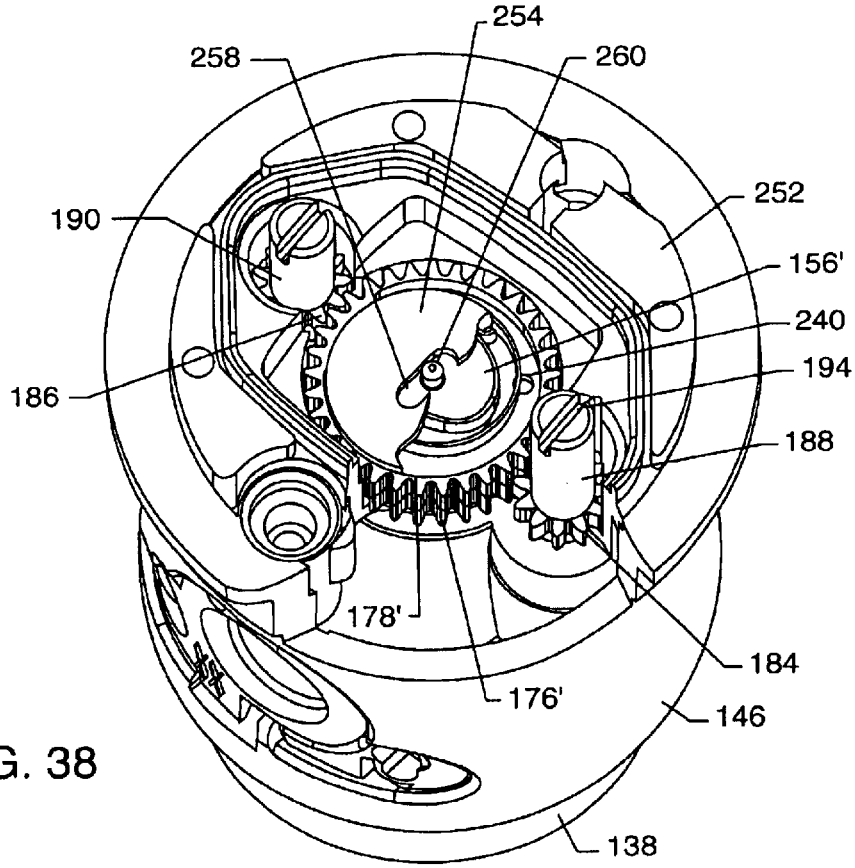
FIG. 38 is a perspective view similar to FIG. 36, but illustrating the upper control disk in a position for full circle spray head operation.

Each of the trip rings 176', 178' is adjustable quickly and easily from the exterior of the sprinkler 10 for separate and individual selected setting of the positions for the two end trip stops. Specifically, the two adjustment cog wheels 184, 186 are carried on the respective pair of adjustment shafts 188', 190' at diametrically opposed sides of the stacked lower and upper trip rings 176', 178'. FIG. 36 shows the adjustment cog wheel 184 on the adjustment shaft 188', to position the cog wheel 184 in meshed engagement with the toothed perimeter of the lower trip ring 176'. In a similar fashion, FIG. 36 also shows the other adjustment cog wheel 186 on the adjustment shaft 190', to position the cog wheel 186 thereon in meshed engagement with the toothed perimeter of the upper trip ring 178'. The upper ends of the two adjustment posts 188', 190' are rotatably seated respectively within upwardly open access ports 248' and 250' formed in the nozzle cap 192', as previously shown and described. The exposed upper ends of the adjustment posts 188', 190' are again slotted as indicated at 194' for screwdriver access via the ports 248', 250' for rotatably adjusting the rotational positions of the two trip rings 176', 178' to correspondingly set the opposite end limits of back-and-forth spray head rotation. Importantly, however, the two adjustment shafts 188', 190' are supported by the underlying retainer cup 152' and the overlying nozzle cap 192' with sufficient friction resistance to effectively lock the two trip rings 176', 178' against undesired self-rotation or rotational creep relative to the spray head 14 during normal sprinkler operation.

The spider cam 200' may also be provided in the alternative embodiment of FIGS. 29–38 for quickly and easily disabling of the end trip stops from the exterior of the sprinkler, to set the spray head 14 for full circle rotation through continuous full circle revolutions. In this regard, the spider cam 200' is adapted for engagement with an upper control disk 254 (FIGS. 29, 30, 33–34, and 36–39) overlying the upper trip ring 178' and including a depending tab 256 (FIG. 33) fitted into the cam follower tip 246 of the upper trip spring 240. A diametrically elongated slot 258 is formed in the control disk 254 along a diameter generally coinciding with the tab 256 and receives a short upstanding axially centered cam pin 260 at the upper end of the trip core 156'. The slot 258 permits the bias provided by the trip spring 240 to carry the control disk 254 normally to an off-axis or off-centered position (FIGS. 30, 34 and 36–37) relative to the underlying trip ring 178'. In this normal off-axis position, the control disk 254 does not interfere with normal engagement of the cam follower tip 246 with the upper cam track 222 on the trip core 156'.

The spider cam 200' mounted on the underside of the nozzle cap 192' can be rotatably adjusted as previously described for selectively shifting the control disk 254 to a full circle setting wherein the end trip stop associated with the upper trip ring 178' is disabled. The spider cam 200' includes the elongated and curved spider legs 206 each terminating in the associated cam pin 208', as previously shown and described. These cam pins 208' depend from the cam legs 206 to engage the generally rectangular cam track 210 formed in the retainer cup 152' at an axial location about the control disk 254. In a normal position for back-and-forth part-circle reversible operation of the sprinkler spray head 14, the cam pins 208' are disposed at the corners of this cam track 210 (FIG. 37) to permit movement of the control disk 254 to the normal off-axis position. However, when full circle operation is desired, the spider cam 200' can be rotated as previously described to cause the cam pins 208' to engage the control disk 254 and to move the control disk back to a generally on-axis or centered position as viewed in FIG. 38. In this centered position, the control disk 254, the tab 256 on the control disk 254 shifts the cam follower tip 246 on the upper trip spring 240 in a radially outward direction relative to the trip core 156', resulting in disengagement of the trip spring 240 from the trip core to correspondingly disable the upper end trip stop.

In this setting, the spray head 14 is permitted to rotate continuously through full circle revolutions in a reverse-drive or clockwise direction, since the cam follower tip 246 will not engage and lock with the cam flat 235 of the upper cam track 222. In the event that the upper end trip stop is disabled while the lower shift cartridge 46 is set for forward-drive or counter-clockwise rotation of the spray head 14, the spray head will rotatably index counter-clockwise to the end trip stop defined by the lower trip ring 176' and then reverse for clockwise rotation in continuous full circle revolutions. Return setting of the spray head 14 for resumed part-circle reversible operation is achieved by return rotational adjustment of the spider cam 200' to permit the control disk 254 to shift back under the influence of the upper trip spring 240 to the normal off-axis position.

This modified upper trip unit 48' is also beneficially resistant to attempted vandalism such as forced rotation of the spray head 14 relative to the riser tube 16 in an attempt to break or otherwise re-orient the settings of the end trip stops. In this regard, the configuration of the trip core 156' (FIGS. 31 and 33) to define the chord-like cam flats 235, 232 on the upper and lower cam tracks 222, 220 enables effective lock-up with the trip springs 240 during normal reversible rotary drive operation. However, in the event of attempted forced rotation of the spray head 14, the cam follower tips 246 on the trip springs 240 will displace generally radially outwardly along the associated cam flats 235, 232 to accommodate the forced rotation without breakage of any sprinkler components. Accordingly, the trip springs 240 will disengage from their associated cam flats 235, 232 upon such attempted over-rotation of the sprinkler head, and thereby provide a releasible clutch for the upper trip unit 48'. Upon subsequent resumption of sprinkler operation, the cam follower tips 246 on the trip springs 240 will ride circumferentially about the respective cam tracks 222, 220 until the spray head returns to within the range of the previously set arcuate pattern, at which time reversible operation within the set arcuate pattern will resume. Accordingly, forced rotation of the spray nozzle 14 to a rotational position outside the pre-set arcuate pattern will not break sprinkler components and further will not alter the settings of the end trip stops.

Figure 39:
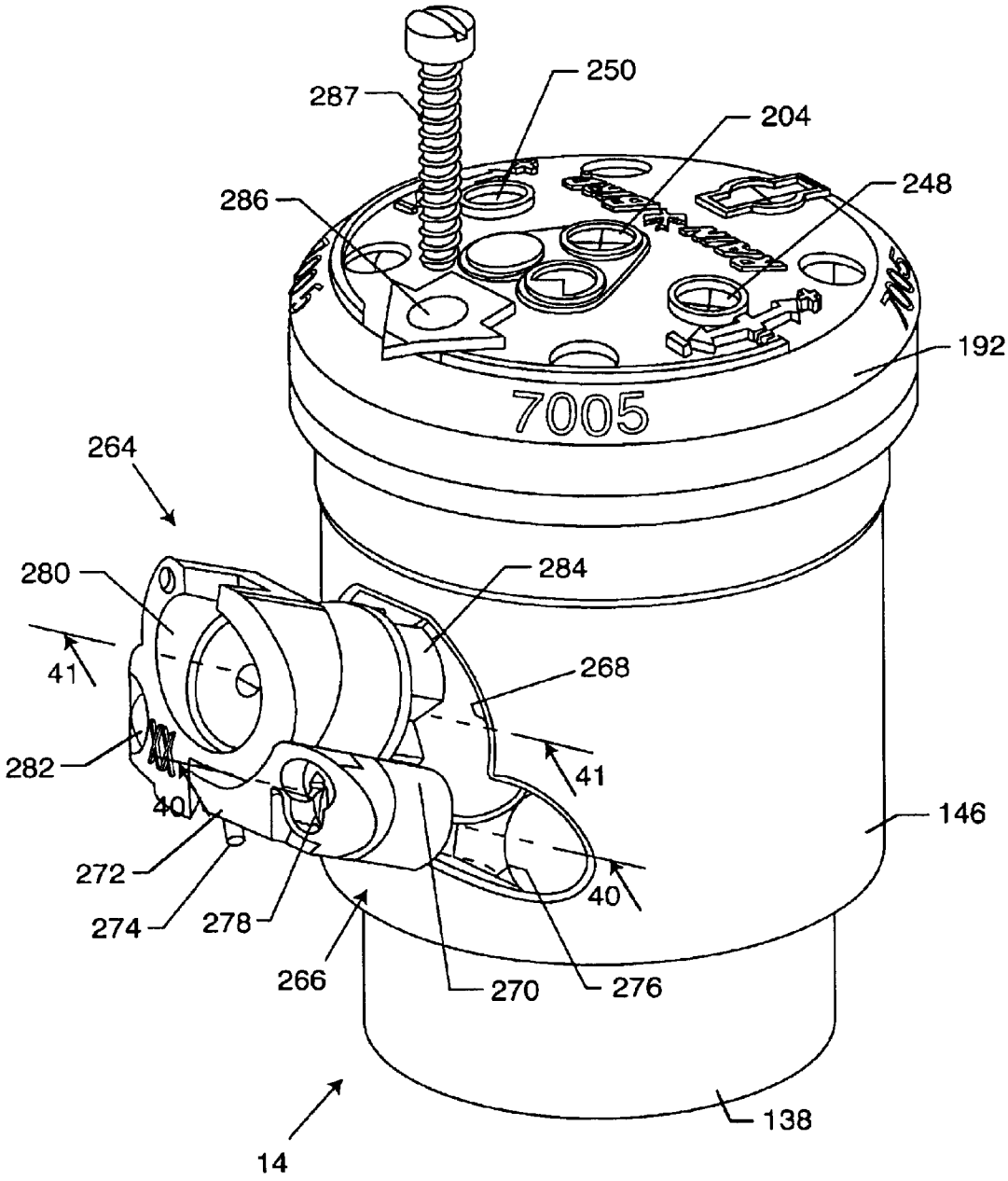
FIG. 39 is an enlarged perspective view showing the spray head in exploded relation with primary, secondary and tertiary spray nozzles for removable mounting on the nozzle housing.
Figure 40:
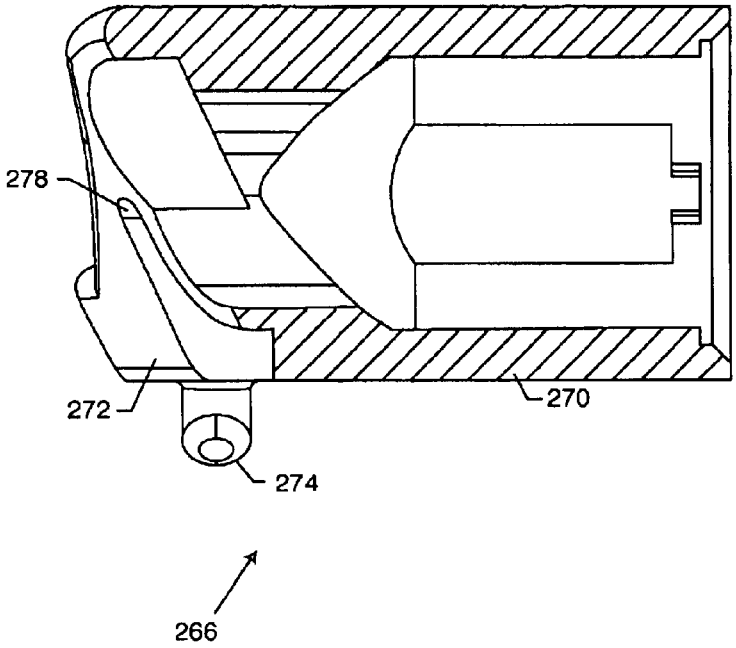
FIG. 40 is an enlarged vertical sectional view taken generally on the line 40—40 of FIG. 39.
Figure 41:
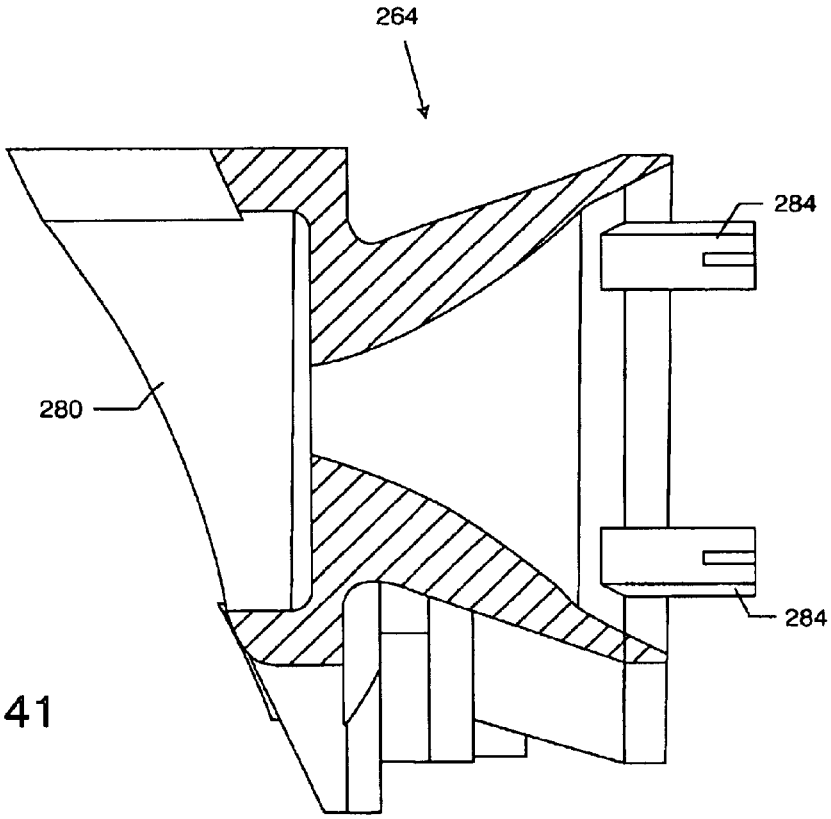
FIG. 41 is an enlarged vertical sectional view taken generally on the line 41—41 of FIG. 39.

FIGS. 39–41 illustrate a preferred spray nozzle geometry for the spray head 14, to include a primary spray nozzle unit 264 and an associated tertiary spray nozzle unit 266. As shown, the spray nozzle housing 146 is shaped to define a generally tri-lobed discharge opening 268 (FIG. 39) in one side thereof for removable mounting of the primary and tertiary nozzle units 264, 266 which define spray paths for spray distribution of irrigation water over the target terrain area. The nozzle units 264, 266 are designed for quick and easy seated installation within the discharge opening 268 and cooperatively provide multiple spray paths for long-range and short-range water streams for substantially uniform precipitation rate over the terrain area to be irrigated.

More particularly, the tri-lobe discharge opening 268 comprises a relatively large upper passage aimed angularly upwardly and outwardly from the lower pressure chamber 144 (FIG. 5) within the nozzle housing 146. This large upper passage is generally centered above and flanked by a pair of smaller lobe passages. As shown in FIGS. 39–40, one of these smaller lobe passages is sized and shaped for slide fit reception of the tertiary nozzle unit 266 comprising a generally cylindrical nozzle tube 270 joined near a front end thereof to a short radially extending mounting arm 272. This mounting arm 272 carries a lock pin 274 positioned to seat within a lock port 276 formed in the nozzle housing 146. The tertiary nozzle unit 266 is fitted into the associated lobe passage with the mounting arm 272 and lock pin 274 rotated out of alignment with the lock port 276, followed by rotation of the mounting arm 272 to seat the lock pin 274 in the lock port 276. A nozzle port 278 of selected geometry is formed at the front end of the nozzle tube 270 through which a close-range stream of water is projected for close-range terrain irrigation.

The primary nozzle unit 264 comprises a comparatively larger nozzle component in the form of a main spray nozzle 280 formed integrally with a secondary spray nozzle 282. A cylindrical flow straightening grid 285 (FIG. 41) is snap fit or welded to the rear end of the main spray nozzle 280 to the nozzle. Latch fingers 284 (FIGS. 39 and 41) at the rear end of the main spray nozzle 280 are designed for interference-fit engagement with the nozzle housing 146, to secure the primary nozzle unit 264 with the main spray nozzle 280 seated within the larger lobe passage and the secondary spray nozzle 282 seated within the other smaller lobe passage. A lock screw 287 (FIG. 39) may be fastened into a mounting port 286 formed in the nozzle cap 192 and spray head 14 for removably locking the primary nozzle unit 264 in place. When mounted in this manner, the primary nozzle unit 264 securely retains the tertiary nozzle unit 266 in place by preventing dislocation of the lock pin 274 from the associated lock port 276.

Figure 42:
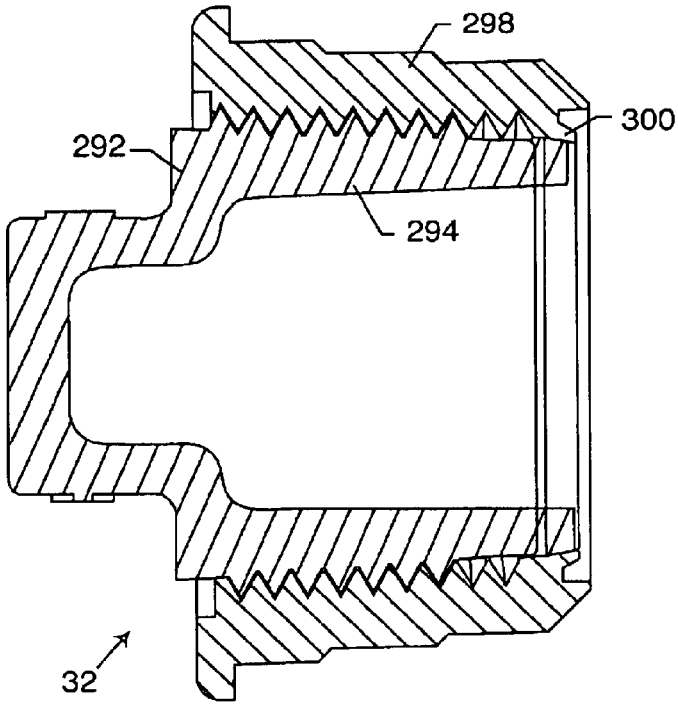
FIG. 42 is an enlarged fragmented vertical sectional view showing a plug seal member for assembly with the sprinkler housing.
Figure 43:
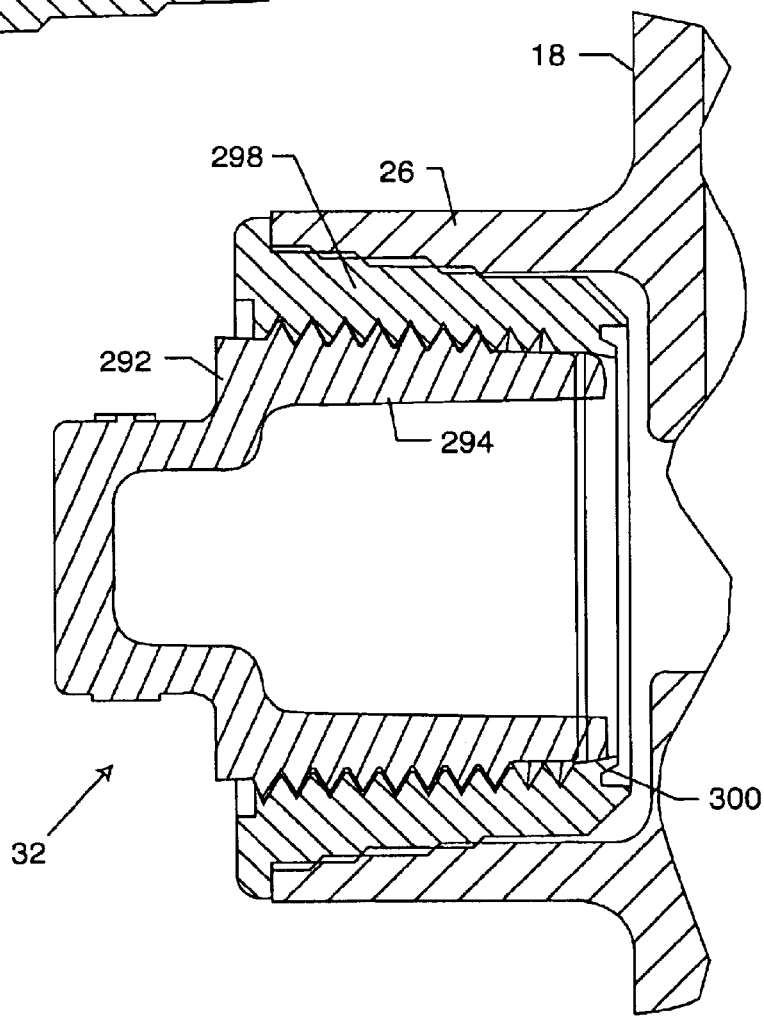
FIG. 43 is an enlarged fragmented vertical sectional view illustrating the plug seal member of FIG. 42 in assembled relation with the sprinkler housing.

FIGS. 42 and 43 depict an improved plug seal member 32 for sealingly closing the side inlet 26 formed in the sprinkler housing 18, when the lower inlet 24 is the one used for connecting the sprinkler 10 to the water supply line 30 (as viewed in FIG. 1). As shown, the plug seal member 32 comprises a plug end wall 292 joined with a cylindrical and externally threaded plug core 294 adapted for thread-in reception into an internally threaded bore formed in an adapter sleeve 298. The end wall 292 desirably includes an external squared nipple or the like for engagement with a suitable wrench or the like. The adapter sleeve 298 is sized for secure and substantially sealed mounting within the side inlet 26 formed in the sprinkler housing 18, as by a bonded adhesive or weld attachment therein. Importantly, a leading edge of the adapter sleeve 298 carries a pliant lip seal 300 which protrudes angularly and radially inwardly therefrom. This lip seal 300 is positioned for engagement by a leading end of the plug seal member 32 upon threaded mounting thereof into the adapter sleeve 298, whereupon the lip seal 300 responds to tightening forces and water pressure within the sprinkler housing 18 to seat and seal effectively against the leading end of the plug seal member 32, as viewed in FIG. 43. A second adapter sleeve 298 may be installed in a similar manner in the lower inlet 24, as viewed in FIG. 3, for seated and sealed engagement of the lip seal 300 thereon with the leading end of a threaded nipple used to coupled the sprinkler housing 18 to the water supply line 30 (FIG. 1). It will be understood, of course, that the plug seal member 32 may be installed within the adapter sleeve 298 at the lower inlet 24 in the event that the side inlet 26 is used to connect the sprinkler to the water supply line.

Figure 44:
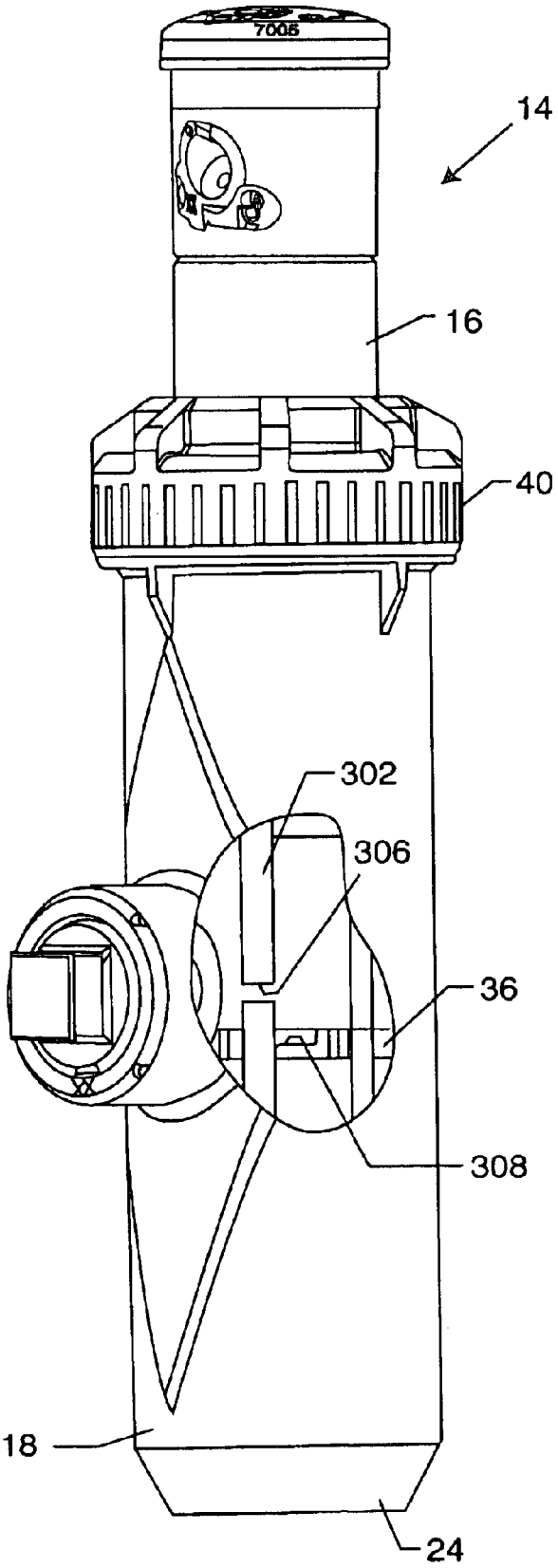
FIG. 44 is a fragmented and somewhat schematic front elevation view of the sprinkler, illustrating an internal support rib formed within the sprinkler housing for use in temporarily retaining the pop-up riser in a partially elevated position.
Figure 45:
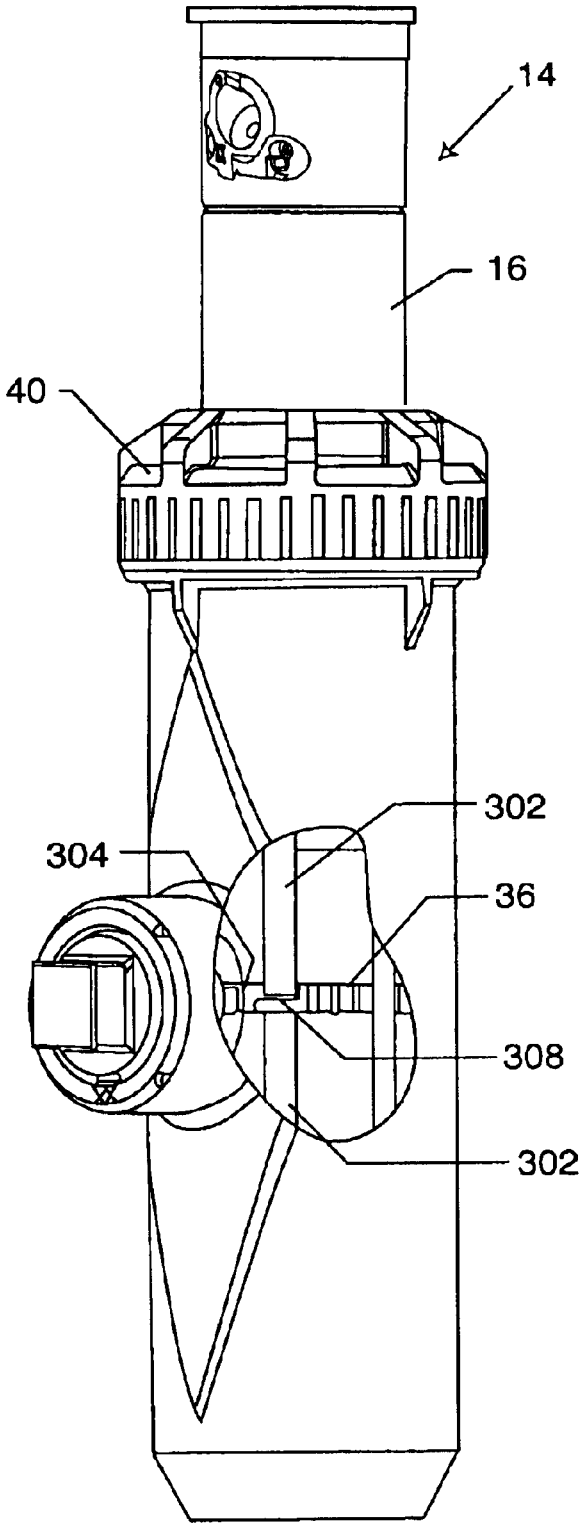
FIG. 45 is a fragmented front elevation view similar to FIG. 44, but depicting the housing support rib engaged with a lower flange on the pop-up riser for supporting the riser in a partially elevated position.

According to a further feature of the improved gear drive sprinkler 10 of the present invention, the sprinkler housing 18 and the riser tube 16 includes cooperative means for temporarily supporting the pop-up riser 16 in a partially elevated position for easy access to the spray nozzle 14 as may be required for service or maintenance. As shown in FIGS. 44 and 45, the housing 18 may include a conventional internal and vertically elongated guide rib 302 which interlocks with a gap 304 (also shown in FIG. 2) formed in the flange 36 at the lower end of the riser tube 16, for guiding the pop-up riser 16 for vertical displacement without rotation within the housing 18. As shown, however, this guide rib 302 additionally includes a gap 306 formed therein, generally at a mid-height location. When the pop-up riser 16 is elevated manually to a substantially half-height location, the flange gap 304 can be vertically aligned with the gap 306 in the guide rib 302. At this point, the riser tube 16 can be rotated a few degrees to misalign the flange gap 304 relative to the guide rib gap 306, so that a portion of the riser tube flange 36 is seated within the guide rib gap 306 whereby the riser tube 16 is locked in a half-height position as viewed in FIG. 45. A shallow step 308 may be formed as shown in the flange 36 to prevent riser tube rotation beyond a minimal stroke sufficient to interlock the components as shown. The spray nozzle 14 is thus supported in a partially elevated position (FIG. 45) for easy access and service. The riser tube 16 is quickly and easily unlocked for resumed normal pop-up and pop-down displacement by rotating the riser tube 16 back to a normal position with the flange gap 304 aligned with the housing guide rib 302.

According to still another aspect of the invention, the water-driven turbine 44 may include brake means for preventing rotation thereof at an excess speed, particularly in the event that compressed air is used to flush water and/or particulate from the internal flow passages within the sprinkler and/or the related water supply line. As shown in FIGS. 7–8, the turbine brake means comprises a pair of brake arms 310 extending outwardly from a central hub 312 mounted coaxially with and rotatable with the turbine 44. The brake arms 310 project radially outwardly and then turn through a part-circumferential segment adapted to displace radially outwardly by centrifugal force in response to turbine rotation at an excessive speed. These part-circumferential segments of the brake arms frictionally contact the interior of the turbine housing or shroud when the turbine is rotated as a speed significantly greater than the normal water-driven operating speed, to prevent excess wear and/or thermal damage to moving parts of the turbine and related gear drive transmission 20. Accordingly, compressed air which can otherwise drive the turbine at a speed up to or greater than 10,000 rpm, can be used to flush the components of the sprinkler system, with the turbine brake arms 310 preventing actual turbine rotating speeds greater than a safe threshold on the order of about 5,000–6,000 rpm.

A variety of further modifications and improvements in and to the improved gear drive sprinkler of the present invention will be apparent to those skilled in the art. For example, persons skilled in the art will recognize and appreciate that the lower shift mechanism 46 of the reverse assembly 22 may comprise a shiftable gear as disclosed by way of example in U.S. Pat. No. 4,568,024. Accordingly, no limitation on the invention is intended by way of the foregoing description and accompanying drawings, except as set forth in the appended claims.

What is claimed is:

1. An irrigation sprinkler for controlled distribution of irrigation water over surrounding terrain, comprising:

a sprinkler housing adapted for connection to a supply of irrigation water under pressure;

a spray head rotatably carried by said housing, and including nozzle means for projecting at least one stream of irrigation water outwardly from said housing;

a water driven gear drive transmission for rotatably driving said spray head to sweep said at least one stream of irrigation water over the surrounding terrain; and a reverse assembly including a shift mechanism movable between forward and reverse drive positions for respectively shifting said gear drive transmission between forward and reverse drive rotational directions for correspondingly reversing the direction of rotatable driving of said spray head;

said reverse assembly further including a trip unit having a pair of end trip stops rotatable with said spray head and defining the opposite end limits of a predetermined part-circle path of reversible spray head rotation, and clutch means for engagement by said end trip stops respectively at said opposite end limits of part-circle spray head rotation and for responding thereto to displace said shift mechanism between said forward and reverse drive positions;

said clutch means being disengageable upon forced over-rotation of said spray head beyond one of said opposite end limits of part-circle spray head rotation to uncouple said end trip stops from said shift mechanism, said clutch means being re-engageable upon return rotation of said spray head to a position between said opposite end limits of part-circle rotation.

2. The irrigation sprinkler of claim 1 wherein each of said end trip stops is adjustable relative to said spray head for individually and selectively setting the positions of said opposite end limits of part-circle spray head rotation.

3. The irrigation sprinkler of claim 1 further including means for selectively disabling at least one of said end trip stops to permit continuous full circle spray head rotation.

4. The irrigation sprinkler of claim 1 further including a pop-up riser having said spray head mounted thereon, said pop-up riser being mounted within said sprinkler housing for movement between a normal spring-loaded position retracted substantially within said housing and an elevated spraying position with said spray head elevated above said sprinkler housing in response to connection of said housing to the supply of irrigation water under pressure.

5. The irrigation sprinkler of claim 1 wherein said water driven gear drive transmission comprises a water driven turbine, and a speed reduction transmission coupled between said turbine and said spray head.

6. The irrigation sprinkler of claim 5 wherein said turbine is rotatably carried by a turbine housing, and further wherein said speed reduction transmission comprises a plurality of speed reduction gears carried within a gear box housing and including a main drive gear driven by said turbine and an output gear rotatably driving said spray head, said gear box housing being rotatable relative to said turbine housing upon manually forced rotation of said spray head.

7. The irrigation sprinkler of claim 5 wherein said shift mechanism comprises a deflector plate mounted generally at an upstream side of said water driven turbine, said deflector plate having at least one set of first and second oppositely angled jet nozzles formed therein for respective passage of at least a portion of the irrigation water under pressure into driving communication with said water turbine, said deflector plate being movable between said forward drive position with said first jet nozzle oriented for water passage to drive said water turbine in a forward drive direction, and said reverse drive position with said second jet nozzle oriented for water passage to drive said water turbine in a reverse drive direction.

8. The irrigation sprinkler of claim 7 further including a pressure regulator unit mounted generally at an upstream side of said deflector plate, said pressure regulator unit including at least one turbine drive jet port for passage of at least a portion of the irrigation water under pressure through said deflector plate jet nozzles into driving communication with said water turbine, and a bypass valve normally spring-loaded to a position closing a bypass port and responsive to a predetermined water pressure for movement to an open position to open said bypass port to permit bypass flow of a portion of the irrigation water under pressure around said deflector plate and said water turbine.

9. The irrigation sprinkler of claim 8 wherein said bypass port has a generally multi-legged configuration.

10. The irrigation sprinkler of claim 8 further including inlet filter means mounted generally at an upstream side of said flow regulator unit.

11. The irrigation sprinkler of claim 10 wherein said inlet filter means comprises a perforate wall filter basket having internal, generally diametrically extending support ribs.

12. The irrigation sprinkler of claim 5 further including at least one centrifugal brake arm rotatably carried with said water turbine, said brake arm including means for radially outward displacement by centrifugal force upon rotational driving of said turbine at a predetermined maximum rotational speed to frictionally engage an adjacent nonrotating structure and thereby limit the rotational speed of said turbine.

13. The irrigation sprinkler of claim 1 wherein said trip unit comprises a pair of adjustment rings rotatably mounted in stacked relation within said spray head and respectively carrying said pair of end trip stops.

14. The irrigation sprinkler of claim 13 further including means accessible from the exterior of said spray head for individually adjusting the rotatable positions of said adjustment rings relative to each other to correspondingly and individually adjust the relative positions of said end trip stops.

15. The irrigation sprinkler of claim 13 wherein said adjustment rings each include an externally formed set of gear teeth, and further including a pair of cog wheels meshed respectively with said pair of adjustment rings, said pair of cog wheels being carried on a respective pair of adjustment posts rotatably carried by said spray head and having upper ends thereof accessible from the exterior of said spray head.

16. The irrigation sprinkler of claim 15 wherein said upper exposed ends of said adjustment posts have screw-driver slots formed therein.

17. The irrigation sprinkler of claim 13 wherein said adjustment rings each include a radially inwardly extending stop key forming said end trip stop thereon.

18. The irrigation sprinkler of claim 17 wherein said clutch means is mounted within said spray head in a position generally within said adjustment rings and includes a radially outwardly extending drive tab for engagement by said stop keys respectively at said opposite end limits of part-circle spray head rotation.

19. The irrigation sprinkler of claim 18 wherein said clutch means comprises a trip core having said drive tab thereon, a clutch insert, and spring means for normally retaining said clutch insert in driven engagement with said trip core, and further including a drive rod rotatably connected between said clutch insert and said shift mechanism for shifting said gear drive transmission between said forward and reverse drive positions, said clutch insert being springably disengageable from said trip core upon forced over-rotation of said spray head beyond one of said opposite end limits of part-circle spray head rotation to uncouple said trip unit from said shift mechanism, and said clutch insert being springably re-engageable with said trip core upon return rotation of said spray head to a position between said opposite end limits of part-circle rotation.

20. The irrigation sprinkler of claim 19 wherein said trip rod extends generally coaxially through said water driven gear drive transmission.

21. The irrigation sprinkler of claim 19 wherein said trip rod comprises a metal shaft.

22. The irrigation sprinkler of claim 19 wherein said trip core comprises a radially outwardly extending clutch flange defining a recessed seat formed with ramped side margins, and wherein said clutch insert comprises a clutch plate having a size and shape to overlie and engage said clutch flange, said clutch plate having a lug thereon for seated reception into said recessed seat formed in said clutch flange.

23. The irrigation sprinkler of claim 19 further including means for selectively disengaging said clutch insert from said trip core for disabling said end trip stops to permit continuous full circle spray head rotation.

24. The irrigation sprinkler of claim 23 wherein said means for selectively disengaging said clutch insert from said trip core comprises a spider cam mounted on said spray head and movable between a first position retracted from said clutch insert to permit part-circle spray rotation between said opposite end limits defined by the positions of said end trip stops, and a second position engaging and displacing said clutch insert to a position disengaged from said trip core to permit full circle spray head rotation.

25. The irrigation sprinkler of claim 24 wherein said spider cam comprises a generally cylindrical boss rotatably mounted on said spray head, and a plurality of flexible spider legs radiating outwardly from said boss and each including a cam pin engageable with a cam track formed on said spray head for movement of said cam pins upon rotation of said boss between said first position retracted from said clutch insert and said second position engaged with said clutch insert.

26. The irrigation sprinkler of claim 25 wherein said boss has an upper end exposed to the exterior of said spray head, said boss upper end having a screwdriver slot formed therein.

27. The irrigation sprinkler of claim 13 further including first and second trip springs mounted respectively within said pair of adjustment rings and extending generally circumferentially therein in opposite directions and each terminating in an enlarged spring bead defining one of said pair of end trip stops, and further wherein said clutch means comprises a trip core mounted generally within said adjustment rings and defining first and second cam tracks engageable respectively by said first and second trip springs, said first and second cam tracks being formed generally as opposite mirror images each to include an angularly oriented cam flat engageable upon spray head rotation by said spring bead of the associated one of said first and second trip springs to rotatably displace said trip core, and further including a drive rod rotatably connected between said trip core and said shift mechanism for shifting said gear drive transmission between said forward and reverse drive positions, said trip springs being springably disengageable from said trip core upon forced over-rotation of said spray head beyond one of said opposite end limits of part-circle spray head rotation to uncouple said trip unit from said shift mechanism, and said trip springs being springably re-engageable with said trip core upon return rotation of said spray head to a position between said opposite end limits of part-circle rotation.

28. The irrigation sprinkler of claim 27 wherein said trip rod extends generally coaxially through said water driven gear drive transmission.

29. The irrigation sprinkler of claim 27 wherein said trip rod comprises a metal shaft.

30. The irrigation sprinkler of claim 27 further including means for selectively disengaging at least one of said trip springs from said trip core to permit continuous full circle spray head rotation.

31. The irrigation sprinkler of claim 30 wherein said means for selectively disengaging at least one of said trip springs from said trip core comprises a control disk coupled to one of said trip springs and movably carried between a normal part-circle position with said one trip spring engaged with said trip core and a full-circle position with said one trip spring retracted from engagement with said trip core, a spider cam mounted on said spray head and movable between a first position retracted from control disk to permit part-circle spray rotation between said opposite end limits defined by the positions of said end trip stops, and a second position engaging and displacing said control disk to said full-circle position to disengage said one trip spring from said trip core to permit full circle spray head rotation.

32. The irrigation sprinkler of claim 31 wherein said spider cam comprises a generally cylindrical boss rotatably mounted on said spray head, and a plurality of flexible spider legs radiating outwardly from said boss and each including a cam pin engageable with a cam track formed on said spray head for movement of said cam pins upon rotation of said boss between said first position retracted from said control disk and said second position engaged with said control disk.

33. The irrigation sprinkler of claim 32 wherein said boss has an upper end exposed to the exterior of said spray head, said boss upper end having a screwdriver slot formed therein.

34. The irrigation sprinkler of claim 1 wherein said sprinkler housing has a pair of water inlets formed therein with one of said water inlets being connected to the supply of irrigation water under pressure, and further including an internally threaded adapter sleeve mounted within the other of said water inlets, and an externally threaded plug seal member threadably installed into said adapter sleeve, said adapter sleeve further including a pliant seal lip formed generally at a leading end thereof for pressure activated sealing engagement with a leading end of said plug seal member when water under pressure is supplied into said sprinkler housing.

35. The irrigation sprinkler of claim 4 wherein said spray head is rotatably mounted on said pop-up riser, and further wherein said sprinkler housing has an internal vertically elongated rib formed therein, said pop-up riser having a flange thereon with a gap formed therein for sliding reception of said internal housing rib upon movement of said riser between said retracted and elevated positions, whereby said rib slidably guides said pop-up riser between said retracted and elevated positions substantially without rotation with respect to said sprinkler housing, said internal housing rib further defining a gap therein formed generally at a mid-height location to permit rotation of said riser relative to said housing at a mid-height position with said riser flange aligned with said rib gap so that said housing rib engages said riser flange to support said riser at said mid-height position.

36. The irrigation sprinkler of claim 35 wherein said riser flange defines a shallow step adjacent said riser flange gap to limit riser rotation at said mid-height position to a relatively short part-circle stroke.

37. An irrigation sprinkler for controlled distribution of irrigation water over surrounding terrain, comprising:

a sprinkler housing adapted for connection to a supply of irrigation water under pressure;

a spray head rotatably carried by said housing, and including nozzle means for projecting at least one stream of irrigation water outwardly from said housing;

a water driven gear drive transmission for rotatably driving said spray head to sweep said at least one stream of irrigation water over the surrounding terrain;

a reverse assembly including a shift mechanism movable between forward and reverse drive positions for respectively shifting said gear drive transmission between forward and reverse drive rotational directions for correspondingly reversing the direction of rotatable driving of said spray head;

said reverse assembly further including a trip unit having a pair of end trip stops rotatable with said spray head and defining the opposite end limits of a predetermined part-circle path of reversible spray head rotation, each of said end trip stops being adjustable relative to said spray head for individually and selectively setting the positions of said opposite end limits of part-circle spray head rotation; and further including means for selectively disabling at least one of said end trip stops to permit continuous full circle spray head rotation.

38. The irrigation sprinkler of claim 37 further including clutch means for engagement by said end trip stops respectively at said opposite end limits of part-circle spray head rotation and for responding thereto to displace said shift mechanism between said forward and reverse drive positions, said clutch means being disengageable upon forced over-rotation of said spray head beyond one of said opposite end limits of part-circle spray head rotation to uncouple said end trip stops from said shift mechanism, said clutch means being re-engageable upon return rotation of said spray head to a position between said opposite end limits of part-circle rotation.

39. The irrigation sprinkler of claim 37 further including a pop-up riser having said spray head mounted thereon, said pop-up riser being mounted within said sprinkler housing for movement between a normal spring-loaded position retracted substantially within said housing and an elevated spraying position with said spray head elevated above said sprinkler housing in response to connection of said housing to the supply of irrigation water under pressure.

40. The irrigation sprinkler of claim 37 wherein said water driven gear drive transmission comprises a water driven turbine, and a speed reduction transmission coupled between said turbine and said spray head.

41. The irrigation sprinkler of claim 40 wherein said turbine is rotatably carried by a turbine housing, and further wherein said speed reduction transmission comprises a plurality of speed reduction gears carried within a gear box housing and including a main drive gear driven by said turbine and an output gear rotatably driving said spray head, said gear box housing being rotatable relative to said turbine housing upon manually forced rotation of said spray head.

42. The irrigation sprinkler of claim 40 wherein said shift mechanism comprises a deflector plate mounted generally at an upstream side of said water driven turbine, said deflector plate having at least one set of first and second oppositely angled jet nozzles formed therein for respective passage of at least a portion of the irrigation water under pressure into driving communication with said water turbine, said deflector plate being movable between said forward drive position with said first jet nozzle oriented for water passage to drive said water turbine in a forward drive direction, and said reverse drive position with said second jet nozzle oriented for water passage to drive said water turbine in a reverse drive direction.

43. The irrigation sprinkler of claim 38 wherein said trip unit comprises a pair of adjustment rings rotatably mounted in stacked relation within said spray head and respectively carrying said pair of end trip stops.

44. The irrigation sprinkler of claim 43 wherein said adjustment rings each include an externally formed set of gear teeth, and further including a pair of cog wheels meshed respectively with said pair of adjustment rings, said pair of cog wheels being carried on a respective pair of adjustment posts rotatably carried by said spray head and having upper ends thereof accessible from the exterior of said spray head, said exposed upper ends of said adjustment posts having screwdriver slots formed therein.

45. The irrigation sprinkler of claim 44 wherein said adjustment rings each include a radially inwardly extending stop key forming said end trip stop thereon.

46. The irrigation sprinkler of claim 45 wherein said clutch means is mounted within said spray head in a position generally within said adjustment rings and includes a radially outwardly extending drive tab for engagement by said stop keys respectively at said opposite end limits of part-circle spray head rotation.

47. The irrigation sprinkler of claim 46 wherein said clutch means comprises a trip core having said drive tab thereon, a clutch insert, and spring means for normally retaining said clutch insert in driven engagement with said trip core, and further including a drive rod rotatably connected between said clutch insert and said shift mechanism for shifting said gear drive transmission between said forward and reverse drive positions, said clutch insert being springably disengageable from said trip core upon forced over-rotation of said spray head beyond one of said opposite end limits of part-circle spray head rotation to uncouple said trip unit from said shift mechanism, and said clutch insert being springably re-engageable with said trip core upon return rotation of said spray head to a position between said opposite end limits of part-circle rotation.

48. The irrigation sprinkler of claim 47 wherein said trip core comprises a radially outwardly extending clutch flange defining a recessed seat formed with ramped side margins, and wherein said clutch insert comprises a clutch plate having a size and shape to overlie and engage said clutch flange, said clutch plate having a lug thereon for seated reception into said recessed seat formed in said clutch flange.

49. The irrigation sprinkler of claim 47 wherein said means for selectively disabling at least one of said end trip stops comprises means for selectively disengaging said clutch insert from said trip core for disabling said end trip stops to permit continuous full circle spray head rotation.

50. The irrigation sprinkler of claim 49 wherein said means for selectively disengaging said clutch insert from said trip core comprises a spider cam mounted on said spray head and movable between a first position retracted from said clutch insert to permit part-circle spray rotation between said opposite end limits defined by the positions of said end trip stops, and a second position engaging and displacing said clutch insert to a position disengaged from said trip core to permit full circle spray head rotation.

51. The irrigation sprinkler of claim 50 wherein said spider cam comprises a generally cylindrical boss rotatably mounted on said spray head, and a plurality of flexible spider legs radiating outwardly from said boss and each including a cam pin engageable with a cam track formed on said spray head for movement of said cam pins upon rotation of said boss between said first position retracted from said clutch insert and said second position engaged with said clutch insert.

52. The irrigation sprinkler of claim 51 wherein said boss has an upper end exposed to the exterior of said spray head, said boss upper end having a screwdriver slot formed therein.

53. The irrigation sprinkler of claim 43 further including first and second trip springs mounted respectively within said pair of adjustment rings and extending generally circumferentially therein in opposite directions and each terminating in an enlarged spring bead defining one of said pair of end trip stops, and further wherein said clutch means comprises a trip core mounted generally within said adjustment rings and defining a first and second cam tracks engageable respectively by said first and second trip springs, said first and second cam tracks being formed generally as opposite mirror images each to include an angularly oriented cam flat engageable upon spray head rotation by said spring bead of the associated one of said first and second trip springs to rotatably displace said trip core, and further including a drive rod rotatably connected between said trip core and said shift mechanism for shifting said gear drive transmission between said forward and reverse drive positions, said trip springs being springably disengageable from said trip core upon forced over-rotation of said spray head beyond one of said opposite end limits of part-circle spray head rotation to uncouple said trip unit from said shift mechanism, and said trip springs being springably re-engageable with said trip core upon return rotation of said spray head to a position between said opposite end limits of part-circle rotation.

54. The irrigation sprinkler of claim 53 wherein said means for selectively disengaging at least one of said trip springs from said trip core comprises a control disk coupled to one of said trip springs and movably carried between a normal part-circle position with said one trip spring engaged with said trip core and a full-circle position with said one trip spring retracted from engagement with said trip core, a spider cam mounted on said spray head and movable between a first position retracted from control disk to permit part-circle spray rotation between said opposite end limits defined by the positions of said end trip stops, and a second position engaging and displacing said control disk to said full-circle position to disengage said one trip spring from said trip core to permit full circle spray head rotation.

55. The irrigation sprinkler of claim 54 wherein said spider cam comprises a generally cylindrical boss rotatably mounted on said spray head, and a plurality of flexible spider legs radiating outwardly from said boss and each including a cam pin engageable with a cam track formed on said spray head for movement of said cam pins upon rotation of said boss between said first position retracted from said control disk and said second position engaged with said control disk.

56. The irrigation sprinkler of claim 55 wherein said boss has an upper end exposed to the exterior of said spray head, said boss upper end having a screwdriver slot formed therein.

57. In an irrigation sprinkler having a sprinkler housing with at least two water inlets each adapted for connection to a supply of water under pressure, and a spray head including nozzle means for projecting at least one stream of irrigation water over surrounding terrain, the improvement comprising:

an internally threaded adapter sleeve mounted within a selected one of said water inlets; and an externally threaded plug seal member threadably installed into said adapter sleeve;

said adapter sleeve further including a pliant seal lip formed generally at a leading end thereof for pressure activated sealing engagement with a leading end of said plug seal member when water under pressure is supplied into said sprinkler housing.

58. The irrigation sprinkler of claim 57 wherein said adapter sleeve is adhesively mounted into said selected one of said water inlets.

59. In an irrigation sprinkler having a sprinkler housing adapted for connection to a supply of irrigation water under pressure, a spray head rotatably carried by said sprinkler housing and including nozzle means for projecting at least one stream of irrigation water outwardly from said sprinkler housing, and a water driven turbine mounted within said sprinkler housing for rotatably driving said spray head to sweep said at least one stream of irrigation water over the surrounding terrain, the improvement comprising:

at least one centrifugal brake arm rotatably carried with said water turbine, said brake arm including means for radially outward displacement by centrifugal force upon rotational driving of said turbine at a predetermined maximum rotational speed to frictionally engage an adjacent nonrotating structure and thereby limit the rotational speed of said turbine.

60. The irrigation sprinkler of claim 59 wherein said at least one centrifugal brake arm comprises a pair of centrifugal brake arms mounted in diametrically opposed relation for balanced rotation with said turbine.

61. The irrigation sprinkler of claim 59 wherein said turbine is rotatably mounted within a turbine housing, said at least one centrifugal brake arm being adapted for frictionally engaging said turbine housing upon rotational driving of said turbine at said predetermined maximum rotational speed.

62. In an irrigation sprinkler having a sprinkler housing adapted for connection to a supply of irrigation water under pressure, a spray head rotatably carried by said sprinkler housing and including nozzle means for projecting at least one stream of irrigation water outwardly from said sprinkler housing, and a water driven turbine mounted within said sprinkler housing for rotatably driving said spray head to sweep said at least one stream of irrigation water over the surrounding terrain, the improvement comprising:

a pressure regulator unit mounted generally at an upstream side of said turbine and including at least one turbine drive jet port for passage of at least a portion of the irrigation water under pressure through said jet drive port into driving communication with said water turbine; and a bypass valve normally spring-loaded to a position closing a bypass port and responsive to a predetermined water pressure for movement to an open position to open said bypass port to permit bypass flow of a portion of the irrigation water under pressure around said jet drive port and said water turbine;

said bypass port having a generally multi-legged configuration.

63. An irrigation sprinkler, comprising:

a sprinkler housing adapted for connection to a supply of irrigation water under pressure;

a spray head rotatably carried by said sprinkler housing and including nozzle means for projecting at least one stream of irrigation water outwardly from said sprinkler housing; and a pop-up riser having said spray head mounted thereon, said pop-up riser being mounted within said sprinkler housing for movement between a normal spring-loaded position retracted substantially within said housing and an elevated spraying position with said spray head elevated above said sprinkler housing in response to connection of said housing to the supply of irrigation water under pressure;

said sprinkler housing having an internal vertically elongated rib formed therein, and said pop-up riser having a flange thereon with a gap formed therein for sliding reception of said internal housing rib upon movement of said riser between said retracted and elevated positions, whereby said rib slidably guides said pop-up riser between said retracted and elevated positions substantially without rotation with respect to said sprinkler housing;

said internal housing rib further defining a gap therein formed generally at a mid-height location to permit rotation of said riser relative to said housing at a mid-height position with said riser flange aligned with said rib gap so that said housing rib engages said riser flange to support said riser at said mid-height position.

64. The irrigation sprinkler of claim 63 wherein said riser flange defines a shallow step adjacent said riser flange gap to limit riser rotation at said mid-height position to a relatively short part-circle stroke.

* * * * *